US006909858B2

(12) United States Patent
Hama et al.

(10) Patent No.: US 6,909,858 B2
(45) Date of Patent: Jun. 21, 2005

(54) IMAGE FORMING APPARATUS, TONER-ADHESION CALCULATION METHOD AND DATA PROCESSING METHOD

(75) Inventors: Takashi Hama, Nagano-ken (JP); Hidetsugu Shimura, Nagano-ken (JP); Keiichi Taguchi, Nagano-ken (JP); Hiroshi Nakazato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 10/633,689

(22) Filed: Aug. 5, 2003

(65) Prior Publication Data

US 2004/0105691 A1 Jun. 3, 2004

(30) Foreign Application Priority Data

Aug. 9, 2002 (JP) ..... 2002-232252
Jun. 9, 2003 (JP) ..... 2003-163189

(51) Int. Cl.[7] ..... G03G 15/00
(52) U.S. Cl. ..... 399/49
(58) Field of Search ..... 399/46, 49, 53, 399/60

(56) References Cited

U.S. PATENT DOCUMENTS 4,387,211 A 6/1983 Yasuda et al.
4,999,673 A * 3/1991 Bares ..... 399/49
5,365,313 A * 11/1994 Nagamochi et al. ..... 399/49
5,987,271 A * 11/1999 Regelsberger et al. .... 399/46 X
6,229,972 B1 * 5/2001 Rushing ..... 399/49 X

FOREIGN PATENT DOCUMENTS

| | | | |
|---|---|---|---|
| EP | 0-055-449 A1 | | 7/1982 |
| EP | 0-055-449 B1 | | 4/1985 |
| JP | 57-109825 A | | 7/1982 |
| JP | 60-260066 | * | 12/1985 |
| JP | 61-59333 B2 | | 12/1986 |
| JP | 01-169468 | * | 7/1989 |
| JP | 11-015217 | * | 1/1999 |
| JP | 11-030908 | * | 2/1999 |
| JP | 11-084762 | * | 3/1999 |
| JP | 2001-125325 | * | 5/2001 |
| JP | 2001-324832 A | | 11/2001 |
| WO | WO 03/071359 A1 | | 8/2003 |

* cited by examiner

*Primary Examiner*—Sandra L. Brase
(74) *Attorney, Agent, or Firm*—Sughrue Mion, PLLC

(57) ABSTRACT

Output signals Vp from a density sensor are sampled for plural positions on an intermediate transfer belt and an amount of toner adhesion is determined based on the results of sampling. Since these sample data pieces may contain noises, each predetermined number of data pieces of higher order and of lower order are removed from the resultant sample data string. The removed data pieces are each replaced by an average value Vpavg of the other sample data pieces. The amount of toner adhesion is calculated based on the data string thus replaced.

23 Claims, 34 Drawing Sheets

FIG. 14A HIGH-DENSITY PATCH IMAGE

| TONER CHARACTER INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.990 | 0.988 | 0.984 | 0.982 |
| | ~2000000 | 0.988 | 0.984 | 0.982 | 0.982 |
| | ~6666666 | 0.984 | 0.982 | 0.982 | 0.982 |
| | ~12000000 | 0.982 | 0.982 | 0.982 | 0.982 |

FIG. 14B LOW-DENSITY PATCH IMAGE

| TONER CHARACTER INFORMATION ="0" | | DEVELOPER ROLLER ROTATING TIME (sec) | | | |
|---|---|---|---|---|---|
| | | ~1325 | ~3975 | ~6625 | ~10600 |
| DOT COUNT VALUE | ~1000000 | 0.185 | 0.182 | 0.181 | 0.180 |
| | ~2000000 | 0.182 | 0.181 | 0.180 | 0.180 |
| | ~6666666 | 0.181 | 0.180 | 0.180 | 0.180 |
| | ~12000000 | 0.180 | 0.180 | 0.180 | 0.180 |

IMAGE FORMING APPARATUS, TONER-ADHESION CALCULATION METHOD AND DATA PROCESSING METHOD

BACKGROUND OF THE INVENTION

1. Field of the Invention

The present invention relates to an image forming apparatus adapted to irradiate light on a surface of an image carrier for detection of light therefrom and to determine a density of an image on the image carrier based on the detection results, and to an image density calculation method therefore.

2. Description of the Related Art

Image forming apparatuses such as copy machines, printers and facsimile machines utilizing the electrophotographic techniques may encounter density variations of toner images associated with individually different characters of apparatuses, variations with time, or changes in conditions surrounding the apparatus which include temperature, moisture and the like. Heretofore, there have been proposed a variety of techniques for ensuring stable image density, which include, for example, a technique wherein a small test patch (patch image) is formed on the image carrier such that a density control factor affecting the image density may be optimized based on the density of the patch image. According to the technique, a desired image density is attained by forming a predetermined toner image on the image carrier with the density control factor set to a different value each time; sensing the density of the toner image, as the patch image, on the image carrier; and controlling the density control factor in a manner to establish coincidence between the density of the patch image and a predetermined target density.

While there have heretofore been proposed a variety of techniques for taking measurement of the patch image density (hereinafter, referred to as "patch sensing technique"), the techniques utilizing optical means are most commonly used. Specifically, the technique takes a procedure including the steps of irradiating light on a surface region of the image carrier or an intermediate member with the patch image formed thereon; detecting light reflected from or transmitted through the surface region by means of an optical sensor; and determining the density of the patch image based on the amount of detected light.

In order to set the density control factor to an optimum value for forming the toner image of good quality, how accurately the density of the formed patch image is sensed is an important point for the image forming apparatus adapted to adjust the density control factor based on the density of the patch image. Unfortunately, the above conventional patch sensing techniques have the following problems.

There may be a case where because of changes in the surface conditions of the image carrier due to mars or dirt thereon or of noise factors such as electrical noises, noises are superimposed on a sensor output so that a sensed value does not indicate a correct density of the patch image. The conventional patch sensing technique for image forming apparatus does not give adequate consideration to such influences of noises. Since the density control factor is adjusted based on the density of the patch image determined from such a sensor output containing the noises, the density control factor may not always be optimized, resulting in a deteriorated image quality.

The incidence and magnitude of noises vary from condition to condition. Therefore, it is quite difficult to identify the nature of noises contained in the sensor output. On this account, a demand exists for the establishment of a technique for achieving high-accuracy determination of the patch image density through effective removal of the noises.

SUMMARY OF THE INVENTION

It is not always easy for the patch sensing technique of this type to directly determine the density (optical density) of an image transferred to a final receiving media such as paper or in other words, an image actually observed by a user. However, the image density can be indirectly evaluated by determining the amount of toner adhered to the image carrier (e.g., mass of adhered toner per unit area) as a physical quantity closely related with the image density. The technique for accurately determining the amount of toner adhered to the image carrier may be applied not only to the measurement of the patch image density but also to the measurement of the densities of other images or the evaluation of contamination or degradation of the image carrier.

In view of the foregoing, it is a first object of the invention to provide a measurement technique for achieving high-accuracy determination of the amount of toner adhered to the image carrier as eliminating the influences of noises. A second object of the invention is to ensure a stable formation of toner images of high quality by accurately determining the patch image density and optimizing the density control factor based on the density thus determined.

A "subject region of calculation" of the invention is defined to be a region accounting for a given area of the surface of the image carrier. The invention discloses a technique for determining the amount of toner adhered to the subject region of calculation with high accuracies.

A "measurement area" is defined to be an area accounting for a partial area in the surface of the image carrier, such that reflected light rays from individual points in the measurement area can be simultaneously detected by an optical sensor of the invention. That is, the "optical sensor" of the invention is designed to detect light reflected from the "measurement area" of the surface of the image carrier and to output a signal corresponding to the amount of detected light.

According to the invention, the amount of toner adhered to the "subject region of calculation" accounting for a predetermined area of the surface of the image carrier is calculated. To this end, measurement is taken directly on the amounts of light reflected from plural "measurement areas" in the "subject region of calculation" or from the "subject region of calculation" and its plural neighboring "measurement areas". Then, the amount of toner adhered to the "subject region of calculation" is indirectly determined by subjecting the measurement results to predetermined processings including noise correction.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 14A and 14B are drawings which show examples of look-up tables which are for calculating a control target value;

DETAILED DESCRIPTION OF THE PREFERRED EMBODIMENTS

First Preferred Embodiment (1) Structure of Apparatus

Figure 1:
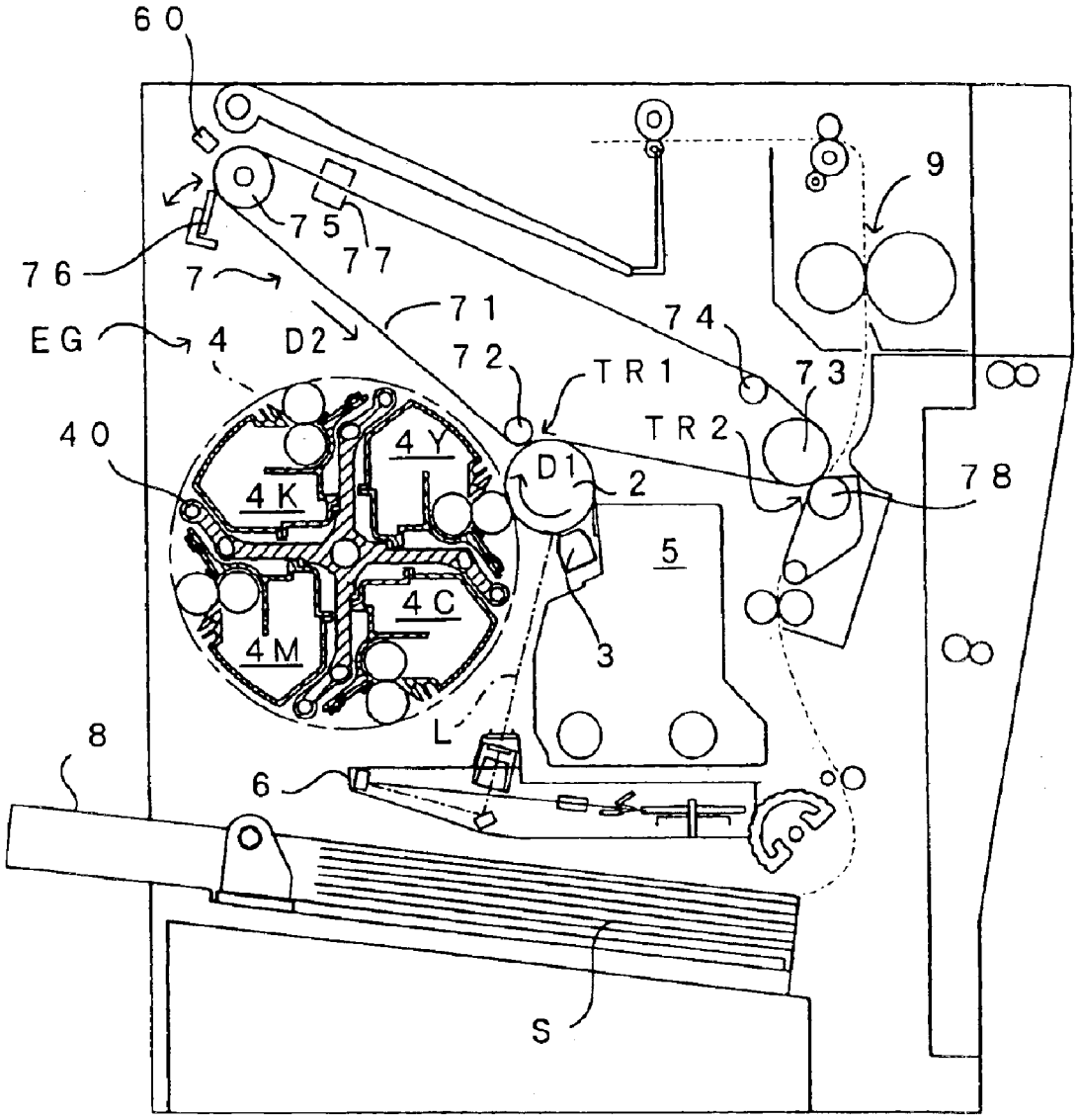
FIG. 1 is a drawing of a first preferred embodiment of an image forming apparatus according to the present invention.
Figure 2:
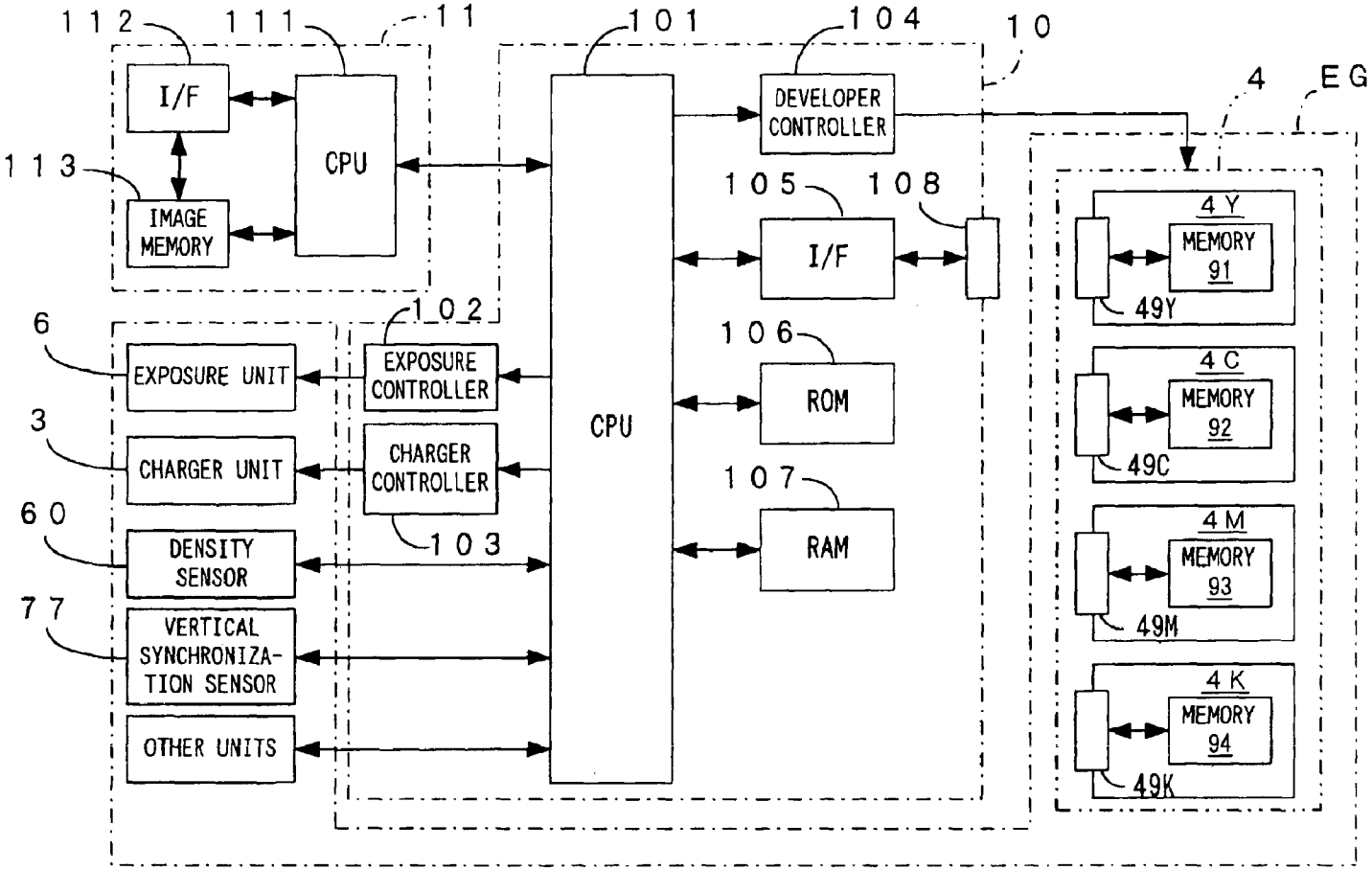
FIG. 2 is a block diagram of an electric structure of the image forming apparatus which is shown in FIG. 1.

FIG. 1 is a drawing of a first preferred embodiment of an image forming apparatus according to the present invention. FIG. 2 is a block diagram of an electric structure of the image forming apparatus which is shown in FIG. 1. This image forming apparatus is an apparatus which superposes toner in four colors of yellow (Y), magenta (M), cyan (C) and black (K) and accordingly forms a full-color image, or uses only toner in black (K) and accordingly forms a monochrome image. In this image forming apparatus, when an image signal is fed to a main controller 11 from an external apparatus such as a host computer in response to an image formation request from a user, an engine controller 10 controls respective portions of an engine EG in accordance with an instruction received from the main controller 11 and an image which corresponds to the image signal is formed on a sheet S. As described later, the engine controller 10 functions as a "control means" of the present invention.

In the engine EG, a photosensitive member 2 is disposed so that the photosensitive member 2 can freely rotate in the arrow direction D1 in FIG. 1. Around the photosensitive member 2, a charger unit 3, a rotary developer unit 4 and a cleaner 5 are disposed in the rotation direction D1. A charger controller 103 applies a charging bias upon the charger unit 3, whereby an outer circumferential surface of the photosensitive member 2 is charged uniformly to a predetermined surface potential.

An exposure unit 6 emits a light beam L toward the outer circumferential surface of the photosensitive member 2 which is thus charged by the charger unit 3. The exposure unit 6 makes the light beam L expose on the photosensitive member 2 in accordance with a control instruction fed from an exposure controller 102 and forms an electrostatic latent image corresponding to the image signal. For instance, when an image signal is fed to a CPU 111 of the main controller 11 via an interface 112 from an external apparatus such as a host computer, a CPU 101 of the engine controller 10 outputs a control signal corresponding to the image signal at predetermined timing, the exposure unit 6 emits the light beam L upon the photosensitive member 2, and an electrostatic latent image corresponding to the image signal is formed on the photosensitive member 2. Further, when a patch image which will be described later is to be formed in accordance with a necessity, a control signal corresponding to a patch image signal which expresses a predetermined pattern is fed from the CPU 101 to the exposure controller 102, and an electrostatic latent image corresponding to this pattern is formed on the photosensitive member 2.

The developer unit 4 develops thus formed electrostatic latent image with toner. In other words, the developer unit 4 comprises a support frame 40 which is disposed for free rotation about a shaft, a rotation driver not shown, and a yellow developer 4Y, a cyan developer 4C, a magenta developer 4M and a black developer 4K which are freely attachable to and detachable from the support frame 40 and house toner of the respective colors. A developer controller 104 controls the developer unit 4 as shown in FIG. 2. The developer unit 4 is driven into rotations based on a control instruction from the developer controller 104, and the developers 4Y, 4C, 4M and 4K are selectively positioned at a predetermined developing position facing the photosensitive member 2 and supply the toner of the selected color onto the surface of the photosensitive member 2. As a result, the electrostatic latent image on the photosensitive member 2 is visualized with the toner of the selected color. Shown in FIG. 1 is a state that the yellow developer 4Y is positioned at the developing position.

Figure 3:
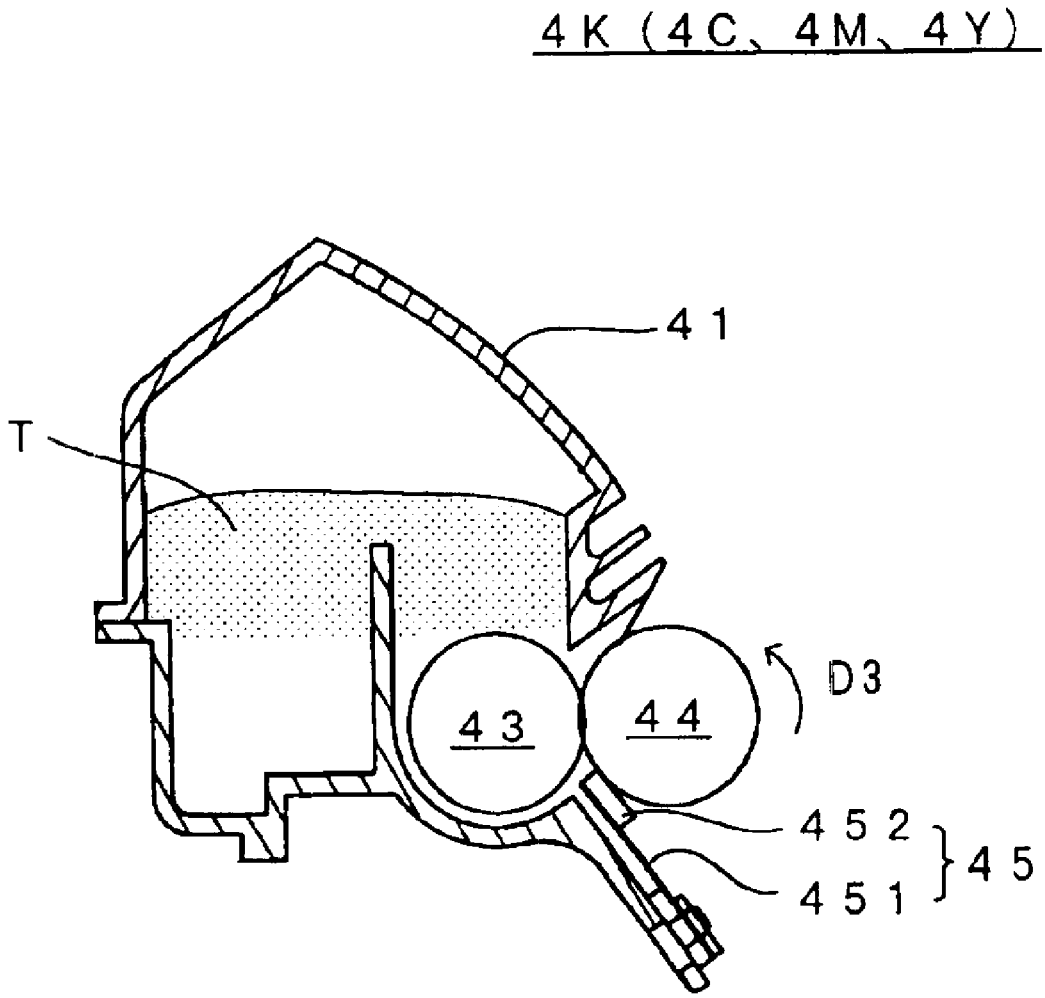
FIG. 3 is a cross sectional view of a developer of the image forming apparatus.

Since the developers 4Y, 4C, 4M and 4K all have the same structure, a structure of the developer 4K will now be described in more detail with reference to FIG. 3. The other developers 4Y, 4C and 4M remain the same in structure and function. FIG. 3 is a cross sectional view of the developer of the image forming apparatus. In this developer 4K, a supply roller 43 and a developer roller 44 are axially attached to a housing 41 which houses toner T inside. As the developer 4K is positioned at the developing position described above, the developer roller 44 abuts on the photosensitive member 2 or gets positioned at an opposed position with a predetermined gap from the photosensitive member 2, and the rollers 43 and 44 rotate in a predetermined direction as they are engaged with the rotation driver (not shown) which is disposed to the main section. The developer roller 44 is made as a cylinder of metal, such as iron, copper and aluminum, or an alloy such as stainless steel, or so as to receive a developing bias as described later. As the two rollers 43 and 44 rotate while remaining in contact, the black toner is rubbed against a surface of the developer roller 44 and a toner layer having predetermined thickness is accordingly formed on the surface of the developer roller 44.

Further, in the developer 4K, a restriction blade 45 is disposed which restricts the thickness of the toner layer formed on the surface of the developer roller 44 into the predetermined thickness. The restriction blade 45 comprises a plate-like member 451 of stainless steel, phosphor bronze or the like and an elastic member 452 of rubber, a resin material or the like attached to a front edge of the plate-like member 451. A rear edge of the plate-like member 451 is fixed to the housing 41, which ensures that the elastic member 452 attached to the front edge of the plate-like member 451 is positioned on the upstream side to the rear edge of the plate-like member 451 in a rotation direction D3 of the developer roller 44. The elastic member 452 elastically abuts on the surface of the developer roller 44, thereby restricting the toner layer formed on the surface of the developer roller 44 finally into the predetermined thickness.

Toner particles which form the toner layer formed on the surface of the developer roller 44 are charged, due to friction with the supply roller 43 and the restriction blade 45. Although the example described below assumes that the toner has been negatively charged, it is possible to use toner which becomes positively charged as potentials at the respective portions of the apparatus are appropriately changed.

The toner layer thus formed on the surface of the developer roller 44 is gradually transported, owing to the rotations of the developer roller 44, to an opposed position facing the photosensitive member 2 on which surface the electrostatic latent image has been formed. As the developing bias from the developer controller 104 is applied upon the developer roller 44, the toner carried on the developer roller 44 partially adheres to respective portions within the surface of the photosensitive member 2 in accordance with surface potentials in these portions. The electrostatic latent image on the surface of the photosensitive member 2 is visualized as a toner image in this toner color in this manner.

While the developing bias applied upon the developer roller 44 may be a direct current voltage or a developing bias which is obtained by superimposing an alternating current voltage upon a direct current voltage, in an image forming apparatus of the non-contact developing type in which the photosensitive member 2 and the developer roller 44 in particular are located away from each other and toner transfers between the two for the purpose of development with the toner, it is preferable for efficient toner transfer that the developing bias has a voltage waveform which is obtained by superimposing an alternating current voltage, such as a sine wave, a chopping wave and a square wave, upon a direct current voltage. Although the value of a direct current voltage and the amplitude, the frequency, the duty ratio and the like of an alternating current voltage may have any desired values, in the following description, a direct current component (average value) of the developing bias will be referred to as a n average developing bias Vavg, regardless of whether the developing bias contains an alternating current component.

A preferable example of the developing bias described above used in an image forming apparatus of the non-contact developing type will now be described. For instance, the waveform of the developing bias is obtained by superimposing an alternating current voltage having a square wave upon a direct current voltage, the frequency of the square wave is 3 kHz and a peak-to-peak voltage Vpp is 1400 V. In addition, as described later, although it is possible to change the developing bias Vavg as one of density control factors in this preferred embodiment. The developing bias may be changed in the variable range of (−110 V) to (−330 V) for example, considering an influence over an image density, a variation in characteristics of the photosensitive member 2, etc. These numerical figures are not limited to those mentioned above, but should rather be appropriately changed in accordance with the structure of the apparatus.

In addition, as shown in FIG. 2, memories 91 through 94, which store data regarding a production batch and/or the history of use of the developers, characteristics of the toner inside and the like, are disposed to the respective developers 4Y, 4C, 4M and 4K. Connectors 49Y, 49C, 49M and 49K are disposed to the respective developers 4Y, 4C, 4M and 4K. These are selectively connected with a connector 108 which is disposed to the main section in accordance with a necessity, allow that data are transferred between the CPU 101 and the respective memories 91 through 94 via an interface 105, and thus manage various types of information on the developers such as management of consumables. While data are sent and received with the connector 108 of the main section and the connector 49Y and the like of the developers mechanically fit with each other in this embodiment, the data transfer may be non-contact data transfer using other electromagnetic means such as radio communications. Further, the memories 91 through 94 which store data unique to the respective developers 4Y, 4C, 4M and 4K are preferably non-volatile memories which are capable of saving the unique data even when a power source is OFF, when the developers have been detached from the main section or on other occasions. Flash memories, ferroelectric memories, EEPROMs and the like may be used as such non-volatile memories.

The structure of the apparatus will be described continuously, referring to FIG. 1 again. The toner image developed by the developer unit 4 in the manner described above is primarily transferred onto an intermediate transfer belt 71 of a transfer unit 7 in a primary transfer region TR1. The transfer unit 7 comprises the intermediate transfer belt 71 which runs across a plurality of rollers 72 through 75 and functions as an "image carrier" of the present invention, and a driver (not shown) which drives a roller 73 into rotations to thereby drive the intermediate transfer belt 71 into rotations in a predetermined rotation direction D2. At a position facing the roller 73 across the intermediate transfer belt 71, a secondary transfer roller 78 is disposed which is attached to and detached from a surface of the belt 71 by an electromagnetic clutch not shown. For transfer of a color image onto the sheet S, toner images in the respective colors on the photosensitive member 2 are superposed one atop the other on the intermediate transfer belt 71, thereby forming a color image. Further, on the sheet S unloaded from a cassette 8 and transported to a secondary transfer region TR2 which is located between the intermediate transfer belt 71 and the secondary transfer roller 78, the color image is secondarily transferred. The sheet S now seating thus formed color image is transported to a discharging tray which is disposed to a top surface portion of the main section of the apparatus via a fixing unit 9. Static eliminating means not shown resets a surface potential of the photosensitive member 2 as it is after the primary transfer of the toner image onto the intermediate transfer belt 71. After removal of the toner remaining on the surface of the photosensitive member 2 by a cleaner 5, the charger unit 3 charges the photosensitive member 2.

When it is necessary to further form images, the operation above is repeated, a necessary number of images are accordingly formed, and the series of image forming operation ends. The apparatus remains on standby until a new image signal is received, and for the purpose of suppressing an energy consumption in the standby state, the apparatus switches from the standby operation to a suspended state. In short, the photosensitive member 2, the developer roller 44, the intermediate transfer belt 71 and the like stop rotating and the application of the developing biases upon the developer roller 44 and the charger unit 3 is stopped, whereby the apparatus enters the operation-suspended state.

Further, a cleaner 76, a density sensor 60 and a vertical synchronization sensor 77 are disposed in the vicinity of the roller 75. Of these, the cleaner 76 can move freely to be attached to and detached from the roller 75, owing to the electromagnetic clutch not shown. In a condition that the cleaner 76 has moved to the roller 75, a blade of the cleaner 76 abuts on the surface of the intermediate transfer belt 71 which runs around the roller 75 and removes the toner which remains adhering to the outer circumferential surface of the intermediate transfer belt 71 after the secondary transfer. Meanwhile, the vertical synchronization sensor 77 is a sensor which detects a reference position of the intermediate transfer belt 71, and functions as a vertical synchronization sensor which is for obtaining a synchronizing signal which is outputted in relation to rotations of the intermediate transfer belt 71, namely, a vertical synchronizing signal Vsync. In this apparatus, the operations of the respective portions of the apparatus are controlled based on the vertical synchronizing signal Vsync, to thereby time the operations of the respective portions to each other and to accurately superimpose toner images of the respective colors one atop the other. In addition, the density sensor 60 is disposed facing the surface of the intermediate transfer belt 71, and has such a structure which permits the density sensor 60 to measure a density of a patch image which is formed on the outer circumferential surface of the intermediate transfer belt 71.

In FIG. 2, denoted at 113 is an image memory which is disposed to the main controller 11 to store an image signal which is fed from an external apparatus such as a host computer via the interface 112. Denoted at 106 is a ROM which stores a calculation program executed by the CPU 101, control data for control of the engine EG, etc. Denoted at 107 is a RAM which temporarily stores a calculation result derived by the CPU 101, other data, etc.

Figure 4:
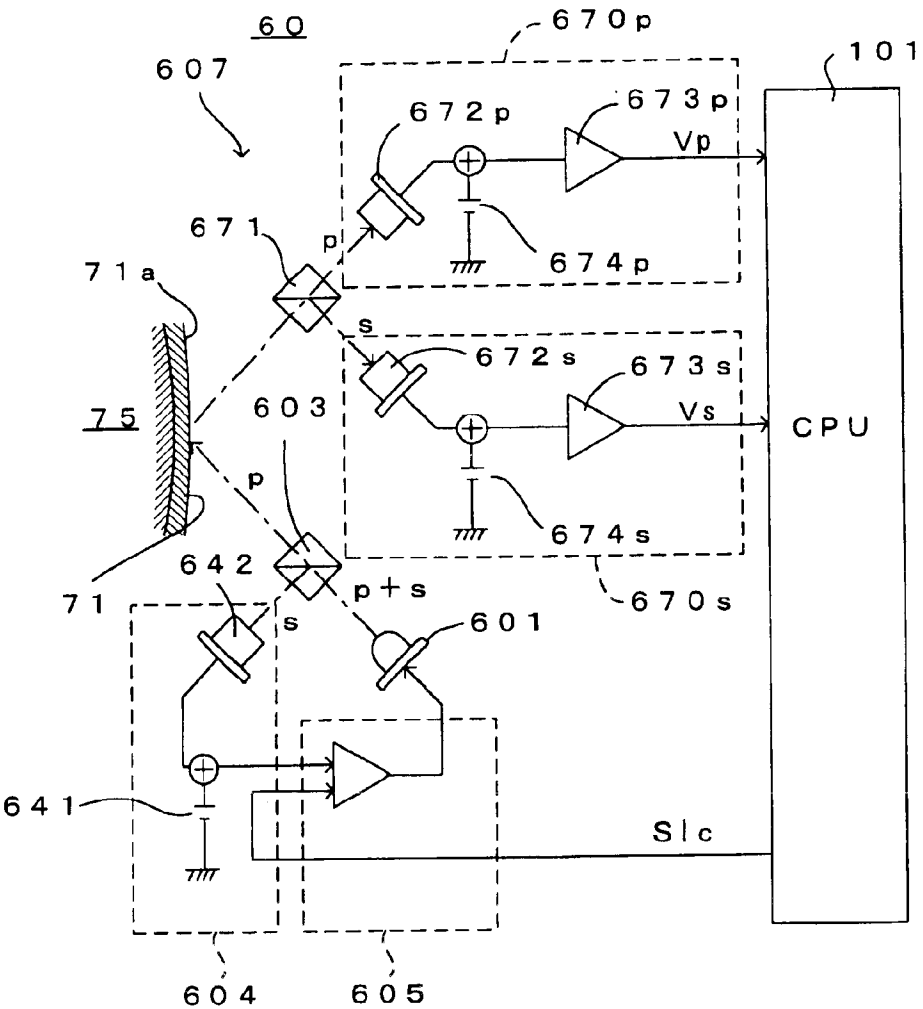
FIG. 4 is a drawing which shows a structure of a density sensor.

FIG. 4 is a drawing which shows a structure of the density sensor. The density sensor 60 comprises a light emitter element 601, such as an LED, which functions as "light emitting means" of the present invention and which irradiates light upon a wound area 71*a* which corresponds to a surface area of the intermediate transfer belt 71 which lies on the roller 75. Disposed to the density sensor 60 are a polarizer beam splitter 603, a light receiver unit for monitoring irradiated light amount 604 and an irradiated light amount adjusting unit 605, for the purpose of adjusting the irradiated light amount of irradiation light in accordance with a light amount control signal Slc which is fed from the CPU 101 as described later.

The polarizer beam splitter 603 is, as shown in FIG. 4, disposed between the light emitter element 601 and the intermediate transfer belt 71. The polarizer beam splitter 603 splits light emitted from the light emitter element 601 into p-polarized light, whose polarizing direction is parallel to the surface of incidence of the irradiation light on the intermediate transfer belt 71, and s-polarized light whose polarizing direction is perpendicular to the surface of incidence of the irradiation light. The p-polarized light impinges as it is upon the intermediate transfer belt 71, while the s-polarized light impinges upon the light receiver unit 604 for monitoring irradiated light amount after emitted from the polarizer beam splitter 603, so that a signal which is in proportion to the irradiated light amount is outputted to the irradiated light amount adjusting unit 605 from a light receiver element 642 of the light receiver unit 604.

Based on the signal from the light receiver unit 604 and a light amount control signal Slc from the CPU 101 of the engine controller 10, the irradiated light amount adjusting unit 605 feedback-controls the light emitter element 601 and adjusts the irradiated light amount of the light irradiated upon the intermediate transfer belt 71 from the light emitter element 601 into a value which corresponds to the light amount control signal Slc. The irradiated light amount can thus be changed and adjusted appropriately within a wide range according to this embodiment.

In addition, an input offset voltage 641 is applied to the output side of the light receiver element 642 of the light receiver unit 604 for monitoring irradiated light amount, and the light emitter element 601 is maintained turned off unless the light amount control signal Slc exceeds a certain signal level according to this embodiment. This prevents the light emitter element 601 from erroneously turning on because of a noise, a temperature drift, etc.

As the light amount control signal Slc having a predetermined level is fed to the irradiated light amount adjusting unit 605 is fed from the CPU 101, the light emitter element 601 turns on and p-polarized light is irradiated as irradiation light upon the intermediate transfer belt 71. The p-polarized light is reflected by the intermediate transfer belt 71. Of light components of the reflection light, a reflection light amount detector unit 607 detects the light amount of the p-polarized light and the light amount of the s-polarized light respectively, and signals corresponding to the respective light amounts are outputted to the CPU 101.

As shown in FIG. 4, the reflection light amount detector unit 607 comprises a polarized light beam splitter 671, a light receiver unit 670*p* and a light receiver unit 670*s*. The polarized light beam splitter 671 is disposed on an optical path of the reflection light. The light receiver unit 670*p* receives p-polarized light transmitted by the polarization light beam splitter 671 and outputs a signal which corresponds to the light amount of the p-polarized light. And the light receiver unit 670*s* receives s-polarized light split by the polarization light beam splitter 671 and outputs a signal which corresponds to the light amount of the s-polarized light. In the light receiver unit 670*p*, a light receiver element 672*p* receives the p-polarized light from the polarization light beam splitter 671, and after an amplifier circuit 673*p* amplifies an output from the light receiver element 672*p*, an amplified signal is outputted as a signal Vp which corresponds to the light amount of the p-polarized light to the CPU 101. Meanwhile, like the light receiver unit 670*p*, the light receiver unit 670*s* comprises a light receiver unit 672*s* and an amplifier circuit 673*s* and outputs a signal Vs which corresponds to the light amount of the s-polarized light. Hence, it is possible to independently calculate the light amounts of the mutually different two component light (the p-polarized light and the s-polarized light) among the light components of the reflection light. The light receiver units 670*p* and 670*s* function as "light amount detecting means" of the present invention.

Further, in this embodiment, output offset voltages 674*p* and 674*s* are respectively applied to the output side of the light receiver elements 672*p* and 672*s*, and even when outputs from the respective light receiver elements are zero, that is, even when the reflection light amounts are zero, the amplifier circuits 673*p* and 673*s* reach a predetermined positive potential. This permits to output appropriate output voltages which correspond to the reflection light amounts while avoiding a dead zone in the vicinity of the zero inputs to the amplifier circuits 673*p* and 673*s*.

The signals representing these output voltages Vp and Vs are fed to the CPU 101 via an A/D convertor circuit not shown, and the output voltages Vp and Vs are sampled at predetermined time intervals (which are 8 msec in this embodiment). Based on the results of the sampling, the CPU 101 adjusts density control factors for stabilization of an image density, such as the developing bias and the exposure energy, which affect an image density. The adjustment operation is executed at proper timing which may be the time of turning on of the power source of the apparatus, immediately after any of the units has been exchanged, etc. To be more specific, while changing the density control factors above over multiple stages for each one of the toner colors, the image forming operation is executed in accordance with an image signal which is image data which correspond to a predetermined patch image pattern and are stored in advance in the ROM 106, whereby a small test image (patch image) corresponding to the image signal is formed. The density sensor 60 then detects a patch image density, and each density control factor is adjusted so that an optimal image forming condition to achieve a desired image density based on the result of the detection will be obtained. Adjustment operation of the density control factors will now be described.

(2) Adjustment Operation

Figure 5:
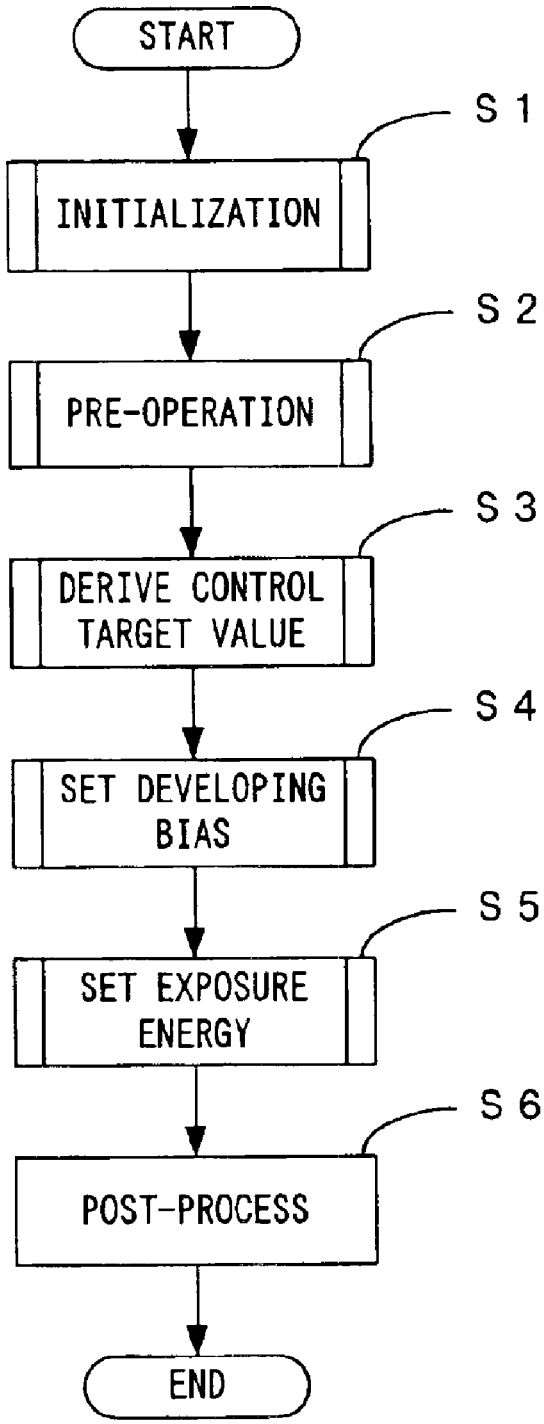
FIG. 5 is a flow chart which shows the outline of optimization of a density control factor in the first preferred embodiment.

FIG. 5 is a flow chart which shows the outline of the adjustment operation of the density control factors in this preferred embodiment. The operation includes six sequences in the following order: initialization (Step S1); a pre-operation (Step S2); a process of deriving a control target value (Step S3); a developing bias setting process (Step S4); an exposure energy setting process (Step S5); and a post-process (Step S6). In these sequences, steps S3 through S5 correspond to an "optimization" of the present invention. Detailed operations in the respective sequences will now be described.

A. Initialization

Figure 6:
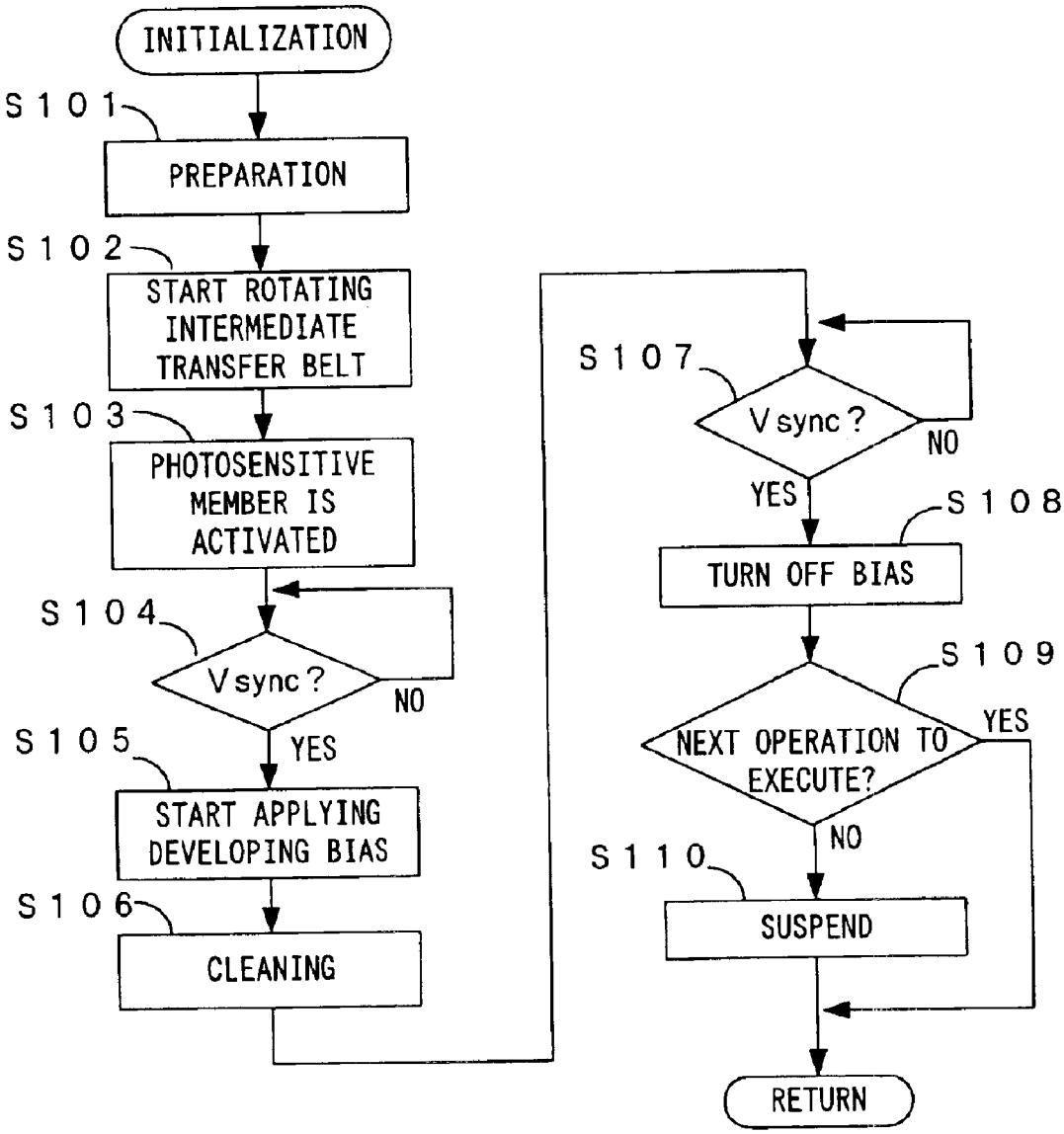
FIG. 6 is a flow chart which shows initialization in the first preferred embodiment.

FIG. 6 is a flow chart which shows initialization in this embodiment. During the initialization, first, as preparation (Step S101), the developer unit 4 is driven into rotations and positioned at a so-called home position, and the cleaner 76 and the secondary transfer roller 78 are moved to positions away from the intermediate transfer belt 71 using the electromagnetic clutch. In this condition, driving of the intermediate transfer belt 71 is started (Step S102) and the photosensitive member 2 is driven into rotations and static elimination is started so that the photosensitive member 2 is activated (Step S103).

As the vertical synchronizing signal Vsync which is indicative of the reference position of the intermediate transfer belt 71 is detected and rotations of the intermediate transfer belt 71 is accordingly confirmed (Step S104), application of predetermined biases upon the respective portions of the apparatus is started (Step S105). That is, the charger controller 103 applies the charging bias upon the charger unit 3 to thereby charge the photosensitive member 2 to a predetermined surface potential, and a bias generator not shown then applies a predetermined primary transfer bias upon the intermediate transfer belt 71.

In this condition, the intermediate transfer belt 71 is cleaned (Step S106). In short, the cleaner 76 abuts on the surface of the intermediate transfer belt 71 and the intermediate transfer belt 71 is then rotated approximately one round in this condition, thereby removing the toner, dirt and the like which remain adhering to the surface of the intermediate transfer belt 71. The secondary transfer roller 78 applied with a cleaning bias then abuts on the intermediate transfer belt 71. The cleaning bias has the opposite polarity to that of a secondary transfer bias which is applied upon the secondary transfer roller 78 during execution of an ordinary image forming operation. Hence, the toner which remains adhering to the secondary transfer roller 78 moves to the surface of the intermediate transfer belt 71, and the cleaner 76 removes the toner off from the surface of the intermediate transfer belt 71. As the cleaning of the intermediate transfer belt 71 and the secondary transfer roller 78 ends in this fashion, the secondary transfer roller 78 is moved away from the intermediate transfer belt 71 and the cleaning bias is turned off. Upon receipt of the next vertical synchronizing signal Vsync (Step S107), the charging bias and the primary transfer bias are turned off (Step S108).

Further, in this embodiment, the CPU 101 can execute initialization not only when adjustment of density control factors is to be performed but instead when needed independently of other processing. So, when the next process is to be executed following this (Step S109), the initialization is ended in the condition that the process has been executed up to the step S108 described above, and the next process is carried out. When the next process is not in a plan, as a suspend process (Step S110), the cleaner 76 is moved away from the intermediate transfer belt 71, and the static eliminating process and the drive-rotations of the intermediate transfer belt 71 is stopped. In this case, it is preferable that the intermediate transfer belt 71 is stopped in such a manner that the reference position of the intermediate transfer belt 71 is immediately before an opposed position facing the vertical synchronization sensor 77. This is because the state the intermediate transfer belt 71 is rotating is confirmed by means of detection of the vertical synchronizing signal Vsync when the intermediate transfer belt 71 is in rotations in subsequent processing, and it is therefore possible to determine in a short period of time whether there is abnormality based on whether the vertical synchronizing signal Vsync is detected immediately after the start of the driving in the manner described above.

B. Pre-Operation

Figure 7:
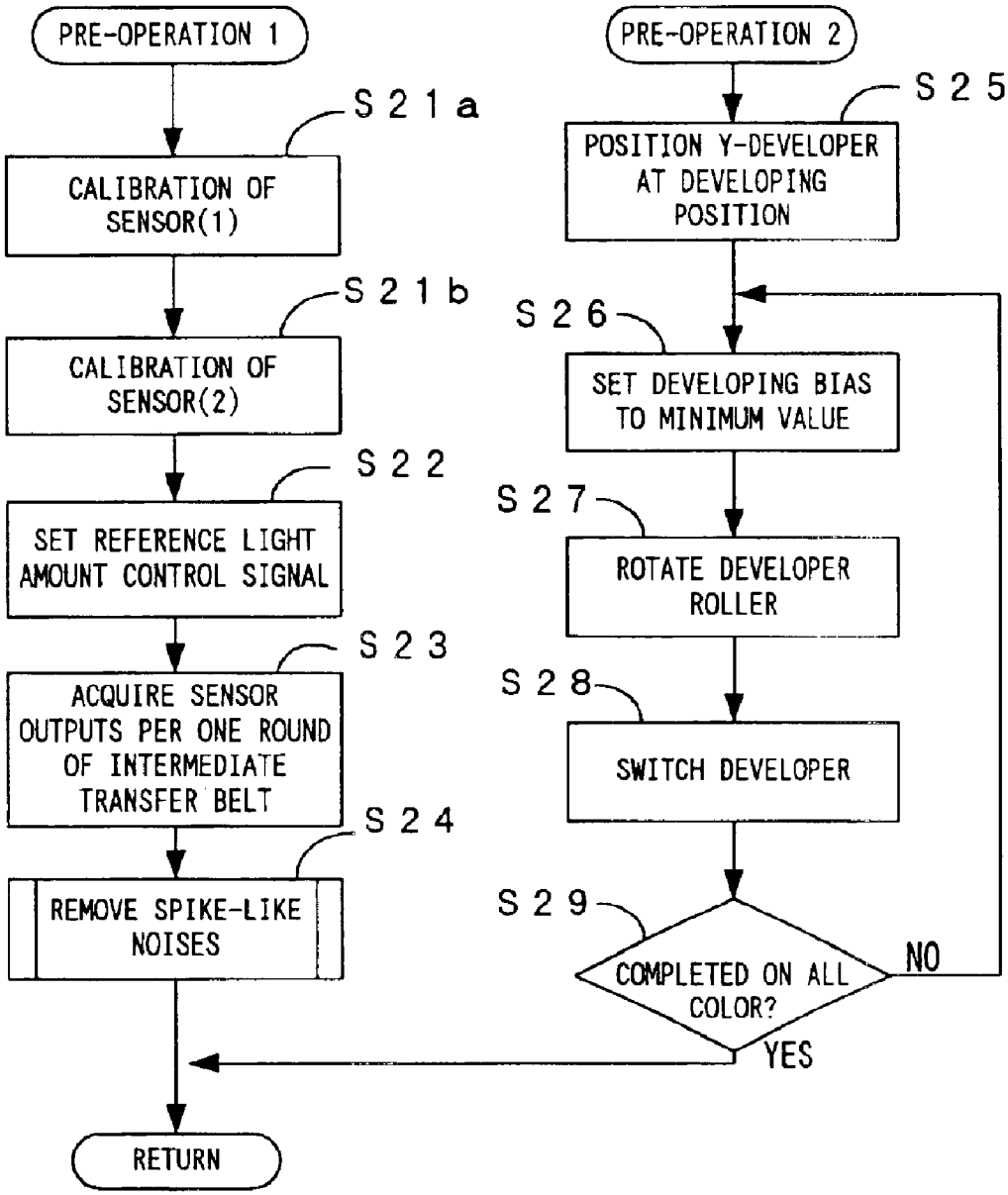
FIG. 7 is a flow chart which shows a pre-operation in the first preferred embodiment.

FIG. 7 is a flow chart which shows a pre-operation in this preferred embodiment. During the pre-operation, as pre-processing prior to formation of a patch image which will be described later, two processes are performed in parallel. More specifically, in parallel to adjustment of operating conditions for the respective portions of the apparatus in an effort to accurately optimize the density control factors (a pre-operation 1), the developer rollers 44 disposed to the respective developers 4Y, 4C, 4M and 4K are rotated idle (a pre-operation 2).

B-1. Setting Operating Conditions (Pre-Operation 1)

During the left-hand side flow (the pre-operation 1) in FIG. 7, first, the density sensor 60 is calibrated (Step S21*a*, Step S21*b*). The calibration (1) at the step S21*a* requires to detect the output voltages Vp and Vs from the light receiver units 670*p* and 670*s* as they are when the light emitter element 601 of the density sensor 60 is OFF, and to store these as dark outputs Vp0 and Vs0. Next, during the calibration (2) at the step S21*b*, the light amount control signal Slc to be fed to the light emitter element 601 is changed so as to achieve two types of ON-states which are a low light amount and a high light amount, and the output voltage Vp from the light receiver unit 670*p* with each light amount is detected. From these three values, a reference light amount of the light emitter element 601 is calculated which ensures that the output voltage Vp in a toner adhesion-free state will be at a predetermined reference level (which is a value obtained by adding the dark output Vp0 to 3 V in this preferred embodiment). A level of the light amount control signal Slc which ensures that the light amount of the light emitter element 601 will be the reference light amount is thus calculated, and the calculated value is set as a reference light amount control signal (Step S22). Following this, when it becomes necessary to turn on the light emitter element 601, the CPU 101 outputs the reference light amount control signal to the irradiated light amount adjusting unit 605 and the light emitter element 601 is feedback-controlled so as to emit light always in the reference light amount.

The output voltages Vp and Vs as they are when the light emitter element 601 is OFF are stored as "dark outputs" of this sensor system. As these values are subtracted from the output voltages Vp and Vs at the time of detection of a density of a toner image, an influence of the dark outputs is eliminated and the density of the toner image is detected at a high accuracy, as described later.

An output signal from the light receiver element 672*p* with the light emitter element 601 turned on is dependent upon the amount of reflection light from the intermediate transfer belt 71. But as described later, since the condition of the surface of the intermediate transfer belt 71 is not always optically uniform, for the purpose of calculating the output in such a condition, it is desirable to calculate an average value across one round of the intermediate transfer belt 71. Further, while it is not necessary to detect output signals representing one round of the intermediate transfer belt 71 when the light emitter element 601 is OFF, in order to reduce a detection error, it is preferable to average out output signals obtained at more than one points.

In this preferred embodiment, since the surface of the intermediate transfer belt 71 is white, reflectance of light is high. The reflectance however decreases when the toner in any color adheres on the intermediate transfer belt 71. Hence, in this preferred embodiment, as the amount of the toner adhering to the surface of the intermediate transfer belt 71 increases, the output voltages Vp and Vs from the light emitter units decrease from the reference level. And therefore, it is possible to estimate the amount of the adhering toner, and further an image density of a toner image, from the values of the output voltages Vp and Vs.

In addition, since the reflection characteristics are different between color (Y, C, M) toner and black (K) toner, this preferred embodiment requires to calculate a density of a patch image formed with black toner described later based on the light amount of p-polarized light included in reflection light from the patch image, but to calculate a density of a patch image formed with color toner based on a light amount ratio of p-polarized light and s-polarized light. Hence, it is possible to accurately calculate an image density over a wide dynamic range.

Referring back to FIG. 7, the pre-operation will be continuously described. The condition of the surface of the intermediate transfer belt 71 is not always optically uniform, and fused toner during use may gradually lead to discoloration, dirt, etc. To prevent a change in surface condition of the intermediate transfer belt 71 from causing an error in detection of a density of a toner image, this embodiment requires to acquire a foundation profile of the intermediate transfer belt 71 for the overall circumferential length thereof, or information on the surface conditions of the intermediate transfer belt 71 free from the toner image for the overall circumferential length thereof or particularly on the degrees of density thereof. To be more specific, the light emitter element 601 is made emit light in the reference light amount calculated earlier, the intermediate transfer belt 71 is made rotate one round while sampling the output voltages Vp and Vs from the light receiver units 670*p* and 670*s* (Step S23), and the sample data (the number of samples in this preferred embodiment :312) are stored as a foundation profile in a RAM 107. With the shading in the respective areas on the surface of the intermediate transfer belt 71 grasped in advance in this fashion, it is possible to more accurately estimate a density of a toner image which is formed on the intermediate transfer belt 71.

Figure 8A:
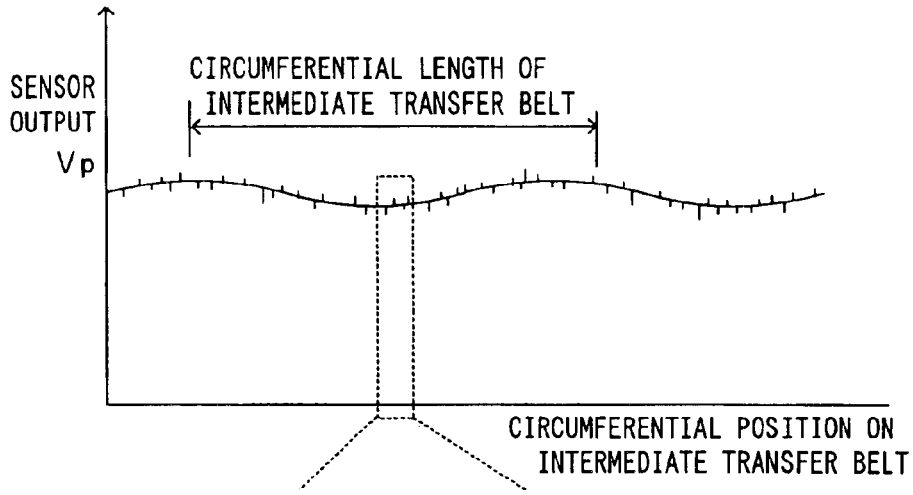
FIGS. 8A and 8B are drawings which show an example of a foundation profile of an intermediate transfer belt.
Figure 8B:
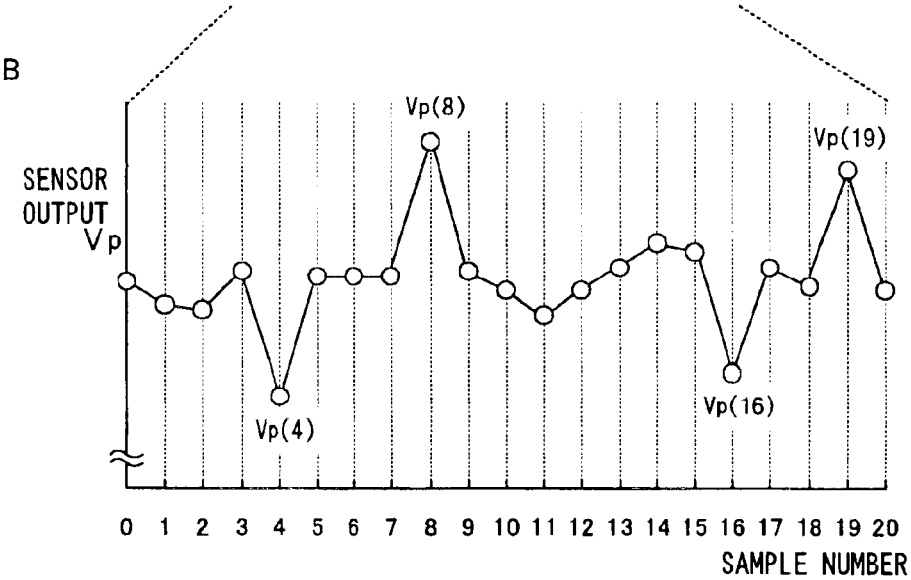

By the way, in some cases, changes in reflectance due to a very small scars or dirt on the roller 75 and the intermediate transfer belt 71, and further, spike-like noises attributed to an electric noise mixed in a sensor circuit may get superimposed on the output voltages Vp and Vs from the density sensor 60 described above. FIGS. 8A and 8B are drawings which show an example of the foundation profile of the intermediate transfer belt. When one detects with the density sensor 60 and plots the amount of reflection light from the surface of the intermediate transfer belt 71 over one round or more of the intermediate transfer belt 71, the output voltage Vp from the density sensor 60 cyclically changes in accordance with the circumferential length or the rotating cycles of the intermediate transfer belt 71, and further, narrow spike-like noises may sometimes get superimposed over the waveform of the output voltage Vp. These noises may possibly contain both a component which is in synchronization to the rotating cycles and an irregular component which is not in synchronization to the rotating cycles. FIG. 8B shows a part of such a sample data string as it is enlarged. In FIG. 8B, two data pieces denoted at Vp(8) and Vp(19) among the respective sample data pieces are dominantly larger than the other data pieces and two data pieces denoted at Vp(4) and Vp(16) are dominantly smaller than the other data pieces because of superimposition of the noises. Although only the p-polarized light component among the two outputs from the sensor is described here, a similar concept applies to the s-polarized light component, too.

A detectable spot diameter of the density sensor 60, or the size of "measurement area" of the invention is about 2 to 3 mm for instance, while discoloration, dirt and the like of the intermediate transfer belt 71 are generally in a size of a larger range. Hence, one can conclude that these local spikes in the data are due to the influence of the noises described above. When a foundation profile, a density of a patch image or the like is calculated based on such sample data which contain superimposed noises and density control factors are set in accordance with the result of the calculation, it may become impossible to set each density control factor always to a proper condition and an image quality may deteriorate.

Noting this, as shown in FIG. 7, after sampling the outputs from the sensor over one round of the intermediate transfer belt 71 at the step S23, the spike-like noises are removed in this preferred embodiment (Step S24).

Figure 9:
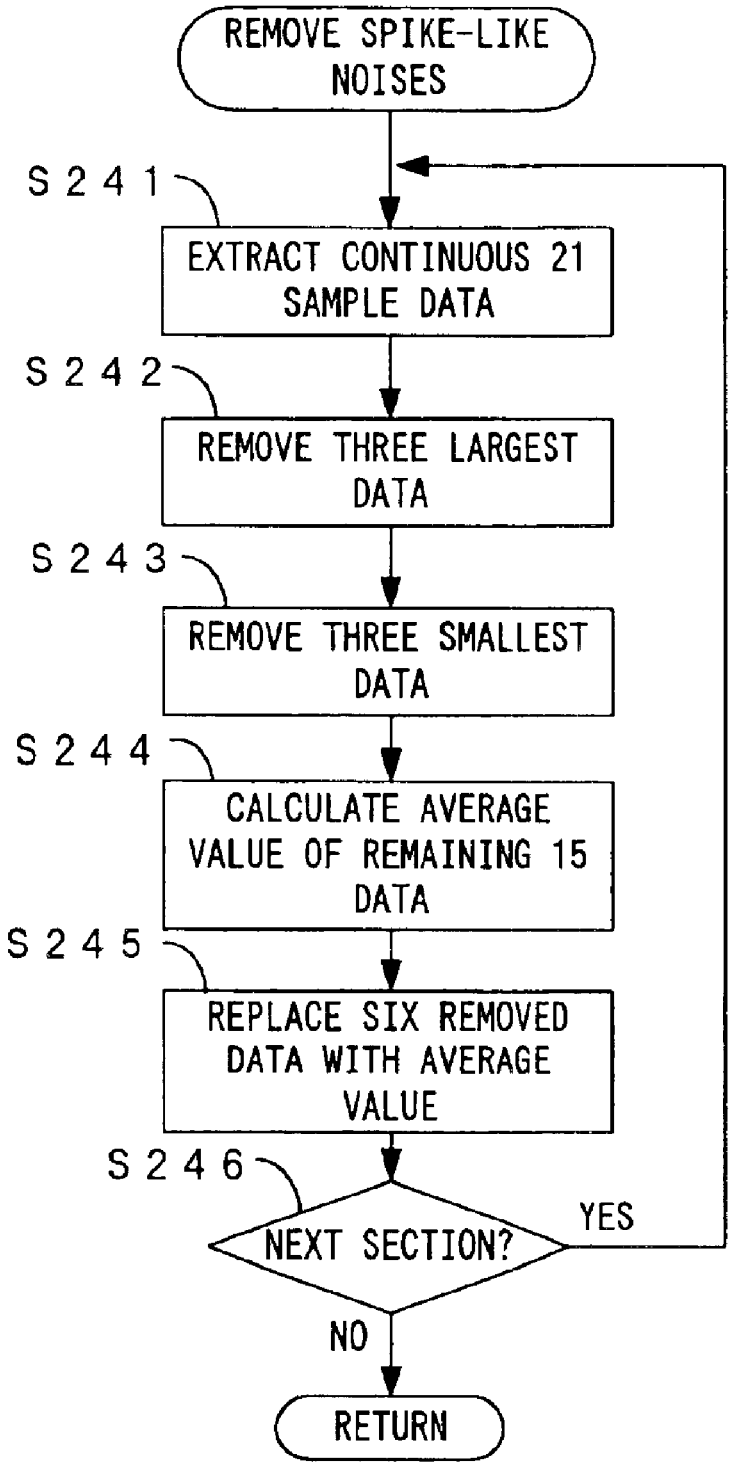
FIG. 9 is a flow chart which shows a spike-like noise removing process in the first preferred embodiment.

FIG. 9 is a flow chart which shows the steps of a spike-like noise removing process in this embodiment hereof. In the spike-like noise removing process, a segment of successive samples (of a length equivalent to 21 successive sample data pieces according to the embodiment) is extracted from a "raw" or unprocessed sample data string thus acquired (Step S241). Then, 3 data pieces at levels of higher order and 3 data pieces at levels of lower order are removed from the 21 sample data pieces of the segment of interest (Steps S242, S243). Subsequently, an arithmetic average of the remaining 15 data pieces is found (Step S244). The resultant average value is regarded as an average level of this segment and substituted for each of the 6 data pieces removed in Steps S242 and 243 whereby a "corrected" sample data array removed of the noises is obtained (Step S245). As required, the Steps S241 to S245 are repeated on the subsequent segment to remove the spike-like noises therefrom the same way (Step S246).

Figure 10:
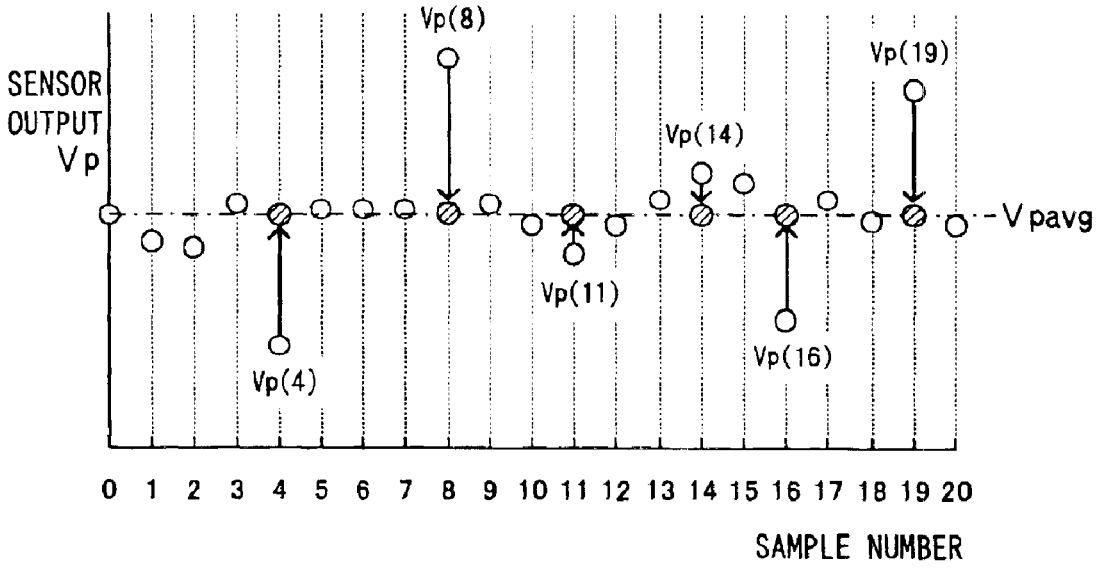
FIG. 10 is a drawing which shows spike-like noise removal in the first preferred embodiment.

Removal of spike-like noises during the process above will now be described in more detail on the data string shown in FIG. 8B, while referring to FIG. 10. FIG. 10 is a drawing which shows spike-like noise removal in this preferred embodiment. In the data string shown in FIG. 8B, the influence of the noises seems to be visible over the two data pieces Vp(8) and Vp(19) which are dominantly larger than the other data pieces and the two data pieces Vp(4) and Vp(16) which are dominantly smaller than the other data pieces. Since the spike-like noise removing process requires to remove the three largest sample data pieces (Step S242 in FIG. 9), those which are to be removed are the three data pieces Vp(8), Vp(14) and Vp(19) including the two data pieces which seem to contain the noises. In a similar manner, the three data pieces Vp(4), Vp(11) and Vp(16) including the two data pieces which seem to contain the noises are also removed (Step S243 in FIG. 9). As these six data pieces are replaced with the average value Vpavg of the other 15 data pieces (denoted at the shadowed circles) as shown in FIG. 10, the spike-like noises which used to be contained in the original data are removed.

For spike-like noise removal, the number of samples to be extracted and the number of data pieces to be removed are not limited to those described above but may be any desired numbers. However, since it becomes impossible to obtain a sufficient noise removing effect and an error may intensify depending on a choice of these numbers, it is desirable to carefully determine these numerical figures in view of the following points.

That is, extraction of too short a section of a data string as compared to the frequency of noises pushes up the possibility that noises are not included in the section within which spike-like noise removal will be executed and increases the number of calculations, and therefore, is not efficient. On the other hand, extraction of too long a section ends up in averaging out even significant variations in sensor output, namely, variations which represent a density change of an object of detection, and thus makes it impossible to correctly calculate a density profile despite the original purpose.

Further, since the frequency of noises is not constant, uniform removal of a predetermined number of largest or smallest data pieces from an extracted data string may result in removal of data such as data pieces Vp(11) and Vp(14) which do not contain noises, or on the contrary, may fail to sufficiently remove noises. Even when a few noise-free data components get removed, as shown in FIG. 10, since a difference between the data pieces Vp(11) and Vp(14) and the average value Vpavg is relatively small, an error attributed to replacement of these data pieces with the average value Vpavg is small. On the other hand, when the noise-containing data pieces are left not removed, replacement of the other data pieces with an average value calculated including these noise-containing data pieces may increase an error. Hence, it is desirable to calculate a ratio of the number of data pieces to be removed to the number of extracted sample data pieces such that the ratio will be comparable to or slightly higher than the frequency of noises created in the actual apparatus.

The spike-like noise removing process in this preferred embodiment is designed as described above, based on the empirical fact that the frequency of data pieces shifted to be larger than an originally intended profile due to an influence of noises was about the same as the frequency of data pieces shifted to be smaller than the originally intended profile due to the influence of the noises and that the frequency of the noises themselves was about 25% or lower (five or fewer samples out of 21 samples) as shown in FIG. 8A.

Various other methods than the one described above may be used as a method of removing spike-like noises. For instance, it is possible to remove spike-like noises by processing "raw" sample data obtained through sampling with conventional low-pass filtering. However, since conventional filtering changes not only noise-containing data but also neighboring data from original values although it is possible to make a noise waveform less sharp, a large error may arise depending on the state of noises.

On the contrary, according to this preferred embodiment, since the corresponding number of largest or smallest data pieces to the frequency of noises are replaced with an average value in sample data and the other data pieces are left unchanged, it is less likely that such an error will arise.

The spike-like noise removing process is executed not only for calculation of the foundation profile described above, but is performed also on sample data which were acquired as the amount of reflection light for the purpose of calculating an image density of a toner image as described later.

B-2. Idling of Developer (Pre-Operation 2)

It is known that when the power source is OFF or even when the power source is ON, if there has been continuation of the operation-suspended state without any image forming operation performed over a long period of time before the next image forming operation, an image may have a cyclic density variation. This phenomenon will be hereinafter referred to "shutdown-induced banding." The inventors of the present invention have found that the cause of shutdown-induced banding is because toner fixedly adheres to the developer roller 44 after left carried on the developer roller 44 of each developer for a long time and because the layer of the toner on the developer roller 44 gradually becomes uneven as the amount of the adhering toner and the retention force of the adhering toner are not uniform on the surface of the developer roller 44.

The inventors' findings on shutdown-induced banding will now be described.

Shutdown-induced banding is most prominently recognized in an image which is formed for the first time after the operation-suspended state. As images are formed repeatedly, however, density variations due to the shutdown induced banding gradually become less visible. After formation of a couple of images, density variations almost disappear. Meanwhile, predominant density variations appear in the event that the operation-suspended state has lasted for a long time or in a high temperature/high humidity environment.

Further, shutdown-induced banding becomes remarkable when a developer roller comprising a conductive surface is used. That is, in the case of an apparatus which uses a metallic developer roller or a developer roller whose surface of a non-conductive material seats a conductive layer, density variations due to shutdown-induced banding are noticeable.

To clarify a mechanism of shutdown-induced banding, using a developer having the structure shown in FIG. 3, the inventors conducted an experiment, made an observation and obtained the following findings. First, according to the observation on development of density variations in images, the following correlation was found between the shading in the images and positions within the surface of the developer roller 44. That is, an image developed with toner carried on a surface area within the surface of the developer roller 44 which used to be located inside the developer housing 41 (hereinafter referred to as a "inside section") during the operation-suspended state had a high density, whereas an image developed with toner carried on a surface area which used to be exposed outside the housing 41 (hereinafter referred to as an "outside section") had a low density.

In addition, using a surface electrometer, the inventors measured a potential distribution of a toner layer on the surface of the developer roller 44 after continuation of the operation-suspended state, and found that the absolute value of the potential of the toner layer was low in a portion corresponding to the inside section but was high in a portion corresponding to the outside section. The potential difference gradually decreased as the developer roller 44 rotated, and the surface potential finally became approximately uniform.

The inventors further measured a toner electrification amount ($\mu$C/g) and a transported toner amount (mg/cm$^2$) on the surface of the developer roller 44, and found that the transported toner amount remained almost the same between the inside section and the outside section while the toner electrification amount was about twice higher in the outside section than in the inside section. It therefore is thought that the potential difference described above was attributed to the difference in toner electrification amount.

From this, the inventors have concluded that shutdown-induced banding occurs since the toner electrification amount is different at different positions, more precisely, between the inside section and the outside section on the developer roller 44 which has just escaped from the operation-suspended state. Since the electrification amount difference gradually decreases as the developer roller 44 rotates, it is believed that immediately after the end of the operation-suspended state, the state of the surface of the developer roller 44 which electrifies the toner by means of friction is different between the inside section and the outside section.

Observing the surface of the developer roller 44, one notices that there is a great amount of fine powder such as toner having small particle diameters, an additive which fell off from the toner, etc. Differences in terms of the amount of adhering fine powder components, the water content and the like influence the condition of frictional between the developer roller 44 and the toner and consequent electrification. Inside the developer, the toner containing such fine powder components always remains in contact with the developer roller 44, and is therefore urged against the developer roller 44 under pressure as the supply roller 43, the restriction blade 45, the seal member 46 and the like stay abutting on the developer roller 44. For this reason, of the surface of the developer roller 44, within the area which remains inside the developer during the operation-suspended state (the inside section), the fine powder components tend to solidify and adhere to the surface. On the contrary, solid adhesion of the fine powder components occurs only on a relatively small scale in the outside section which is exposed outside the developer, since the toner adheres only because of electrostatic force.

As described above, when the apparatus is left in the operation-suspended state for a long period of time, the condition of solid adhesion of the fine powder components becomes uneven on the surface of the developer roller 44 and the toner electrification amount becomes different. This is a major cause of shutdown-induced banding.

In addition, whether shutdown-induced banding easily occurs is also dependent upon the structure of the apparatus. Shutdown-induced banding attributed to fine powder components particularly easily occurs when the apparatus uses a developer, such as the developer 4K and the like according to this embodiment, in which the restriction blade 45 for creating a toner layer having predetermined thickness on the developer roller 44 is disposed below the developer roller 44. This is because such fine powder components tend to remain in a lower portion of the developer housing and hence there are a large number of fine powder components in the vicinity of the abutting position (the restricting position) at which the restriction blade 45 abuts on the developer roller 44.

Particularly in the event that the toner is peeled off from the developer roller 44 on the upstream side to the restricting position in the rotation direction D3 of the developer roller 44 and the peeling position of toner peeling is located above the restricting position as shown in FIG. 3, shutdown-induced banding is more remarkable. The reason is as follows. Around the peeling position, there are fine powder components which are newly created because of friction between the supply roller 43 and the developer roller 44, fine powder components which have been scraped off from the developer roller 44, etc. Due to rotations of the supply roller 43 and the developer roller 44, the gravity and the like, these fine powder components are fed one after another to the abutting position at which the supply roller 43 abuts on the developer roller 44 and the restricting position. Solid adhesion of the fine powder components therefore easily occurs on the surface of the developer roller 44, which in turn easily leads to shutdown-induced banding.

Meanwhile, in the event that the surface of the developer roller 44 is made of a conductive material, solid adhesion of fine powder owing to image force is strong. Hence, an apparatus which comprises such a developer roller easily gives rise to shutdown-induced banding.

A typical structure of a developer roller is that the roller as a whole is formed into a cylindrical shape using the same material or that a core member and a sleeve of different materials are coaxially combined with each other. Examples of the structure which easily bring the shutdown-induced banding may be: i) a structure that the entire roller or at least a sleeve is made of metal or an alloy; ii) a structure that the entire roller or at least a sleeve is made of conductive rubber, a conductive resin or the like; and iii) a structure that a surface of an insulation or conductive roller is covered with a conductive surface layer. In this context, "conductive" means that the specific resistance by volume is approximately $1\times10^{-2}\Omega\cdot m$ or lower, and materials meeting this requirement include metal, metallic oxides, metallic nitrides, graphites, etc. With respect to the examples above, the surface layer referred to in the example iii) may be a conductive material such as metal, an alloy and a conductive resin or alternatively a layer which is obtained by dispersing a conductive material in an insulating material. A method of coating with such a surface layer may be plating, vapor deposition, pressure bonding, thermal spraying, spray coating, dipping coating, etc.

Whether shutdown-induced banding easily occurs is further dependent upon the nature of the toner. In other words, shutdown-induced banding easily occurs in the case of an apparatus which uses toner which contains a wax component which serves as a parting agent for prevention of fixing offset. This is because fine powder of wax liberated from toner particles, some of toner particles with the wax component exposed to the particle surfaces and the like easily allow the toner to adhere to the developer roller 44 because of the van der Waals force.

Referring back to FIG. 7, the pre-operation 2 will be continuously described. When density control factors are to be newly optimized prior to formation of the next image after the apparatus has been in the operation-suspended state for long with the surface of the developer roller 44 uneven, a density variation appearing in a patch image owing to shutdown-induced banding may affect optimization. An image forming apparatus which has any one of the structures described above easily creates density variations attributed to shutdown-induced banding, and therefore, it is necessary to implement some measures to eliminate shutdown-induced banding.

Noting this, for the purpose of eliminating shutdown-induced banding before formation of a patch image, each developer roller 44 is rotated idle in the image forming apparatus according to this preferred embodiment. As the right-hand side flow (the pre-operation 2) in FIG. 7 shows, first, the yellow developer 4Y is positioned at the developing position facing the photosensitive member 2 (Step S25), and after setting the average developing bias Vavg to a value having the smallest absolute value within a variable range of the average developing bias (Step S26), the developer roller 44 is rotated at least one round using the rotation driver (not shown) which is disposed to the main section (Step S27). Following this, while rotating the developer unit 4 and thereby switching the developer (Step S28), the other developers 4C, 4M and 4K are positioned at the developing position in turn and the developer roller 44 disposed to each developer is rotated one round or more (Step S29). As each developer roller 44 is rotated idle one round or more in this manner, a toner layer on the surface of each developer roller 44 is peeled off and re-formed by the supply roller 43 and the restriction blade 45. Hence, thus re-formed more uniform toner layer is used for subsequent formation of a patch image, which makes it less likely to see a density variation attributed to shutdown-induced banding.

During the pre-operation 2 described above, the average developing bias Vavg is set so as to have the smallest absolute value at the step S26. The reason is as follows.

As described later, with respect to the average developing bias Vavg serving a density control factor which affects an image density, the larger the absolute value |Vavg| of the average developing bias Vavg is, the higher a density of a formed toner image becomes. This is because the larger the absolute value |Vavg| becomes, a potential difference increases which develops between an area in the electrostatic latent image on the photosensitive member 2 exposed with the light beam L, namely, the surface area which the toner is to adhere to, and the developer roller 44, and the movement of the toner from the developer roller 44 is further facilitated. However, at the time of acquisition of the foundation profile of the intermediate transfer belt 71, a such toner movement is not desirable. This is because as the toner which has moved from the developer roller 44 to the photosensitive member 2 transfers onto the intermediate transfer belt 71 within the primary transfer region TRI, the transferred toner changes the amount of reflection light from the intermediate transfer belt 71, and it becomes impossible to correctly calculate the foundation profile.

In this preferred embodiment, as described later, the average developing bias Vavg can be changed over stages within a predetermined variable range, as one of density control factors. Noting this, with the average developing bias Vavg set to a value having the smallest absolute value within the variable range, such a state is realized which least likely leads to a movement of toner from the developer roller 44 to the photosensitive member 2, and adhesion of the toner to the intermediate transfer belt 71 is suppressed to minimum. For a similar reason, in an apparatus in which a developing bias contains an alternating current component, it is preferable that the amplitude of the developing bias is set to be smaller than an amplitude for ordinary image formation. For example, as described earlier, in an apparatus requiring the peak-to-peak voltage Vpp of the developing bias to be 1400 V, the peak-to-peak voltage Vpp may be about 1000 V. In an apparatus using a duty ratio of the developing bias, the charging bias and the like for instance as density control factors, too, it is preferable that the density control factors are set appropriately so as to realize a condition which less likely leads to a movement of toner as that described above.

Further, this preferred embodiment requires to simultaneously execute the pre-operation 1 and the pre-operation 2 described above parallel to each other, for the purpose of shortening a processing time. In other words, while the pre-operation 1 demands, for acquisition of the foundation profile, to rotate the intermediate transfer belt 71 idle at least one round or more preferably three rounds including two rounds needed for calibration of the sensor, it is preferable to rotate the developer roller 44 idle as much as possible also during the pre-operation 2. Since these processes can be executed independently of each other, parallel execution makes it possible to shorten a period of time needed for the entire operation while ensuring time needed for each one of these processes. In this preferred embodiment, two pre-operation processes, namely, the pre-operation 1 which includes "preceding processing" of the present invention and the pre-operation 2 which includes "idling" of the present invention, are executed in parallel.

C. Derive Control Target Value

In the image forming apparatus according to this preferred embodiment, as described later, two types of toner images are formed as patch images and each density control factor is adjusted so that densities of these toner images will have a density target value. The target value is not a constant value but may be changed in accordance with an operating state of the apparatus. The reason is as follows.

As described earlier, in the image forming apparatus according to this preferred embodiment, the amount of reflection light from a toner image which has been visualized on the photosensitive member 2 and primarily transferred on the surface of the intermediate transfer belt 71 is detected, and an image density of the toner image is estimated. While there are widely used conventional techniques for calculating an image density from the amount of reflection light from a toner image, as described below in detail, a correlation between the amount of reflection light from a toner image carried on the intermediate transfer belt 71 (or the sensor outputs Vp and Vs which correspond to the light amount) and an optical density (OD value) of a toner image formed on the sheet S which is a final recording medium is not determined uniformly but changes slightly depending on the conditions of the apparatus, the toner, etc. Hence, even when each density control factor is controlled so that the amount of reflection light from a toner image will be constant according to conventional techniques, a density of an image eventually formed on the sheet S will change depending on the condition of the toner.

Figure 11A:
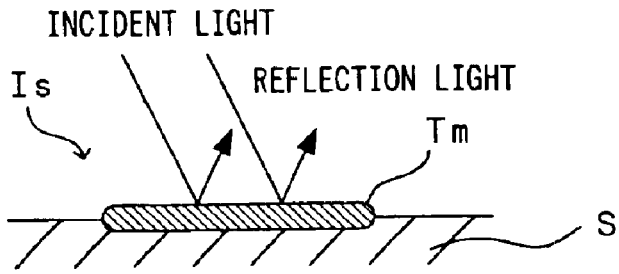
FIGS. 11A, 11B and 11C are schematic diagrams which show a relationship between a particle diameter of toner and the amount of reflection light.
Figure 11B:
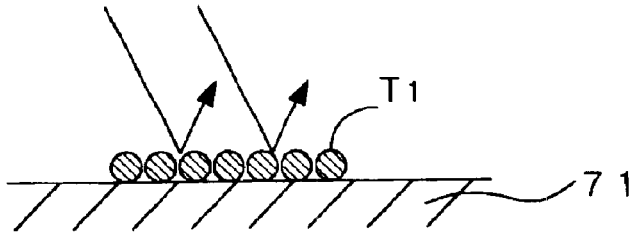
Figure 11C:
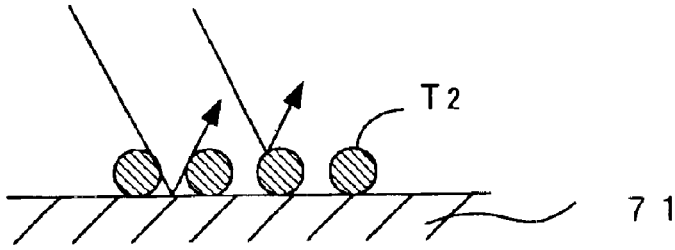

One cause that the sensor outputs fail to match with an OD value on the sheet S is that toner fused on the sheet S after a fixing process reflects differently from toner merely adhering to the surface of the intermediate transfer belt 71 without getting fixed to the surface of the intermediate transfer belt 71. FIGS. 11A, 11B and 11C are schematic diagrams which show a relationship between a particle diameter of toner and the amount of reflection light. As shown in FIG. 11A, in an image Is eventually formed on the sheet S, toner Tm melted by heat and pressure during the fixing process has fused on the sheet S. Hence, while an optical density (OD value) of the image represents the amount of reflection light as it is with the toner fused, the value of the optical density is determined mainly by a toner density on the sheet S (which can be expressed as a toner mass per unit surface area for instance).

On the contrary, in the case of the toner image on the intermediate transfer belt 71 which has not been through the fixing process, toner particles merely adhere to the surface of the intermediate transfer belt 71. Hence, even when the toner density is the same (That is, even when the OD value after the fixing is the same.), the amount of reflection light is not necessarily the same between a state that toner T1 having a small particle diameter shown in FIG. 11B has adhered in a high density and a state that toner T2 having a large particle diameter shown in FIG. 11C has adhered in a low density and the surface of the intermediate transfer belt 71 is locally exposed. In other words, even when the amount of reflection light from the pre-fixing toner image is the same, a post-fixing image density (OD value) does not always become the same. The experiment conducted by the inventors of the present invention has identified that in general, when the amount of reflection light is the same, if a ratio of toner having a large particle diameter to toner particles which form a toner image, a post-fixing image density tends to be high.

Figure 12A:
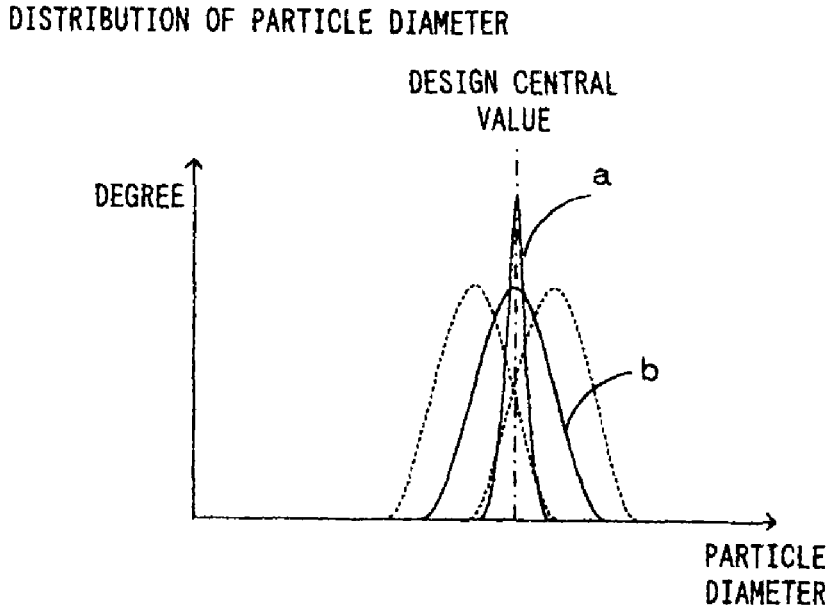
FIGS. 12A and 12B are drawings which show how a toner particle diameter distribution and a change in OD value relate to each other.
Figure 12B:
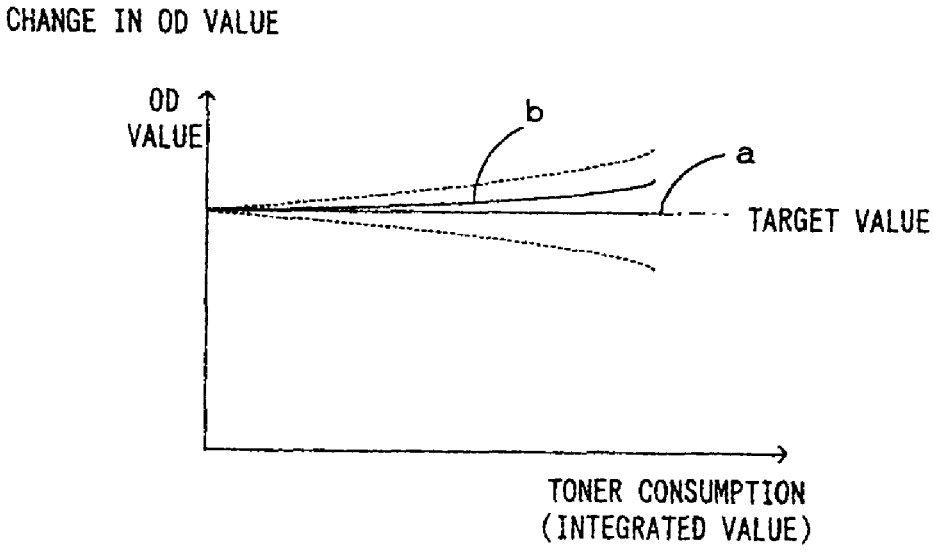

In this manner, a correlation between an OD value on the sheet S and the amount of reflection light from a toner image on the intermediate transfer belt 71 changes in accordance with the condition of toner, and particularly, a distribution of toner particle diameters. FIGS. 12A and 12B are drawings which show how a particle diameter distribution of toner and a change in OD value relate to each other. It is ideal that particle diameters of toner particles housed for formation of a toner image in the respective developers are all aligned to a design central value. However, as shown in FIG. 12A, in reality, the particle diameters are distributed in various manners depending on the type of the toner, a method of manufacturing the toner and the like of course. Even in the case of toner manufactured to meet the same specifications, the distribution slightly changes for each production batch and each product.

Since the mass, the electrification amount and the like of toner having various particle diameters are different, when an image is formed with the toner having such a particle diameter distribution, use of these toner is not uniform. Rather, such toner whose particle diameters are suitable to the apparatus is selectively used, and the other toner are left in the developers without used very much. Hence, as the toner consumption increases, the particle diameter distribution of the toner remaining in the developers changes.

As described earlier, since the amount of reflection light from a pre-fixing toner image changes in accordance with the diameters of the particles which form the toner, even though each density control factor is adjusted so that the amount of reflection light will be constant, a density of a image fixed on the sheet S does not always become constant. FIG. 12B shows a change in optical density (OD value) of an image on the sheet S which was formed while controlling each density control factor so that the amount of reflection light from a toner image, namely, the output voltages from the density sensor 60 will be constant. In the event that the toner particle diameters are well aligned in the vicinity of the design central value as denoted at the curve a in FIG. 12A, even when the consumption of the toner in the developers advances, the OD value is maintained approximately at a target value, as denoted at the curve a in FIG. 12B. On the contrary, as denoted at the curve b in FIG. 12A, when toner whose particle diameter distribution is wider is used, although toner whose particle diameters are close to the design central value is mainly used and an OD value almost the same as a target value is obtained initially as denoted at the curve b in FIG. 12B, as the toner consumption increases, the proportion of the popular toner decreases, toner having larger particle diameters starts to be used for formation of an image, and the OD value gradually increases. Further, as denoted at the dotted curves in FIG. 12A, a median value of the distribution is sometimes off the design value from the beginning depending on a production batch of the toner or the developers, and the OD value on the sheet S accordingly changes in various manners as more toner is used as denoted at the dotted curves in FIG. 12B.

Factors which influence a characteristic of toner include, in addition to a particle diameter distribution of the toner described above, the condition of pigment dispersion within mother particles of the toner, a change in electrifying characteristic of the toner owing to the condition of mixing of the toner mother particles and an additive, etc. Since a toner characteristic slightly varies among products, an image density on the sheet S is not always constant and the extent of a density change varies depending on toner which is used. Hence, in a conventional image forming apparatus in which each density control factor is controlled so that output voltages from a density sensor will be constant, a variation in image density because of a variation in toner characteristic is unavoidable and it therefore is not always possible to obtain a satisfactory image quality.

Figure 13:
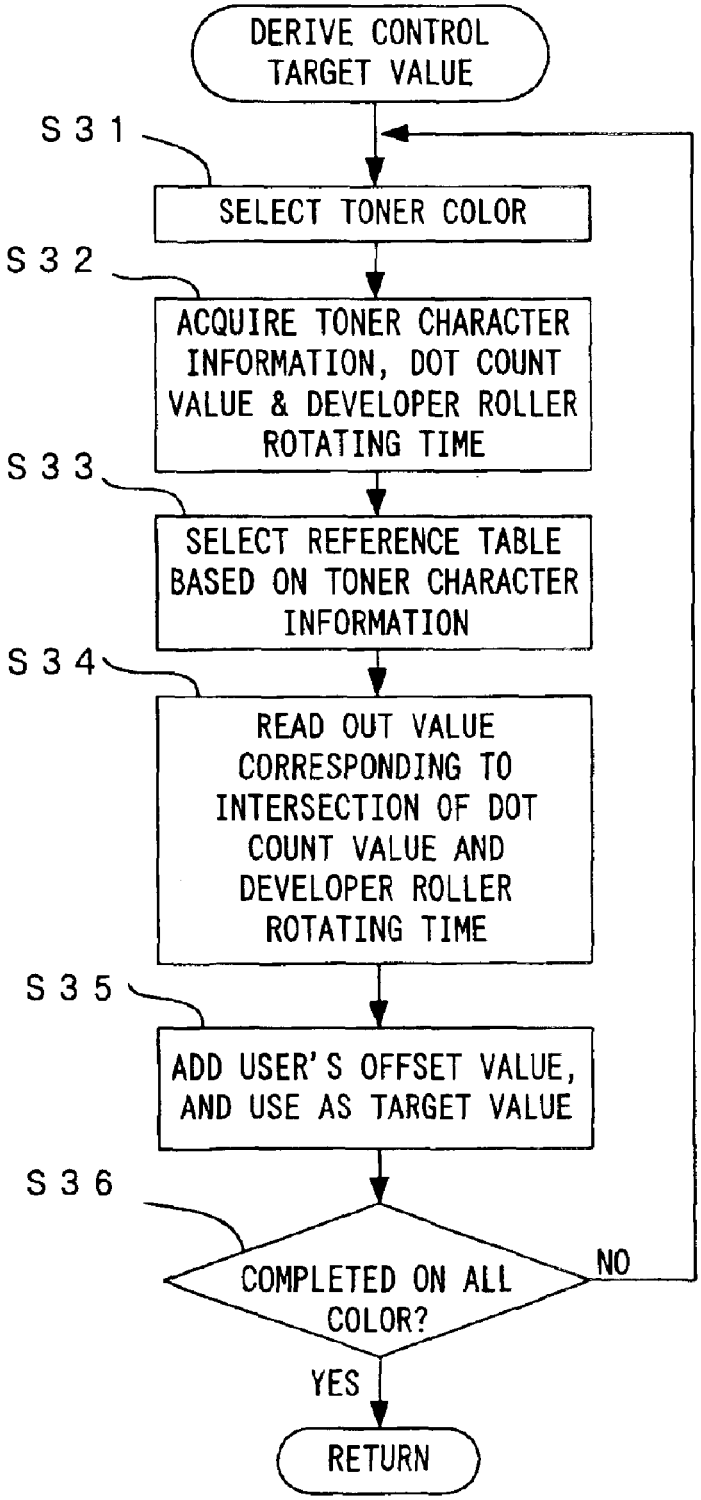
FIG. 13 is a flow chart which shows a process of deriving a control target value in the first preferred embodiment.

Noting this, in this preferred embodiment, with respect to each one of two types of patch images described later, a control target value for an image density evaluation value (described later) which represents the image density is set in accordance with an operating state of the apparatus, and each density control factor is adjusted so that the evaluation value for each patch image will be the control target value, whereby an image density on the sheet S is maintained constant. FIG. 13 is a flow chart which shows a process of deriving the control target values in this preferred embodiment. In this process, for each toner color, a control target value suiting the condition of use of the toner, namely, an initial characteristic such as a particle diameter distribution of the toner upon introduction into the developers, and the amount of the toner which remains the developer, are calculated. First, one of the toner colors is selected (Step S31), and the CPU 101 acquires, as information for estimating the condition of use of the toner, "toner character information" regarding the selected toner color, a "dot count" value which expresses the number of dots formed by the exposure unit 6 and information regarding a "developer roller rotating time (Step S32)". Although the description here relates to an example that a control target value corresponding to the black color is calculated, the description should remain similar on the other toner colors, too.

"Toner character information" is data written in a memory 94 which is disposed to the developer 4K in accordance with characteristics of the toner which is housed in the developer 4K. In this apparatus, noting that various characteristics such as the particle diameter distribution of the toner described above are different among different production batches, the characteristics of the toner are classified into eight types. The type of the toner is then determined based on an analysis during production, and 3-bit data representing the type are fed as toner character information to the developer 4K. This data are read out from the memory 94 when the developer 4K is mounted to the developer unit 4 and stored in the RAM 107 of the engine controller 10.

Meanwhile, a "dot count value" is information for estimating the amount of the toner which remains within the developer 4K. While to calculate from an integrated value of the number of formed images is the simplest method of estimating the remaining amount of the toner, it is difficult to learn about an accurate remaining amount with this method since the amount of the toner consumed by formation of one image is not constant. On the other hand, the number of dots formed by the exposure unit 6 on the photosensitive member 2 is indicative of the number of dots which are visualized on the photosensitive member 2 with the toner, the number of dots more accurately represents the consumed amount of the toner. Noting this, in this preferred embodiment, the number of dots as it is when the exposure unit 6 has formed an electrostatic latent image on the photosensitive member 2 which is to be developed by the developer 4K is counted and stored in the RAM 107. Thus stored dot count value is used as information which represents the amount of the toner which remains within the developer 4K.

In addition, a "developer roller rotating time" is information for estimating in more detail the characteristics of the toner which remains within the developer 4K. As described earlier, there is the toner layer on the surface of the developer roller 44, and some of the toner moves onto the photosensitive member 2 and development is realized. At this stage, on the surface of the developer roller 44, the toner which has not contributed to the development is transported to an abutting position on the supply roller 43 and peeled off by the supply roller 43, thereby forming a new toner layer. As adhesion to and peeling off from the developer roller 44 is repeated in this manner, the toner is fatigued and the characteristics of the toner gradually change. Such a change in toner characteristics intensifies as the developer roller 44 rotates further. Hence, even when the amounts of toner remaining within the developer 4K is the same, there sometimes is a difference in characteristics between fresh toner which has not been used yet and old toner which has repeatedly adhered and has been peeled off. Densities of images formed using these toner may not necessarily be the same.

Noting this, in this preferred embodiment, the condition of the toner housed inside the developer 4K is estimated based on a combination of two pieces of information, one being a dot count value which represents a remaining toner amount and the other being a developer roller rotating time which represents the extent of a change in toner characteristics, and a control target value is set more finely in accordance with the toner condition in order to stabilize an image quality.

These pieces of information are used also for the purpose of enhancing the ease of maintenance through management of the states of wear-out of the respective portions of the apparatus. That is, one dot count corresponds to a toner amount of 0.015 mg. When 12000000 dot counts are reached, the consumption of the toner is about 180 g, which means that almost all of the toner stored in each developer has been used up. With respect to a developer roller rotating time, an integrated value of 10600 sec derived from the developer roller rotating time corresponds to 8000 pages of continuous printing in the JIS (Japanese Industrial Standard) A4 size, and therefore, it is not preferable to continue formation of images any more considering an image quality. In this preferred embodiment, therefore, when any one of these pieces of information reaches the value above, a message indicative of the end of the toner appears in a display not shown to thereby encourage a user to exchange the developers.

From these information regarding the operating state of the apparatus thus acquired, a control target value suiting the operating state is determined. This preferred embodiment requires to calculate in advance through experiments optimal control target values which are proper to toner character information which expresses the type of the toner and to characteristics of the remaining toner estimated based on a combination of the dot count value and the developer roller rotating time. These values are stored as look-up tables by toner type in the ROM 106 of the engine controller 10. Based on thus acquired toner character information, the CPU 101 selects one table which is to be referred to in accordance with the type of the toner (Step S33), and reads out from the table a value which corresponds to the combination of the dot count value and the developer roller rotating time at that time (Step S34).

Further, in the image forming apparatus according to this preferred embodiment, as a user enters an input through a predetermined operation on an operation part not shown, a density of an image to be formed is increased or decreased within a predetermined range in accordance with the user's preference or when such is necessary. In short, every time the user increases or decreases the image density by one notch in response to the value thus read out from the look-up table described above, a predetermined offset value which may be 0.005 per notch for instance is added or subtracted, and the result of this is set as a control target value Akt for the black color at that time and stored in the RAM 107 (Step S35). The control target value Akt for the black color is determined in this manner.

FIGS. 14A and 14B are drawings which show examples of look-up tables which are for calculating a control target value. This table is a table which is referred to when toner whose color is black and whose characteristics belong to "type 0" is to be used. This preferred embodiment uses, for each one of two types of patch images, one for a high density and the other for a low density as described later, and for each toner color, eight types of tables which respectively correspond to eight types of toner characteristics, and these tables are stored in the ROM 106 of the engine controller 10. Shown in FIG. 14A is an example of a table which corresponds to a high-density patch image, while shown in FIG. 14B is an example of a table which corresponds to a low-density patch image.

When the toner character information acquired at the step S32 described above expresses the "type 0" for example, at the following step S33, the table shown in FIGS. 14A and 14B corresponding to the toner character information "0" is selected respectively out from the eight types of tables. The control target value Akt is then calculated based on thus acquired dot count value and developer roller rotating time. For example, for a high-density patch image, when the dot count value is 1500000 counts and the developer roller rotating time is 2000 sec, the value 0.984 which corresponds to the combination of these two is found to be the control target value Akt with reference to FIG. 14A. Further, when a user has set the image density one notch higher than a standard level, the value 0.989 which is obtained by adding 0.005 to this value is the control target value Akt. In a similar manner, it is possible to calculate a control target value for a low-density patch image.

The control target value Akt calculated in this fashion is stored in the RAM 107 of the engine controller 10. During later setting of each density control factor, it is ensured that an evaluation value calculated based on the amount of reflection light from a patch image matches with this control target value.

As described above, the control target value is calculated for the toner color through execution of the steps S31 through S35 described above. The process above is repeated for each toner color (Step S36), and control target values Ayt, Act and Amt and the control target value Akt on all toner colors are found. The subscripts y, c, m and k represent the respective toner colors, i.e., yellow, cyan, magenta and black, while the subscript t expresses that these values are control target values.

D. Settings of Developing Bias

In this image forming apparatus, the average developing bias Vavg fed to the developer roller 44 and an energy E per unit surface area of the exposure beam L which exposes the photosensitive member 2 (hereinafter referred to simply as "exposure energy") are variable, and with these values adjusted, an image density is controlled. The following describes an example that optimal values of these two are calculated while changing the average developing bias Vavg over six stages of V0 to V6 from the low level side and changing the exposure energy E over four stages of a level 0 to a level 3 from the low level side. The variable ranges and the number of stages in each variable range, however, may be changed appropriately in accordance with the specifications of the apparatus. In an apparatus wherein the variable range of the average developing bias Vavg described above is from (−110 V) to (−330 V), the lowest level V0 corresponds to (−110 V) with the smallest absolute voltage value and the highest level V5 corresponds to (−330 V) with the largest absolute voltage value.

Figure 15:
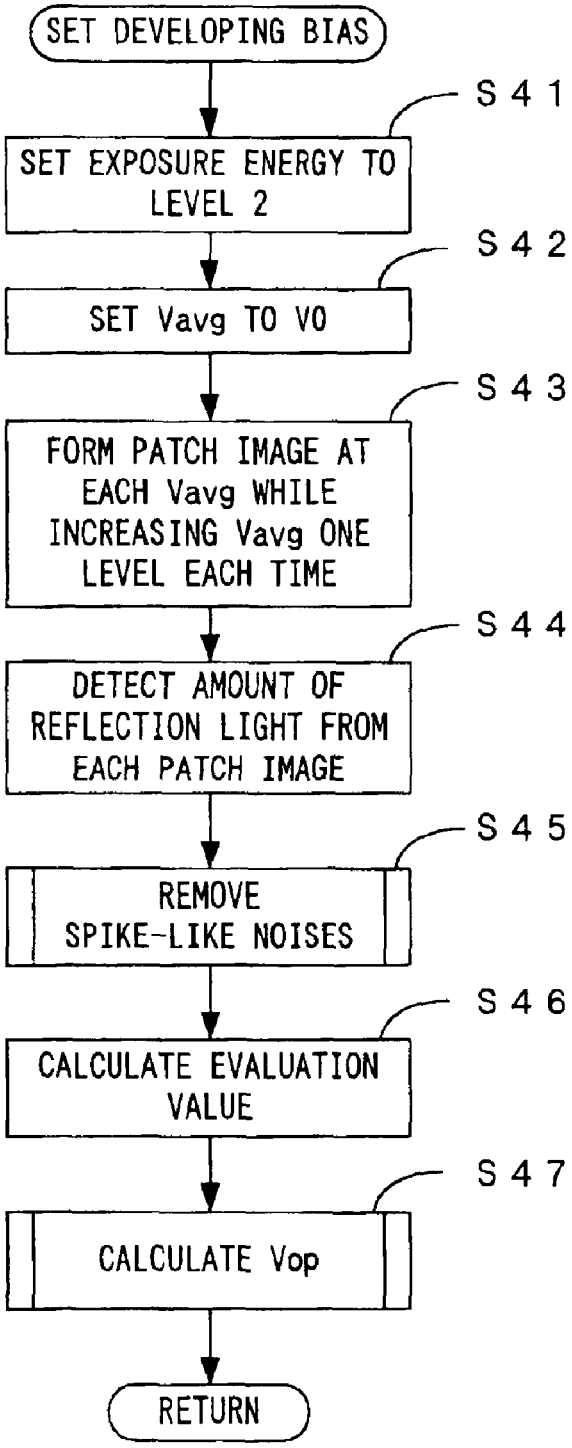
FIG. 15 is a flow chart which shows a developing bias setting process in the first preferred embodiment.
Figure 16:
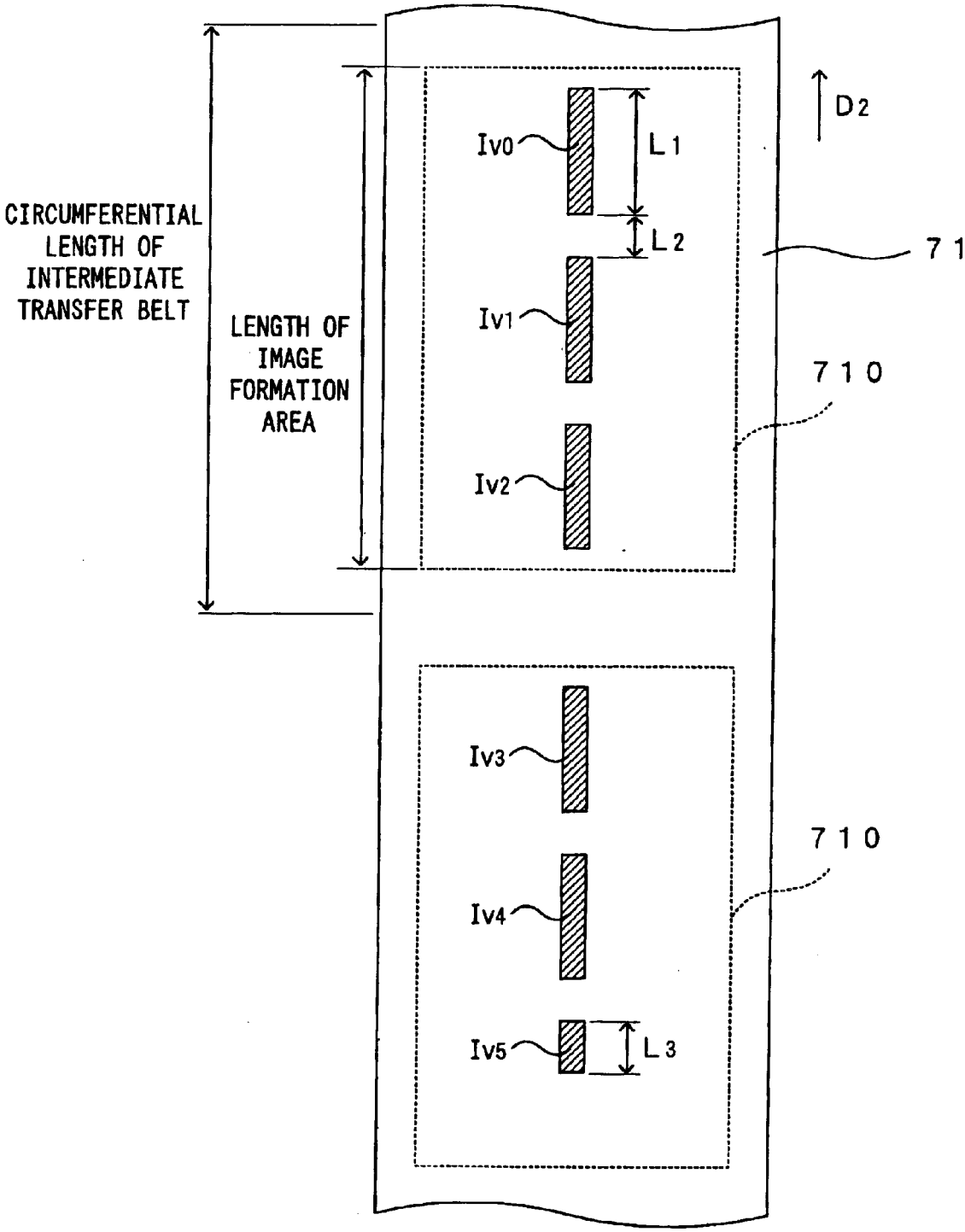
FIG. 16 is a drawing which shows a high-density patch image.

FIG. 15 is a flow chart which shows a developing bias setting process in this preferred embodiment, and FIG. 16 is a drawing which shows a high-density patch image. During this process, first, the exposure energy E is set to the level 2 (Step S41), and while increasing the average developing bias Vavg from the lowest level V0 by one level each time, a solid image which is to serve a high-density patch image is formed with each bias value (Step S42, Step S43).

While six patch images Iv0 through Iv5 are sequentially formed on the surface of the intermediate transfer belt 71 as shown in FIG. 16 in response to the average developing bias Vavg which is changed over the six stages, the first five patch images Iv0 through Iv4 have a length L1. The length L1 is set to be longer than the circumferential length of the photosensitive member 2 which has a cylinder-like shape. On the other hand, the last patch image Iv5 is formed to have a shorter length L3 than the circumferential length of the photosensitive member 2. The reason will be described later. Further, when the average developing bias Vavg is changed, there is a slight delay until the potential of the developer roller 44 becomes uniform, and therefore, the patch images are formed at intervals L2 considering the delay. While an area which can carry a toner image within the surface of the intermediate transfer belt 71 is an image formation area 710 in reality which is shown in FIG. 16, since the patch images have such shapes and arrangement as described above, about three patch images can be formed in the image formation area 710. The six patch images are thus distributed over two rounds of the intermediate transfer belt 71 as shown in FIG. 16.

Figure 17A:
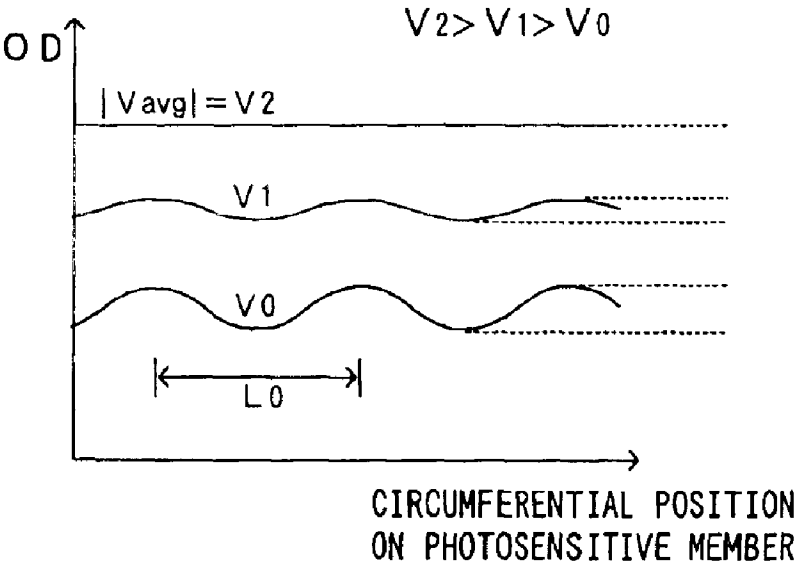
FIGS. 17A and 17B are drawings which show a variation in image density which appears at the cycles of rotation of a photosensitive member.
Figure 17B:
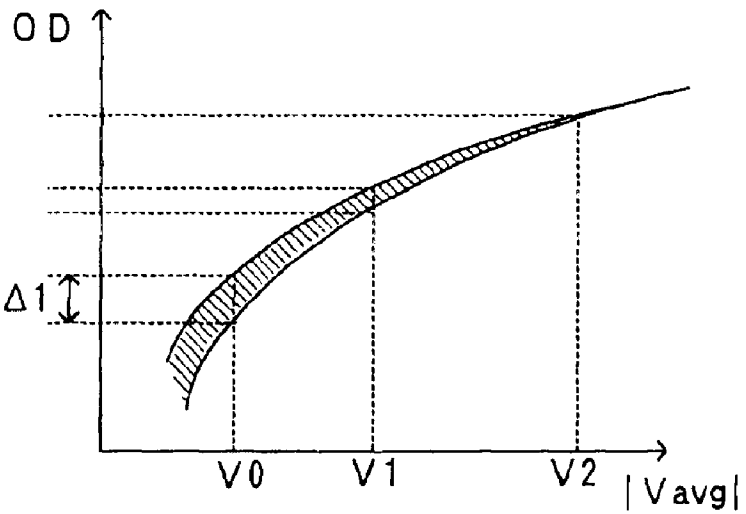

The reason that the lengths of the patch images are set as above will now be described with reference to FIGS. 17A and 17B. FIGS. 17A and 17B are drawings which show a variation in image density which appears at the cycles of rotation of the photosensitive member. As shown in FIG. 1, while the photosensitive member 2 is formed in a cylindrical shape (with a circumferential length of L0), the shape may not sometimes be completely cylindrical or may sometimes have eccentricity due to a production-induced variation, thermal deformation, etc. In such a case, an image density of a toner image may include cyclic variations which correspond to the circumferential length L0 of the photosensitive member 2. The reason is as follows. In an apparatus of the contact developing type in which development with toner is achieved with the photosensitive member 2 and the developer roller 44 abutting on each other, the abutting pressure between the two changes. Meanwhile, in an apparatus of the non-contact developing type in which development using toner is achieved with the two disposed away from each other, the strength of an electric field which causes transfer of the toner between the two changes. Therefore, a probability of a toner movement from the developer roller 44 to the photosensitive member 2 accordingly changes cyclically at the rotating cycles of the photosensitive member 2 in any apparatus.

The widths of the density variations are large particularly when the absolute value |Vavg| of the average developing bias Vavg is relatively small and decrease as the value |Vavg| increases as shown in FIG. 17A. For instance, when a patch image is formed with the absolute value |Vavg| of the average developing bias set to a relatively small value V0, as shown in FIG. 17B, the corresponding image density OD changes within the range of a width 0.1 depending on the location on the photosensitive member 2. In a similar manner, even when a patch image is formed with other developing bias, the corresponding image density changes within a certain range as denoted at the shadowed portion in FIG. 17B. In this fashion, the density OD of the patch image varies depending on not only the average developing bias Vavg but also the position of the patch image formed on the photosensitive member 2. Hence, to calculate an optimal value of the average developing bias Vavg from the image density of the patch image, it is necessary to eliminate an influence of density variations which correspond to the rotating cycles of the photosensitive member 2 exerted over the patch image.

Noting this, in this preferred embodiment, a patch image having the length L1 which exceeds the circumferential length L0 of the photosensitive member 2 is formed, and an average value of densities calculated over the length L0 of the patch image is used as the image density of the patch image. This effectively suppresses an influence of density variations which correspond to the rotating cycles of the photosensitive member 2 exerted over the density of each patch image, which in turn makes it possible to properly calculate an optimal value of the average developing bias Vavg based on the density.

In this preferred embodiment, as shown in FIG. 16, of the respective patch images Iv0 through Iv5, the last patch image Iv5 formed with the average developing bias Vavg set to the maximum has the shorter length L3 than the circumferential length L0 of the photosensitive member 2. This is because it is not necessary to calculate an average value over the cycles of the photosensitive member 2 as density variations corresponding to the rotating cycles of the photosensitive member 2 are small in a patch image formed under the condition that the absolute value |Vavg| is large as shown in FIG. 17B and as described above. In this manner, a period of time needed to form and process a patch image is shortened, and the consumption of toner during formation of the patch image is reduced.

It is desirable to form a patch image in such a manner that the length of the patch image will be larger than the circumferential length L0 of the photosensitive member 2, for the purpose of eliminating an influence of density variations created in accordance with the cycles of the photosensitive member over optimization of density control factors. However, it is not necessary that all patch images have such a length. How many patch images should have such a length needs be determined appropriately in accordance with the extent of density variations which appear in each apparatus, a desired image quality level, etc. For instance, in the event that an influence of density variations at the cycles of the photosensitive member is relatively small, the patch image Iv0 formed with the average developing bias Vavg set to the minimum may have the length L1 and the other patch images Iv1 through Iv5 may have the shorter length L3.

Although all patch images may be formed to have the length L1 on the contrary, in this case, there arises a problem that a processing time and the consumption of toner increase. In addition, it is not preferable in terms of image quality to create density variations corresponding to the cycles of rotation of the photosensitive member even when the average developing bias Vavg is maximum, and therefore, the variable range of the average developing bias Vavg should be determined so that such density variation will not appear at least when the average developing bias Vavg is set to the maximum value. When the variable range of the average developing bias Vavg is set so, such density variations will not appear while the variable range of the average developing bias Vavg is at the maximum, and hence, it is not necessary that a patch image has the length L1.

Referring back to FIG. 15, the developing bias setting process will be continuously described. As for the patch images Iv0 through Iv5 thus formed each with the average developing bias Vavg, the voltages Vp and Vs outputted from the density sensor 60 in accordance with the amounts of reflection light from the surfaces of the patch images are sampled (Step S44). In this preferred embodiment, at 74 points (corresponding to the circumferential length L0 of the photosensitive member 2) as for the patch images Iv0 through Iv4 having the length L1 and at 21 points (corresponding to the circumferential length of the developer roller 44) as for the patch image Iv5 which has the length L3, sample data are obtained from the output voltages Vp and Vs from the density sensor 60 at sampling cycles of 8 msec.

In a similar manner to that during derivation of the foundation profile (FIG. 7) described earlier, removal of spike-like noises from the sample data is executed(Step S45). The following procedure is taken to remove noises from each of the patch images Iv0–Iv4 having the length of L1. That is, 20 sample data pieces including 10 data pieces of higher order and 10 data pieces of lower order are removed from the 74 sample data pieces accounting for a length equivalent to the circumferential length L0 of the photosensitive member 2 and then, an average value of the remaining 54 sample data pieces is calculated. The noises are removed by substituting the resultant average value for each of these removed data pieces.

Figure 18:
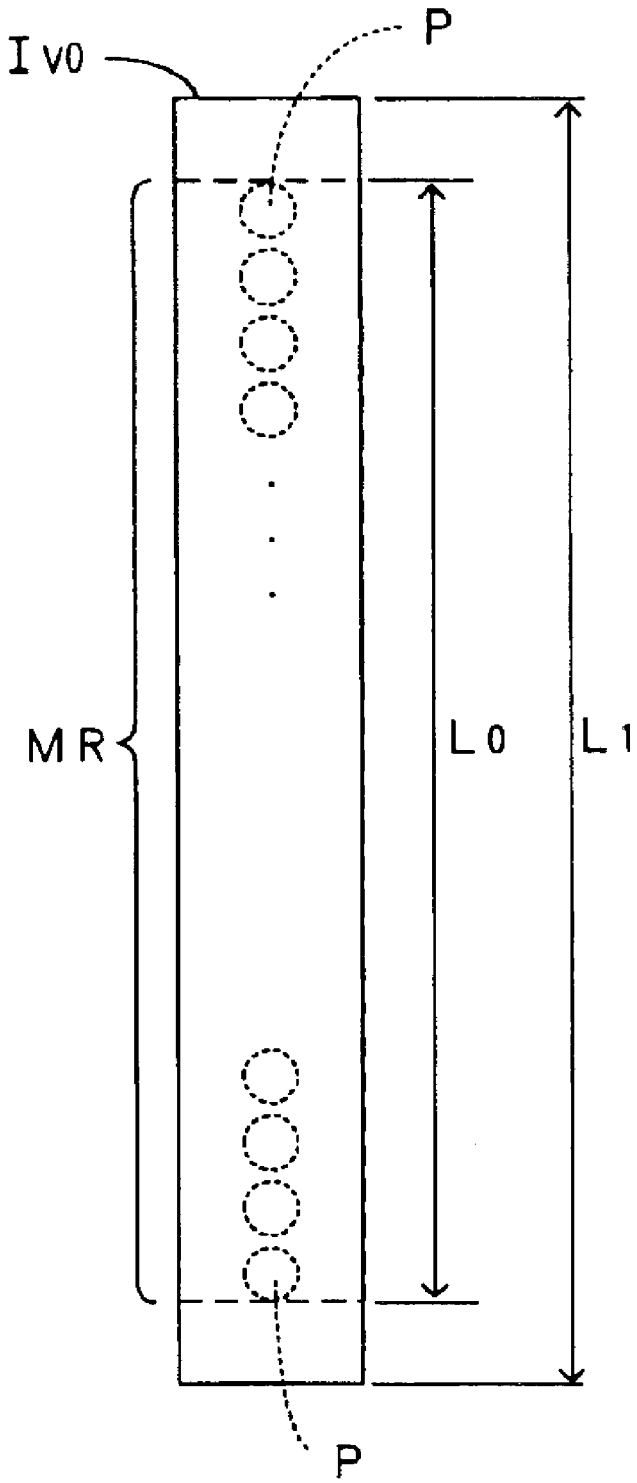
FIG. 18 is an enlarged view which shows a high-density patch image.

FIG. 18 is an enlarged view which shows a high-density patch image. While the invention is characterized by determining an image density of a subject region of calculation based on N2 sample data pieces out of N1 sample data pieces (N2<N1), the sample data according to the embodiment are equivalent to the sampled output voltages Vp, Vs from the density sensor 60. The above example represents a case where N1=74 and N2=54. As shown in FIG. 18, for example, a region MR accounting for the length L0 of the patch image Iv0 of the length L1 is equivalent to the "subject region of calculation" of the invention, whereas each area P corresponding to the diameter of a sensing spot formed by the density sensor 60 is equivalent to the "measurement area" of the invention.

Although FIG. 18 shows the individual measurement areas P arranged at space intervals, these measurement areas P may also be arranged as partially overlapping with one another.

As mentioned supra, the number of data pieces to be excluded (or a ratio thereof) may preferably be decided with the incidence of noises of the apparatus taken into consideration. Specifically, the incidence of spike-like noises of the image forming apparatus of the embodiment is at 25% or less based on the number of sample data pieces, the spike-like noises including abrupt output rises and abrupt output drops. Hence, the number of data pieces to be excluded are defined as follows:

In noise correction on 74 sample data pieces, remove respective groups of 10 data pieces of higher order and of lower order;

In noise correction on 21 sample data pieces, remove respective groups of 3 data pieces of higher order and of lower order.

In this approach, the number (or ratio) of data pieces to be excluded may be defined according to the incidence of noises. In addition, the data pieces to be excluded may be further increased or decreased according to the number of sample data pieces used. It may be effective to exclude a different number of data pieces of higher order from that of data pieces of lower order, as required by some conditions of occurrence of noises. In cases where the incidence of noises can be reduced or where correction is made on a small number of sample data pieces say 10 or so, such an exclusion of data pieces may be dispensed with.

On the other hand, noises are removed from the patch image Iv5 having the length of L3 in the following manner. That is, a total of 6 sample data pieces including 3 data pieces of higher order and 3 data pieces of lower order are removed from 21 sample data pieces and then, an average value of the remaining 15 sample data pieces is calculated. The noises are removed by substituting the resultant average value for each of those removed data pieces. This example represents a case where N1=21 and N2=15.

The spike-like noises are removed from the sample data the same way as in the aforementioned deriving of the foundation profile (FIG. 7) (Step S45). Subsequently, the patch images are each determined for an "evaluation value" based on the data from which the influences of a dark output from the sensor system and of the foundation profile are removed (Step S46).

As described earlier, the density sensor 60 of this apparatus exhibits a characteristic that an output level with no toner adhering to the intermediate transfer belt 71 is the largest but decreases as the amount of the toner increases. Further, an offset due to the dark outputs has been superimposed on the output. Therefore, the output voltage data from the sensor as they directly are hard to be handled as information which is for evaluating the amount of the adhering toner. Noting this, in this preferred embodiment, thus obtained data are processed into such data which express the amount of the adhering toner, that is, converted into an evaluation value, so as to make it easy to execute the subsequent processing.

A method of calculating the evaluation value will now be more specifically described, in relation to an example of a patch image in the black color. Of six patch images developed with the black toner, an evaluation value Ak(n) for an n-th patch image Ivn (where n=0, 1, . . . , 5) is calculated from the formula below:

$$Ak(n)=1-\{Vp\text{mean}k(n)-Vp0\}/\{Vp\text{mean}_b-Vp0\}$$

The respective terms included in the formula mean the following.

First, the term Vpmeank(n) denotes a noise-removed average value of sample data outputted from the density sensor 60 as the output voltage Vp, which corresponds to the p-polarized light component of reflection light from the n-th patch image Ivn, and thereafter sampled. That is, a value Vpmeank(0) corresponding to the first patch image Iv0 for instance denotes an arithmetic average of 74 pieces of sample data which were detected as the output voltage Vp from the density sensor 60 over the length L0 of this patch image, subjected to spike-like noise removal and stored in the RAM 107. The subscript k appearing in each term of the formula above expresses that these values are on the black color.

Meanwhile, the term Vp0 denotes a dark output voltage from the light receiver unit 670*p* acquired during the pre-operation 1 described earlier with the light emitter element 601 turned off. As the dark output voltage Vp0 is subtracted from the sampled output voltage, it is possible to calculate a density of a toner image at a high accuracy while eliminating an influence of the dark output.

Further, the term Vpmean_b denotes an average value of sample data which were, of the foundation profile data stored in the RAM 107 obtained earlier, detected at the same positions as positions at which the 74 pieces of sample data used for the calculation of Vpmeank(n) were detected.

Hence, in a condition that no toner has adhered at all as a patch image to the intermediate transfer belt 71, Vpmeank (n)=Vpmean_b holds satisfied and the evaluation value Ak(n) accordingly becomes zero. On the other hand, in a condition that the surface of the intermediate transfer belt 71 is completely covered with the black toner and the reflectance is zero, Vpmeank(n)=Vp0 holds satisfied and hence the evaluation value Ak(n)=1.

When the evaluation value Ak(n) is used instead of using the value of the sensor output voltage Vp as it directly is, it is possible to measure an image density of a patch image at a high accuracy while canceling an influence due to the condition of the surface of the intermediate transfer belt 71. In addition, because of correction in accordance with the shading of the patch image on the intermediate transfer belt 71, it is possible to further improve the accuracy of measuring the image density. In addition, this permits to normalize the density of the patch image Ivn using a value ranging from the minimum value 0, which expresses a state that no toner has adhered, to the maximum value 1, which expresses a state that the surface of the intermediate transfer belt 71 is covered with high-density toner, and accordingly express the density of the patch image Ivn, which is convenient to estimate a toner image density during the subsequent processing.

As for the other toner color than black, that is, the yellow color (Y), the cyan color (C) and the magenta color (M), since the reflectance is higher than on the black color and the amount of reflection light is not zero even when the surface of the intermediate transfer belt 71 is covered with toner, there may be a case that a density can not be accurately expressed using the evaluation value obtained in the manner above. In this embodiment therefore, used as sample data at the respective positions for calculation of evaluation values Ay(n), Ac(n) and Am(n) for these toner colors is not the output voltage Vp corresponding to the p-polarized light component but is a value PS which is obtained by dividing a value obtained by subtracting the dark output Vp0 from the output voltage Vp by a value obtained by subtracting the dark output Vs0 from the output voltage Vs corresponding to the s-polarized light component, that is, PS=(Vp−Vp0)/(Vs−Vs0), which makes it possible to accurately estimate image densities also in these toner colors. In addition, as in the case of the black color, a sensor output obtained at the surface of the intermediate transfer belt 71 prior to toner adhesion is considered, thereby canceling an influence exerted by the condition of the surface of the intermediate transfer belt 71. Further, owing to correction in accordance with the shading of a patch image on the intermediate transfer belt 71, it is possible to further improve the accuracy of measuring an image density.

For example, as for the cyan color (C), the evaluation value Ac(n) is calculated from:

$$Ac(n)=1-\{PS\text{mean}c(n)-Ps\mathbf{0}\}/\{PS\text{mean}_b-Ps\mathbf{0}\}$$

The symbol PSmeanc(n) denotes an average value of noise-removed PS values calculated from the sensor outputs Vp and Vs at the respective positions of the n-th patch image Ivn in the cyan color. Meanwhile, the symbol Ps0 denotes a value PS which corresponds to the sensor outputs Vp and Vs as they are in a condition that the surface of the intermediate transfer belt 71 is completely covered with the color toner, and is the minimum possible value of PS. Further, the symbol PSmean_b denotes an average value of the values PS calculated from the sensor outputs Vp and Vs as they are sampled as a foundation profile at the respective positions on the intermediate transfer belt 71.

When the evaluation values for the color toner are defined as described above, as in the case of the black color described earlier, it is possible to normalize the density of the patch image Ivn using a value ranging from the minimum value 0, which expresses a state that no toner has adhered to the intermediate transfer belt 71 (and that PSmeanc(n)=PSmean_b is satisfied), to the maximum value 1, which expresses a state that the intermediate transfer belt 71 is covered completely with the toner (and that PSmeanc (n)=Ps0 is satisfied), and express the density of the patch image Ivn.

Figure 19:
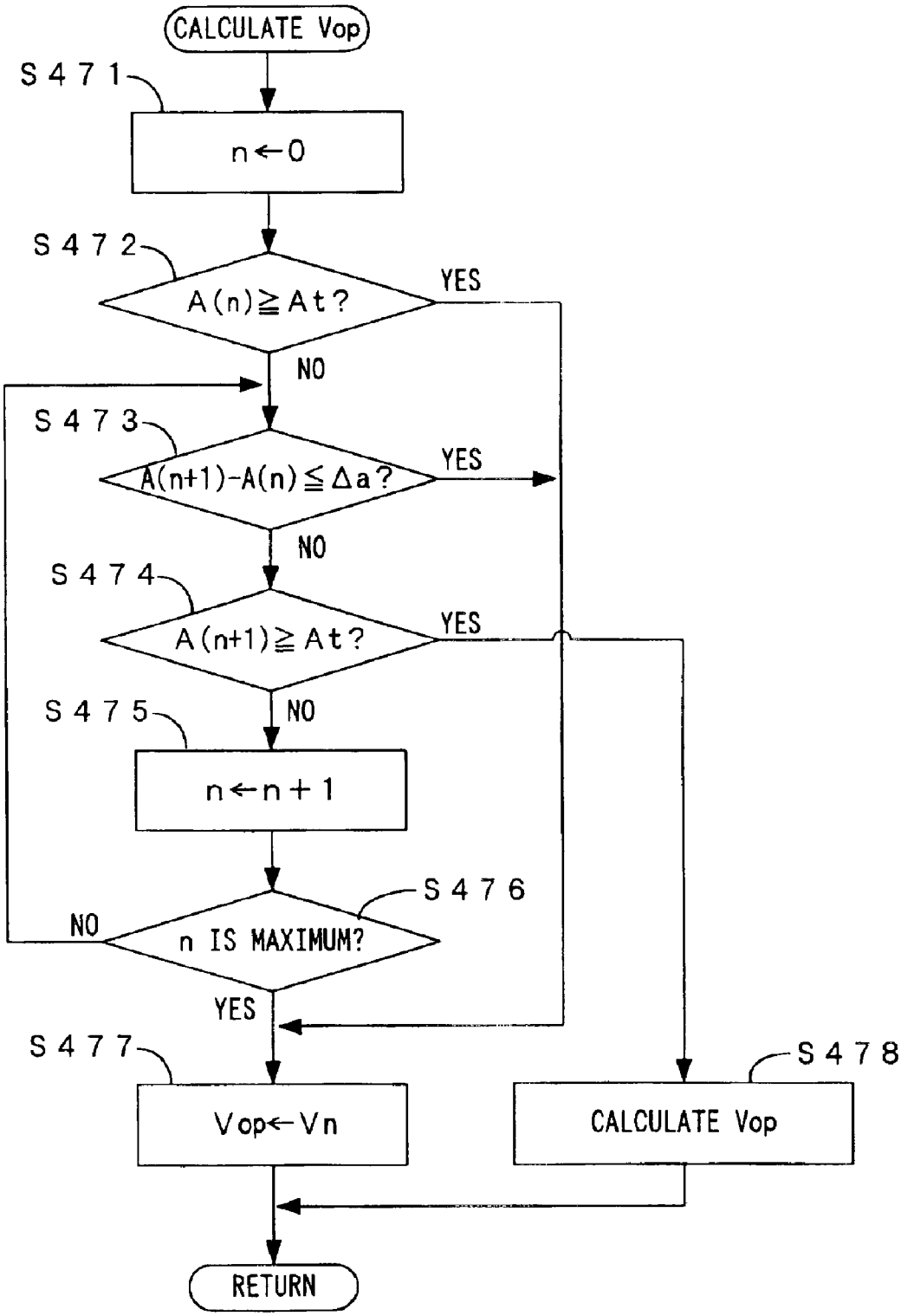
FIG. 19 is a flow chart which shows a process of calculating an optimal value of developing bias in the first preferred embodiment.

As the densities of the patch images (to be more specific, the evaluation values for the patch images) are thus calculated, an optimal value Vop of the average developing bias Vavg is calculated based on these values (Step S47). FIG. 19 is a flow chart which shows a process of calculating the optimal value of the developing bias in this preferred embodiment. This process remain unchanged in terms of content among the toner colors, and therefore, the subscripts (y, C, m, k) expressing evaluation values and corresponding to the toner colors are omitted in FIG. 19. However, the evaluation values and target values for the evaluation values may of course be different value among the different toner colors.

First, a parameter n is set to 0 (Step S471), and an evaluation value A(n), namely A(0), is compared with a control target value At (Akt for the black color for instance) which was calculated earlier (Step S472). At this stage, the evaluation value A(0) being equal to or larger than the control target value At means that an image density over a target density has been obtained with the average developing bias Vavg set to the minimum value V0. Hence, there is no need to study a higher developing bias, and the process is ended acknowledging that the minimum developing bias V0 at this stage is the optimal value Vop (Step S477).

On the contrary, when the evaluation value A(0) is yet to reach the control target value At, an evaluation value A(1) for a patch image Iv1 formed with a developing bias V1 which is one level higher is read out, a difference from the evaluation value A(0) is calculated, and whether thus calculated difference is equal to or smaller than a predetermined value . a is judged (Step S473). In the event that the difference between the two is equal to or smaller than the predetermined value . a, in a similar fashion to the above, the average developing bias V0 is acknowledged as the optimal value Vop. The reason for this will be described in detail later.

On the other hand, when the difference between the two is larger than the predetermined value . a, the process proceeds to a step S474 and the evaluation value A(1) is compared with the control target value At. At this stage, when the evaluation value A(1) is the same as or over the control target value At, since the control target value At is larger than the evaluation value A(0) but is equal to or smaller than the evaluation value A(1), that is since A(0) <At≦A(1), the optimal value Vop of the developing bias for obtaining the target image density must be between the developing biases V0 and V1. In short, V0<Vop≦V1.

In such a case, the process proceeds to a step S478 to calculate the optimal value Vop through computation. While various methods may be used as the calculation method, an example may be to approximate a change in evaluation value in accordance with the average developing bias Vavg as a proper function within a section from V0 to V1 and thereafter to use, as the optimal value Vop, such an average developing bias Vavg with which a value derived from the function is the control target value At. Of these various methods, while the simplest one is a method which requires to linearly approximate an evaluation value change, when the variable range of the average developing bias Vavg is properly selected, it is possible to calculate the optimal value Vop at a sufficient accuracy. Of course, although the optimal value Vop may be calculated by other method, e.g., using a more accurate approximate function, this is not always practical considering a detection error of the apparatus, a variation among apparatuses, etc.

On the other hand, in the event that the control target value At is larger than the evaluation value A(1) at the step S474, n is incremented by 1 (Step S475) and the optimal value Vop is calculated while repeating the steps S473 through S475 described above until n reaches the maximum value (Step S476). In the meantime, when calculation of the optimal value Vop has not succeeded, i.e., when any one of the evaluation values corresponding to the six patch images has not reached the target value, even after n has reached the maximum value (n=5) at the step S476, the developing bias V5 which makes the density largest is used as the optimal value Vop (Step S477).

As described above, in this embodiment, each one of the evaluation values A(0) through A(5) corresponding to the respective patch images Iv0 through Iv5 is compared with the control target value At and the optimal value Vop of the developing bias for achieving the target density is calculated based on which one of the two is larger than the other. But at the step S473, as described earlier, when a difference between the evaluation values A(n) and A(n+1) corresponding to continuous two patch images is equal to or smaller than the predetermined value . a, the developing bias Vn is used as the optimal value Vop. The reason is as follows.

As shown in FIG. 17B, the apparatus exhibits a characteristic that while an image density OD on the sheet S increases as the average developing bias Vavg increases, the growth rate of the image density decreases in an area where the average developing bias Vavg is relative large, but gradually saturates. This is because as toner has adhered at a high density to a certain extent, an image density will not greatly increase even though the amount of the adhering toner increases further. To increase the average developing bias Vavg to further increase an image density in an area wherein the growth rate of the image density is small ends up in excessively increasing the toner consumption although a very large increase in density can not be expected, and as such, is not practical. On the contrary, in such an area, with the average developing bias Vavg set as low as possible just to an extent which tolerates a density change, it is possible to remarkably reduce the toner consumption while suppressing a drop in image density to minimum.

Noting this, in this preferred embodiment, in a range where the growth rate of the image density in response to the average developing bias Vavg is smaller than a predetermined value, a value as low as possible is used as the optimal value Vop. To be more specific, when a difference between the evaluation values A(n) and A(n+1) respectively expressing the densities of the patch images Ivn and Iv(n+1) formed with the average developing bias Vavg set to the two types of biases Vn and Vn+1 respectively is equal to or smaller than the predetermined value . a, the lower developing bias, namely, the value Vn is set as the optimal value Vop. As for the value . a, it is desirable that when there are two images on which evaluation values are different by . a from each other, the value . a is selected such that the density difference between the two will not be easily recognized with eyes or will be tolerable in the apparatus.

This prevents the average developing bias Vavg from being set to an unnecessarily high value although there is almost no increase in image density, thereby trading the image density off with the toner consumption.

The optimal value Vop of the average developing bias Vavg with which a predetermined solid image density will be obtained is thus set to any value which is within the range from the minimum value V0 to the maximum value V5. For improvement in image quality, this image forming apparatus ensures that a potential difference is always constant (325 V for instance) between the average developing bias Vavg and a surface potential in "non-scanning portion", or a portion within an electrostatic latent image on the photosensitive member 2 to which toner will not adhere in accordance with an image signal. As the optimal value Vop of the average developing bias Vavg is determined in the manner above, the charging bias applied upon the charger unit 3 by the charger controller 103, too, is changed in accordance with the optimal value Vop, whereby the potential difference mentioned above is maintained constant.

E. Setting Exposure Energy

Figure 20:
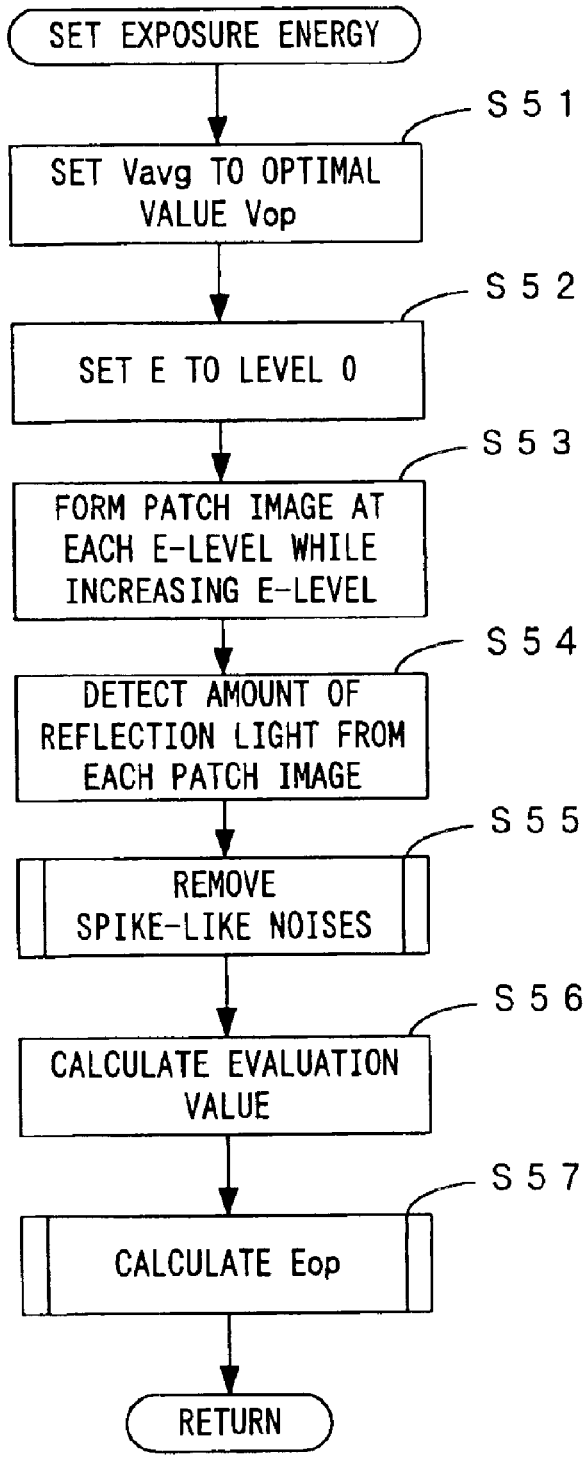
FIG. 20 is a flow chart which shows a process of setting an exposure energy in the first preferred embodiment.

Following this, the exposure energy E is Set to an optimal value. FIG. 20 is a flow chart which shows a process of setting the exposure energy in this preferred embodiment. As shown in FIG. 20, the content of this process is basically the same as that of the developing bias setting process described earlier (FIG. 15). That is, first, the average developing bias Vavg is set to the optimal value Vop calculated earlier (Step S51), and while increasing the exposure energy E from the lowest level 0 by one level each time, a patch image is formed at each level (Step S52, Step S53). The sensor outputs Vp and Vs corresponding to the amount of reflection light from each patch image are sampled (Step S54), spike-like noises are removed from the sample data (Step S55), an evaluation value expressing a density of each patch image is calculated (Step S56), and the optimal value Eop of the exposure energy is calculated based on the result (Step S57).

During this process (FIG. 20), only differences from the developing bias setting process described earlier (FIG. 15) are patterns and the number of patch images to be formed and a calculation of the optimal value Eop of the exposure energy from evaluation values. The two processes are almost the same regarding the other aspects. These differences will now be described mainly.

In this image forming apparatus, while an electrostatic latent image corresponding to an image signal is formed as the surface of the photosensitive member 2 is exposed with the light beam L, in the case of a high-density image such as a solid image which has a relatively large area to be exposed, even when the exposure energy E is changed, a potential profile of the electrostatic latent image does not change very much. On the contrary, for instance, in a low-density image such as a line image and a halftone image in which areas to be exposed are scattered like spots on the surface of the photosensitive member 2, the potential profile of the image greatly changes depending on the exposure energy E. Such a change in potential profile leads to a change in density of a toner image. In other words, a change in exposure energy E does not affect a high-density image very much but largely affects a density of a low-density image.

Noting this, in this preferred embodiment, first, a solid image is formed as a high-density patch image in which an image density is less influenced by the exposure energy E, and the optimal value of the average developing bias Vavg is calculated based on the density of the high-density patch image. Meanwhile, for calculation of the optimal value of the exposure energy E, a low-density patch image is formed. Hence, the exposure energy setting process uses a patch image having a different pattern from that of the patch image (FIG. 16) formed during the developing bias setting process.

While an influence of the exposure energy E over a high-density image is small, if a variable range of the exposure energy E is excessively wide, a density change of the high-density image increases. To prevent this, the variable range of the exposure energy E preferably ensures that a change in surface potential of an electrostatic latent image corresponding to a high-density image (which is a solid image for example) in response to a change in exposure energy from the minimum (level 0) to the maximum (level 3) is within 20 V, or more preferably, within 10 V.

Figure 21:
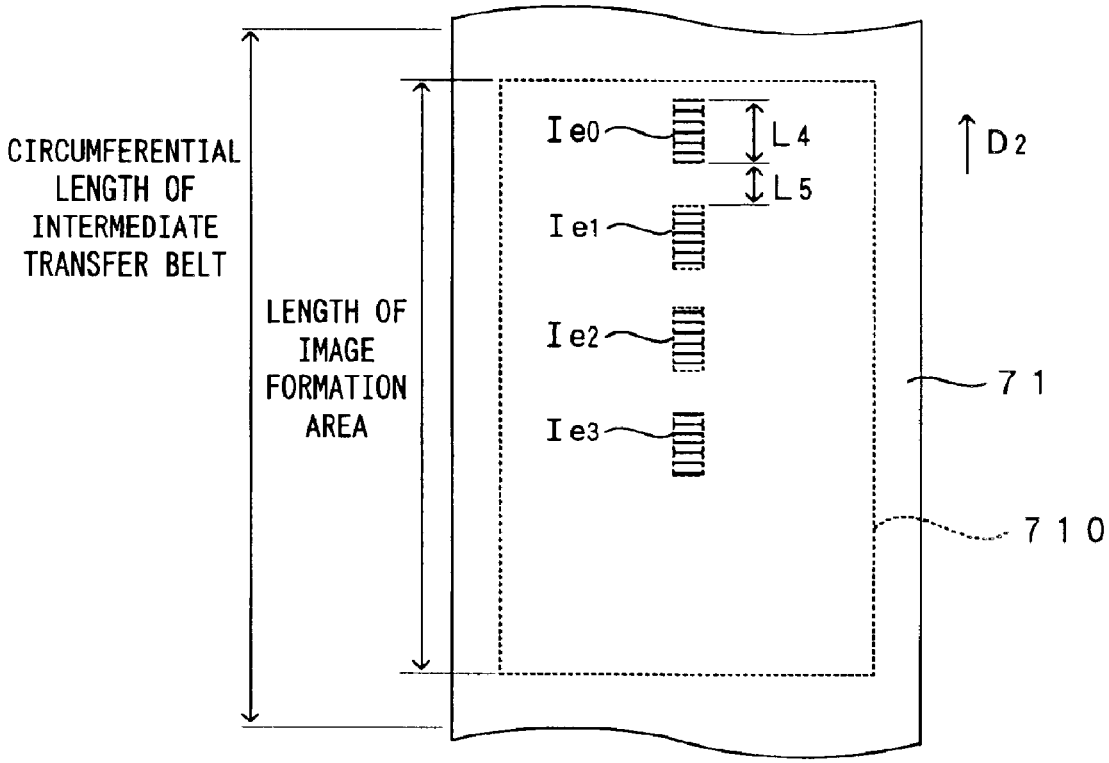
FIG. 21 is a drawing which shows a low-density patch image.

FIG. 21 is a drawing which shows a low-density patch image. As described earlier, this preferred embodiment requires to change the exposure energy E over four stages. In this example, one patch image at each level and four patch images Ie0 through Ie3 in total are formed. A pattern of the patch images used in this example is formed by a plurality of thin lines which are isolated from each other as shown in FIG. 21. To be more specific, the pattern is a 1-dot line pattern that one line is ON and ten lines are OFF. Although a pattern of a low-density patch image is not limited to this, use of a pattern that lines or dots are isolated from each other allows to express a change in exposure energy E as a change in image density and more accurately calculate the optimal value of the exposure energy E.

Further, a length L4 of each patch image is smaller than the length L1 of the high-density patch images (FIG. 16). This is because a density variation will not appear at the cycles of rotation of the photosensitive member 2 during the exposure energy setting process since the average developing bias Vavg has already been set to the optimal value Vop. In other words, present Vop is not the optimal value of the average developing bias Vavg if such a density variation appears even in this condition. However, considering a possibility that there may be density variations associated with deformation of the developer roller 44, it is preferable an average value covering a length which corresponds to the circumferential length of the developer roller 44 is used as the density of the patch image. A circumferential length of the patch image is therefore set to be longer than the circumferential length of the developer roller 44. When moving velocities (circumferential speeds) of the surfaces of the photosensitive member 2 and the developer roller 44 are not the same in an apparatus of the non-contact developing type, considering the circumferential speeds, a patch image whose length corresponds to one round of the developer roller 44 may be formed on the photosensitive member 2.

Gaps L5 between the respective patch images may be narrower than the gaps L2 shown in FIG. 16. This is because it is possible to change an energy density of the light beam L from the exposure unit 6 in a relatively short period of time, and particularly when a light source of the light beam is formed by a semiconductor laser, it is possible to change the energy density of the light beam in an extremely period of time. Such a shape and arrangement of the respective patch images, as shown in FIG. 21, permits to form all of patch images Ie0 through Ie3 over one round of the intermediate transfer belt 71, and hence, to shorten a processing time.

Figure 22:
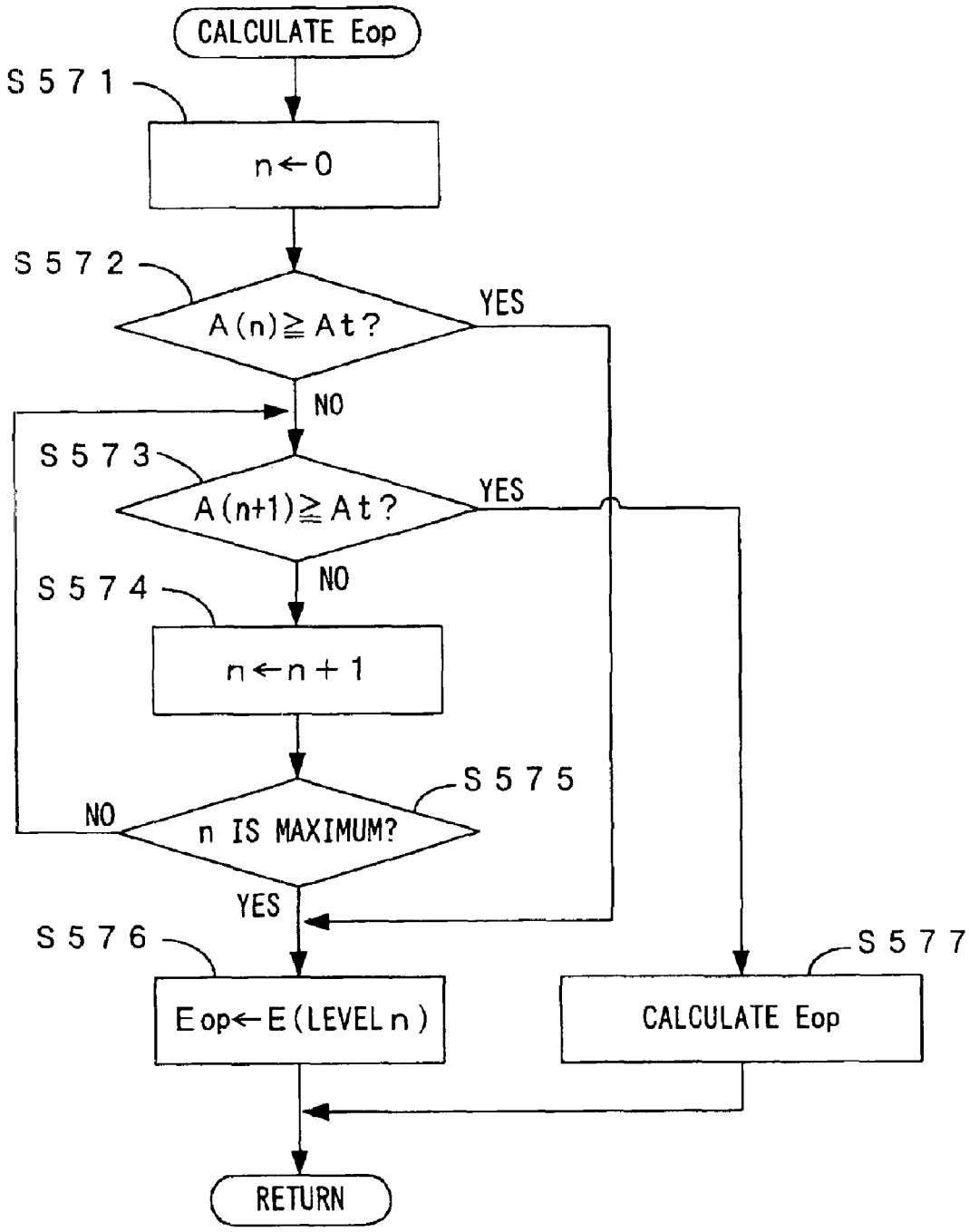
FIG. 22 is a flow chart which shows a process of calculating an optimal value of an exposure energy in the first preferred embodiment.

As for thus formed low-density patch images Ie0 through Ie3, evaluation values expressing the densities of these images are calculated in a similar manner to that described earlier for the high-density patch images. Based on the evaluation values and control target values derived from the look-up table (FIG. 14B) for low-density patch images separately prepared from the look-up table for high-density patch images, the optimal value Eop of the exposure energy is calculated. FIG. 22 is a flow chart which shows a process of calculating the optimal value of the exposure energy in this preferred embodiment. During this process as well, as in the process of calculating the optimal value of the direct current developing bias shown in FIG. 19, the evaluation value is compared with a target value At on the patch images starting from the one formed at a low energy level, and a value of the exposure energy E which makes the evaluation value match with the target value is then calculated, thereby determining the optimal value Eop (Step S571 through Step S577).

However, since within a range of the exposure energy E which is usually used, a saturation characteristic (FIG. 17B) found on the relationship between the solid image densities and the direct current developing bias will not be found on a relationship between the line image densities and the exposure energy E, a process corresponding to the step S473 shown in FIG. 19 is omitted. In this manner, the optimal value Eop of the exposure energy E with which a desired image density will be obtained is calculated.

F. Post-Process

As the optimal values of the average developing bias Vavg and the exposure energy E are calculated in the manner above, it is now possible to form an image to have a desired image quality. Hence, the optimization of the density control factors may be terminated at this stage, or the apparatus may be made remain on standby after stopping the rotations of the intermediate transfer belt 71 and the like, or further alternatively, some adjustment may be implemented to control still other density control factors. The post-process may be any desired process, and therefore, will not be described here.

G. Effects

As described above, the image forming apparatus of this preferred embodiment is provided with the density sensor 60 for irradiating light on the surface of the intermediate transfer belt 71 and receiving light reflected from the surface. The output voltages Vp, Vs from the density sensor 60 are sampled while the amount of toner adhesion corresponding to the patch image density is determined based on the difference between the sensor output associated with the transfer belt free from the toner image and that associated with the patch image borne on the transfer belt. Therefore, the density of the patch image can be determined with high accuracies irrespective of the surface conditions of the intermediate transfer belt 71.

In addition, out of the N1 successive data pieces of the resultant sample data string, each predetermined number of data pieces (3 or 10) of higher order and of lower order are individually replaced with the average value of the remaining N2(=N1−6, or =N1−20) data pieces. In this manner, the spike-like noises contained in the data string are removed. This results in a reduced influence of the spike-like noises contained in the sample data on the sensed patch image density and hence, the density of the patch image is determined with even higher accuracies.

Then, the average developing bias Vavg and the exposure energy E, as the density control factors, are optimized based on the accurate patch image density thus determined, so that these density control factors may be set to optimum values. As a result, the toner image of high quality can be formed in a stable manner.

While the foregoing embodiment illustrates the method for removing the noises from the sensor output Vp corresponding to the p-polarized light component of the reflection light from the intermediate transfer belt 71, the same procedure may be taken to remove noises from the sensor output Vs corresponding to the s-polarized light component. If, in this case, the p-polarized light and the s-polarized light have correlation on the noise occurrence conditions, the noise removal from the sensor output Vs corresponding to the s-polarized light may be done by removing sensor outputs Vs acquired from the positions associated with the data pieces removed from the sample data string of the sensor outputs Vp corresponding to the p-polarized light component. In a case where these polarized lights have no correlation on the noise occurrence conditions, the p-polarized light component and the s-polarized light component may be independently subjected to the aforementioned noise removal.

(3) Others

It is noted that the invention is not limited to the aforementioned embodiment but various changes and modifications may be made thereto within the scope of the invention. Although the embodiment has the arrangement, for example, wherein the density sensor 60 confronts the surface of the intermediate transfer belt 71 for sensing the density of the toner image, as the patch image, primarily transferred to the intermediate transfer belt 71, the arrangement is not limited to this. An alternative arrangement may be made, for example, such that the density sensor confronts the surface of the photosensitive member 2 for sensing the density of the toner image developed on the photosensitive member 2.

On the other hand, there may be a case, the description of which is not made in the above embodiment and in which the rotation of the roller 75 involves periodical variations of a distance between the on-roller area 71*a* of the intermediate transfer belt 71 and the density sensor 60, as a result of the deformation, eccentricity or the like of the roller 75 in opposing relation with the density sensor 60. The distance variations lead to the variations of the amount of light reaching the photodetectors 672*p*, 672*s*, thus resulting in periodical variations of the sensor outputs Vp, Vs. Where the periodical variations associated with the rotation of the roller 75 is encountered, a measure for eliminating the influence thereof may be provided wherein the subject region of calculation on the intermediate transfer belt 71 or the belt section from which the sample data are extracted for the aforementioned spike-like noise removal is so defined as to have a length equal to the overall circumferential length of the roller 75. Then, the amount of periodical variations per rotation of the roller 75 can be canceled by averaging the density information on the region of this length.

The optimization process for the density control factor according to the embodiment includes the steps of sequentially idling the developing rollers 44 by positioning each of the developing units thereof at the development position in turn, and then sequentially forming the patch images by switching from one developing unit to another. Alternatively, the idling of the developing roller followed by the formation of the patch image may be performed in sequence on a per-developing-unit basis. This approach reduces the number of operations for switching from one developing unit to another. Hence, an apparatus required of silence characteristic in standby state, for example, may adopt this approach for minimizing the frequencies of operation noises associated with the switching of developing units.

The procedure for optimizing the density control factor according to the above embodiment is merely exemplary and other procedures may be taken. Although the pre-operations 1 and 2 are started at a time according to the above embodiment, for example, these pre-operations need not necessarily be started simultaneously. The control target value of the image density need be determined at least before the optimum value Vop of the developing bias is determined. That is, the control target value may be determined at a different point of time or prior to the pre-operation, for example.

Although the above embodiment accomplishes the noise elimination by removing each predetermined number of data pieces of higher order and of lower order from each of the sample data strings on the foundation profile and on the patch image density, the noise removal is not limited to this. The noise may be removed by performing the above processing on the foundation profile alone, or on the patch image density alone.

The above embodiment stores the sample data acquired by sampling the outputs from the density sensor 60 for the overall circumferential length of the intermediate transfer belt 71 as the foundation profile thereof. However, an alternative arrangement may be made such that only sample data acquired from the places to be formed with the patch images in the subsequent step are stored, thereby reducing the amount of data to be stored. If, in this case, the individual patch images are formed on the intermediate transfer belt 71 at places with the highest possible degree of alignment with the sampled positions, a common foundation profile may be used in the calculation on the individual patch images so that the efficiency of the calculation is further increased.

While the above embodiment defines the developing bias and the exposure light energy as variable parameters serving as the density control factor for the image density, it is also possible to define only one of these parameters as the variable for controlling the image density. Furthermore, any other density control factor may be used. The above embodiment is arranged such that the charging bias is varied in conjunction with the developing bias but the arrangement is not limited to this. The charging bias may be defied as a fixed factor or may be made to vary independently from the developing bias.

The above embodiment illustrates the image forming apparatus including the intermediate transfer belt 71 as an intermediate medium for temporarily bearing the toner image developed on the photosensitive member 2. However, the invention is also applicable to other image forming apparatuses including any other intermediate medium such as a transfer drum or transfer roller, or to an image forming apparatus including no intermediate medium and adapted for direct transfer of the toner image formed on the photosensitive member 2 onto a sheet S as a final receiving media.

While the image forming apparatus of the above embodiment is adapted to form a full-color image using the toners of 4 colors including yellow, cyan, magenta and black, the colors of the used toners and the number of used color toners are not limited to this but are arbitrary. For example, the invention is also applicable to an image forming apparatus for forming a monochromatic image using only the black toner.

According to the above embodiment, the invention is applied to the printer which carries out the image forming operations based on the image signal supplied from an external source. As a matter of course, the invention is also applicable to a copy machine designed to internally generate an image signal in response to a user's demand for image formation such as given by depressing a copy button, and to perform the image forming operations based on the image signal; or to a facsimile machine adapted to perform the image forming operations based on an image signal applied via a communication line.

According to the invention, as described above, the output signals from the optical sensor are sampled for a plurality of measurement areas in the subject region of calculation included in the patch image, while only N2 sample data pieces out of the resultant N1 sample data pieces are regarded as significant data such that the amount of toner adhered to the subject region of calculation is determined from the N2 data pieces. In other words, (N1−N2) data pieces out of the N1 sample data pieces are excluded as data possibly containing some noises whereas only the remaining N2 data pieces are used for the calculation of the amount of toner adhered to the subject region of calculation. Thus, even if the N1 sample data pieces contain a data piece significantly deviated from its true value due to the influences of noises caused by various factors, such an erroneous data piece can be removed so as to obtain a more accurate image density.

Then, the density control factors are optimized based on the patch image densities thus determined and hence, the toner images of high quality can be formed in a stable manner.

Second Preferred Embodiment

Next, description is made on a second preferred embodiment of the image forming apparatus according to the invention. The image forming apparatus of this embodiment has an arrangement attained by partially modifying the apparatus of the first preferred embodiment. Therefore, like parts are represented by like reference characters, respectively, the explanation of which is dispensed with, while the description here principally focuses on differences from the first preferred embodiment.

Figure 23:
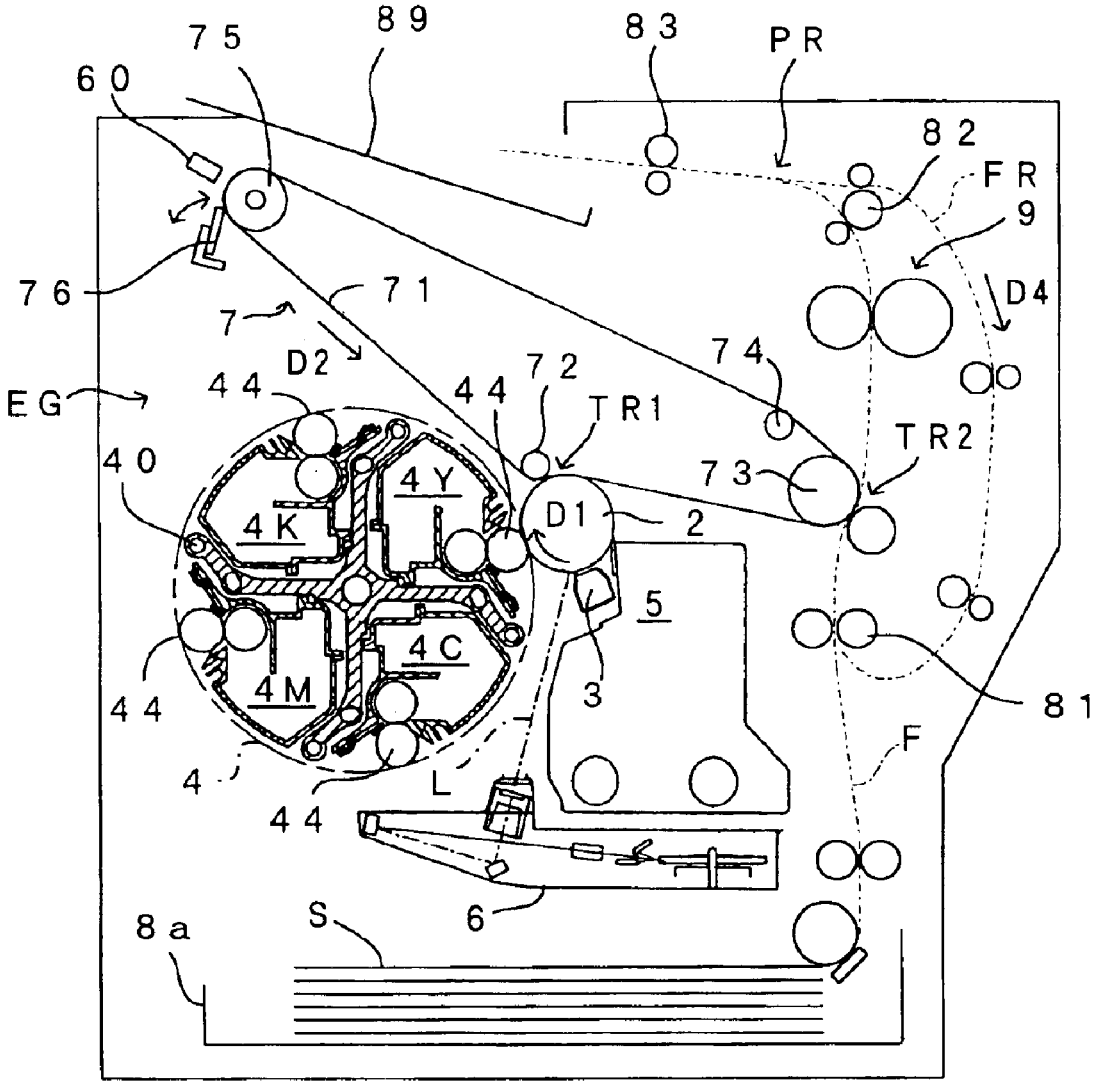
FIG. 23 is a drawing which shows an image forming apparatus according to a second preferred embodiment of the invention.

FIG. 23 is a drawing which shows an image forming apparatus according to the second preferred embodiment of the invention. This embodiment has three major structural differences from the apparatus of the first preferred embodiment. Firstly, the apparatus of the first preferred embodiment (FIG. 1) is constructed such that a part of the cassette 8 for holding the sheets S is projected outward from the apparatus body, whereas the apparatus of the second preferred embodiment (FIG. 23) has a structure wherein a cassette 8*a* is accommodated in the apparatus body. Secondly, the apparatus of the first preferred embodiment is designed to form an image only on one side of the sheet S, whereas the apparatus of the second preferred embodiment is capable of forming images on both sides of the sheet S.

Operations for forming the images on both sides of the sheet S will be described in more details. The operations for forming the image on one side of the sheet S are basically the same as those performed in the first preferred embodiment. Specifically, a sheet S taken out from the cassette 8*a* is transported along a feeding path F to the secondary transfer region TR2, where an image formed on the intermediate transfer belt 71 is transferred to the sheet S. After passing through the fixing unit 9, the sheet S is transported through a pre-discharge roller 82 and a discharge roller 83 to be discharged on a discharge tray 89 disposed at an upper part of the apparatus body.

Where an image is formed on the other side of the sheet S, on the other hand, the rotation of the discharge roller 83 is reversed at the point of time when a trailing end of the sheet S thus formed with the image on one side thereof is brought to a reverse position PR downstream from the pre-discharge roller 82. Thus, the sheet S is transported along a reversal feeding path FR in a direction of an arrow D4. Then again, the sheet S is guided into the feeding path F via place upstream from a gate roller 81. In this step, the sheet S in the secondary transfer region TR2 contacts the intermediate transfer belt 71 on the opposite side from that previously formed with the image so that an image is transferred to the other side of the sheet. In this manner, the images are formed on the both sides of the sheet S.

The third difference of the apparatus of the second preferred embodiment from that of the first preferred embodiment consists in the circuit configuration of the density sensor 60 (FIG. 2). As compared with the p-polarized light component identical with the irradiation light, the s-polarized light component in the reflection light has a lower level so as to be varied less relative to the varied amounts of toner. Hence, this embodiment defines a gain ratio Sg of the amplifier circuit 673*s* versus the amplifier circuit 673*p* as Sg=3. That is, the gain for the s-polarized light component is 3 times greater the gain for the p-polarized light component so as to improve the dynamic range.

Out of the operations performed by the apparatus of the second preferred embodiment, operations for calculating the amount of toner adhered to the patch image are quite different from those of the apparatus of the first preferred embodiment. According to the first preferred embodiment, the "subject region of calculation" to be determined for the amount of toner adhesion accounts for a larger area of the surface of the intermediate transfer belt 71 than the size of the detection spot of the density sensor 60. The amount of toner adhered to the subject region of calculation is determined from the sample data on the plural "measurement areas" in the region.

In short, the apparatus of the first preferred embodiment defines a relatively larger region including the plural "measurement areas" as the "subject region of calculation". In contrast, the apparatus of the second preferred embodiment defines a region substantially of an equal size to that of the detection spot of the density sensor 60 as the "subject region of calculation". That is, the second preferred embodiment regards one of the "measurement areas" as the "subject region of calculation" when calculating the amount of toner adhered to the region. As will be described hereinlater, this approach is favorable in a case where the distribution of the amounts of toner adhesion on a per-position basis is desired.

In the image forming apparatus of the embodiment, the CPU 101 uses the density sensor 60 as the "optical sensor" of the invention for evaluating the density of the toner image formed as the patch image on the intermediate transfer belt 71. It is noted that instead of directly determining the density of the patch image, the amount of toner adhered to the intermediate transfer belt 71 to form the patch image is determined. Based on the result, the CPU optimizes the image forming conditions by adjusting the control factors affecting the image quality, which include the magnitude of the developing bias applied to each developing unit, the intensity of exposure light beam L and the like, thereby ensuring that images of a given quality are formed in a stable manner.

Referring to FIGS. 24 to 28, the following description is made by way of an example of a method for determining the optimum value of the developing bias as the control factor. The same method may be used for determining the optimum values of other control factors such as the intensity of the exposure light beam L and the charging bias, etc.

Figure 24:
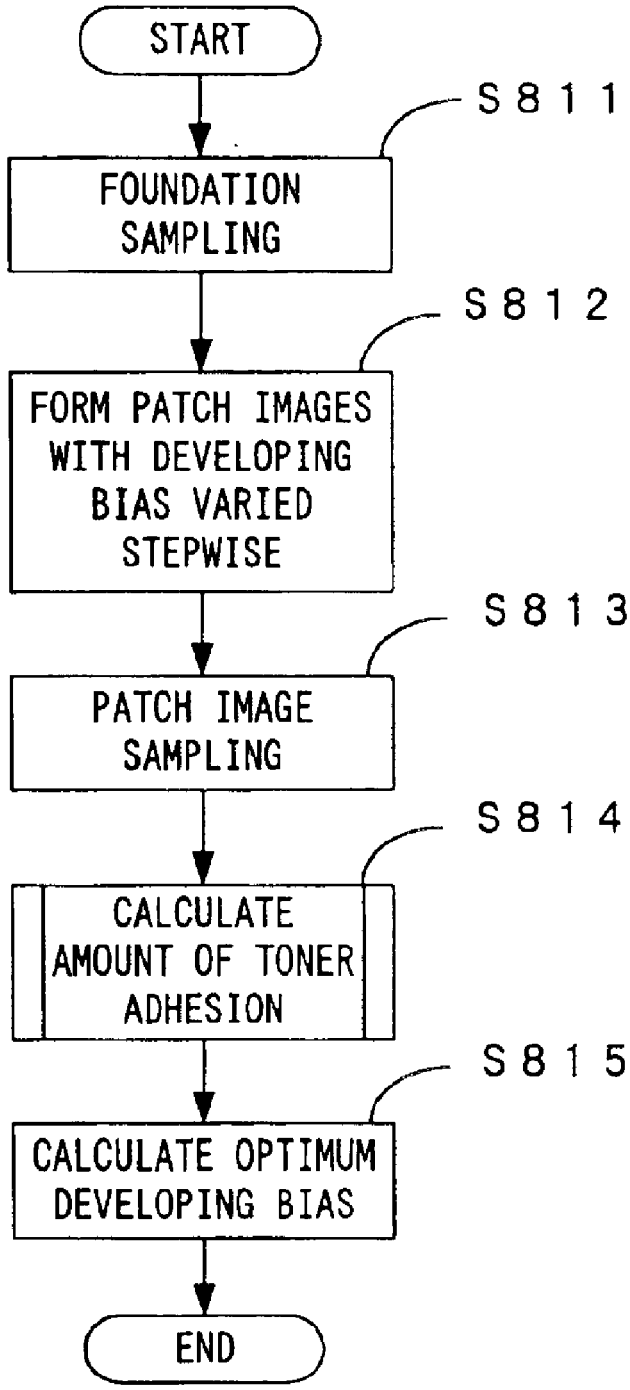
FIG. 24 is a flow chart which shows the steps of a developing-bias optimization process according to the second embodiment.
Figure 25A:
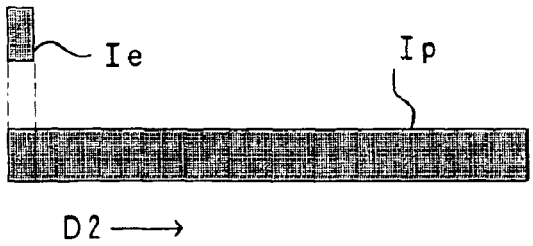
FIGS. 25A, 25B and 25C are drawings which show a patch image formed in the process.
Figure 25B:
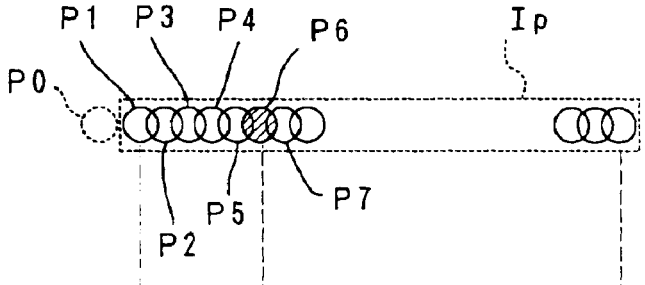
Figure 25C:
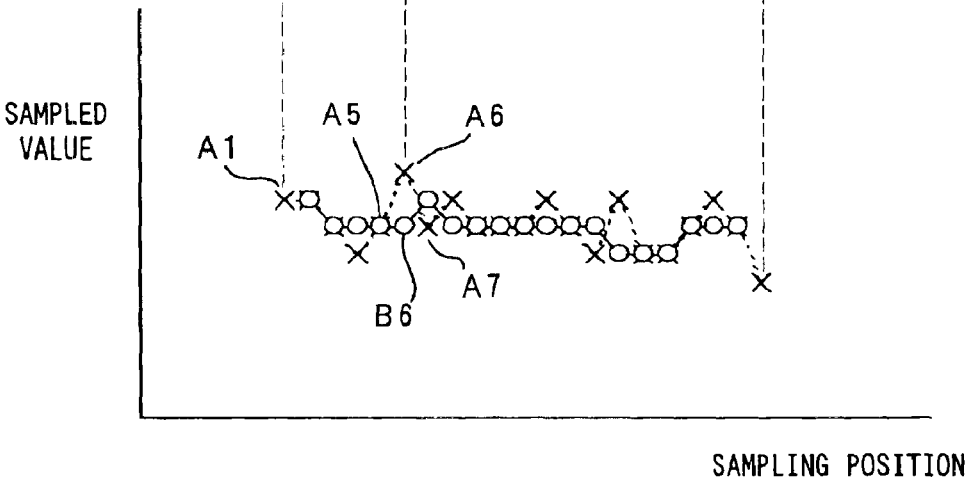

FIG. 24 is a flow chart which shows the steps of a process for optimizing the developing bias according to the second preferred embodiment, whereas FIGS. 25A, 25B and 25C are drawings which show patch images formed in this process. The process is started by performing foundation sampling (Step S811). Specifically, with the intermediate transfer belt 71 driven at a given speed along the predetermined direction (the direction of the arrow D2 in FIG. 1) prior to the formation of patch images, a predetermined amount of light is irradiated on the surface of the belt by the density sensor 60. The sensor 60, in turn, provides output voltages Vp, Vs indicative of the amount of reflection light from the intermediate transfer belt, while the voltage outputs are sampled at predetermined time intervals (8 msec intervals). Thus is acquired a sample data string representing the surface conditions of the intermediate transfer belt 71.

Next, patch images of a predetermined pattern are sequentially formed with the developing bias, as the control factor, varied stepwise (the developing bias varied in exemplary steps of 6). That is, the patch images are each formed at each of the bias values and transferred to the intermediate transfer belt 71 (Step S812). The patch image Ip is obtained by repeatedly forming a predetermined image pattern Ie in an array along the moving direction of the intermediate transfer belt 71. The predetermined image pattern may be a solid image shown in FIG. 25A, a halftone image, a discrete dot-line image, a discrete dot image or the like.

Thus, 6 patch images formed at individually different developing bias are arranged on the intermediate transfer belt 71 along the moving direction D2 thereof. The density sensor 60 irradiates each of the resultant patch images Ip with the predetermined amount of light while the output voltages Vp, Vs outputted from the density sensor 60 in correspondence to the amount of the reflection light therefrom are sampled at given time intervals (Step S813).

In some cases, the patch image Ip may suffer density variations resulting from inconsistent rotation or eccentricity of the developing roller 44 or photosensitive member 2. As shown in FIG. 25B, therefore, the influences of such a drawback are eliminated by performing the sampling on plural sampling points P1, P2, . . . arranged in one patch image Ip with equal spacing as moving the intermediate transfer belt 71 and then determining an average value of the sample data pieces. For meeting this purpose, it is preferred to define the length of the patch image Ip along the direction of the arrow D2 to correspond to a circumferential length of the developing roller 44 or the photosensitive member 2.

It is noted that these sampling points P1 and the like are not previously provided on the intermediate transfer belt 71 but are rather phantom points defined by surface areas, light rays from which are detected by the density sensor 60 during the performance of the sampling operation. Although FIG. 25B shows an example wherein a respective pair of adjoining sampling points partially overlap with each other, the arrangement of the sampling points is not limited to this. The individual sampling points may be arranged in spaced relation.

Next, the amount of toner adhesion to the patch image Ip is calculated from the sampling results thus obtained (Step S814). According to the embodiment, the amount of toner adhered to each sampling point of interest in the patch image, or to each "subject region of calculation" of the invention is calculated based on the following two concepts. The calculation method is described by way of example where a cross-hatched sampling point P6 in FIG. 25B is considered as the "subject region of calculation".

First, an amount of toner adhered to the sampling point P6 is determined using sample data pieces on the sampling point P6 before and after the formation of the patch image. This approach gives consideration to the surface conditions of the intermediate transfer belt 71, as the foundation of the patch image, which may affect the sampling results, thus aiming at canceling the influence of the surface conditions.

Second, the sample data pieces on the sampling point P6 before and after the formation of the patch image are not directly used for determination of the amount of toner adhesion. Alternatively, the amount of toner adhesion is determined using the results of a noise correction process, to be described hereinlater, using sample data pieces on plural surface areas neighboring the sampling point P6 (sampling points P5, P7 and the like on both sides of the sampling point P6). This serves the purpose of canceling the influences of noises and the like superimposed on the sampling results.

Now description is made on the principles of the noise correction process performed on foundation sampling data and patch-image sampling data. A sample data string obtained by sampling the outputs from the density sensor 60 may contain data pieces of values notably deviated from true values, as indicated by mark "x" in FIG. 25C, as a result of mars or dirts on the intermediate transfer belt 71 or electrical noises entering the density sensor 60. That is, the individual sample data pieces may contain errors resulting from various causes. The sample data piece significantly deviated from its neighboring data pieces should be considered to have poor reliability because it is unthinkable that a specific point presents a significantly different sampling result from those of its neighboring points, given the patch image Ip formed under constant conditions and the surface conditions of the intermediate transfer belt 71 prior to the formation of the patch image.

Accordingly, the sample data piece having a significantly different value from those of its neighboring data pieces need be excluded from the sample data on all the sampling points. Such a data piece is regarded as being affected by the noises and the like and hence, should not be used in the subsequent calculation.

Figure 26:
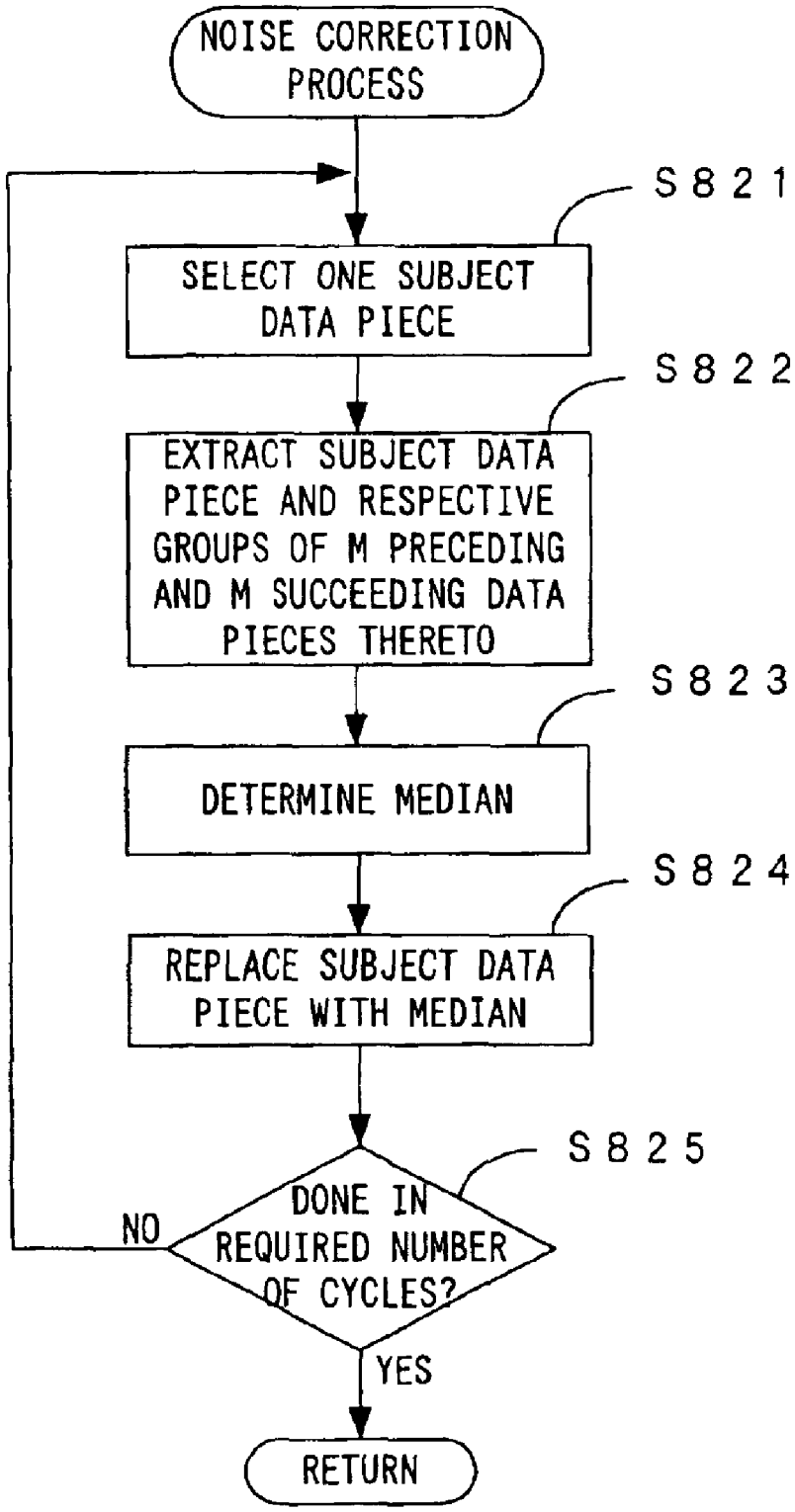
FIG. 26 is a flow chart which shows the steps of a noise correction process.

The embodiment reduces the influences of such noises and errors as follows. For each sampling point, sample data pieces on itself and its neighboring sampling points are extracted to determine a median of the extracted data. The resultant median is used as data indicative of the amount of toner adhered to the sampling point of interest. Specifically, the respective sample data pieces on the sampling points are subjected to the noise correction process as shown in FIG. 26. The process is equivalent to a process based on the assumption of M1=M2=M (M represents a natural number) according to the invention.

FIG. 26 is a flow chart which shows the steps of the noise correction process, which is started by selecting one sample data piece as a processing subject (Step S821). Then, sample data pieces on the selected sampling point and its neighboring points are extracted. More specifically, the sample data piece on the subject sampling point and those on a respective group of M preceding sampling points and M succeeding sampling points thereto (the sampling points on the upstream side and on the downstream side along the direction D2) are extracted from the data pieces sampled while moving the intermediate transfer belt 71 (Step S822). Thus are extracted (2M+1) data pieces in total.

Next, a median of the (2M+1) sample data pieces or the (M+1)−th greatest or smallest value of the data pieces is determined (Step S823). Subsequently, the sample data piece on the subject sampling point is replaced with the median thus determined (Step S824). That is, the median is regarded as the data piece indicative of the amount of toner adhered to the subject sampling point.

These (2M+1) sample data pieces on the sampling points in close adjacency should have values which do not differ so much from one another. Therefore, a true sensed value (free from noise influence) of the subject sampling point should approximate to the aforesaid median. Thus, the replacement has an insignificant influence on the resultant data if the sample data on the subject sampling point is free from the noise influence. If the median is represented by the sample data piece on the subject sampling point, the replacement has no influence on the resultant data at all.

On the other hand, if the sample data piece on the subject sampling point is greatly deviated from its true value because of the noises or the like, the replacement excludes such a sample data piece containing the noises or the like. Hence, the subsequent calculation is not affected by the noises or the like.

Thus, the noise correction process replaces the sample data piece on each sampling point with the median of the sample data pieces on the group of (2M+1) sampling points with the subject sampling point positioned at center, thereby preventing the subsequent calculation of the amount of toner adhesion from giving a result affected by the noises.

As an alternative approach to the noise correction based on the replacement with the median, an average value of the data pieces, for example, may be used in the noise correction based on the preceding and succeeding data pieces. In this approach, an average value of a total number of 2M data pieces including respective groups of M preceding and succeeding data pieces to the subject sampled data piece, or an average value of a total number of (2M+1) data pieces including the above data groups and the subject data piece is determined such that the average value thus determined is regarded as a value indicative of an amount of toner adhesion at the subject sampling point. This approach, however, involves a fear of detrimentally increasing errors if noises are contained in any of the sample data pieces used in the calculation. What is worse, the errors are propagated to preceding and succeeding data pieces to that containing the noises.

In contrast, the aforementioned correction based on the median can completely exclude the sample data piece containing noises from the subsequent calculation and hence, does not encounter the above problem.

After completion of the data replacement with respect to one subject sampling point, the above procedure is repeated in a required number of cycles while sequentially shifting the subject sample data piece from one to the other. Thus, the data pieces on the other sampling points are replaced the same way (Step S825).

The sequential performance of the noise correction involves a case where a plurality of sample data pieces used for the noise correction of data on one sampling point include a data piece already subjected to the noise correction. This poses a question as to whether a pre-correction sample data piece should be used or a post-correction sample data piece should be used. It is preferred to use the post-correction data piece from the viewpoint of enhancing the noise elimination effect.

Such a noise correction process provides an array of sample data pieces removed of the influence of noises as represented by blank circles in FIG. 25C. FIG. 25C shows an exemplary result of the process shown in FIG. 26 which is performed based on M=1. Specifically, in the noise correction of this example, the subject sample data piece is replaced with a median of 3 data pieces including the subject sample data piece and a respective preceding and succeeding sample data piece thereto. By way of example of the sampling point P6 in FIG. 25B, a median A5 of sample values A6, A5 and A7 of the subject sampling point P6 and its adjoining sampling points P5 and P7 is used as a corrected data piece B6 corresponding to the sampling point P6. The data pieces on the other sampling points may be corrected the same way.

The sample data string includes a data piece without a neighboring data piece to be used for the correction thereof. For instance, the first data piece A1 of the sample data string is free from a preceding data piece thereto and hence, the above noise correction cannot be performed thereon. Because of the possibility of noise inclusion, it is preferred to exclude such a data piece in the subsequent processings.

More generally, where (2M+1) sample data pieces are used for the noise correction, it is preferred that M foremost data pieces and M rearmost data pieces of the sample data array are not used for the noise correction. In other words, the size of the patch image to be formed or the number of sampling points need be determined taking it into account that the patch image and the selected sampling points include such data pieces as inapplicable to the subsequent calculation.

Otherwise, these sample data pieces may be used after subjected to any other correction process. In an example, a sample data piece on a subject sampling point may be replaced by a corrected data piece on a sampling point adjacent to the subject sampling point. In another example, an average value of the data pieces on the subject sampling point and its adjoining sampling point may be used as the corrected data piece on the subject sampling point.

In order to perform the noise correction on the sample data on the patch image, in particular, all the sample data pieces used for the correction process must be sampled at the sampling points in the patch image. If a data piece sampled at a sampling point P0 outside of the patch image Ip is used for the noise correction of the sample data piece on the sampling point P1 in the patch image Ip, for example, a serious error will result.

While performing the noise correction on the foundation sampling data and the patch-image sampling data, the amount of toner adhered to each of the sampling points in the patch image is calculated based on the data so corrected.

Figure 27:
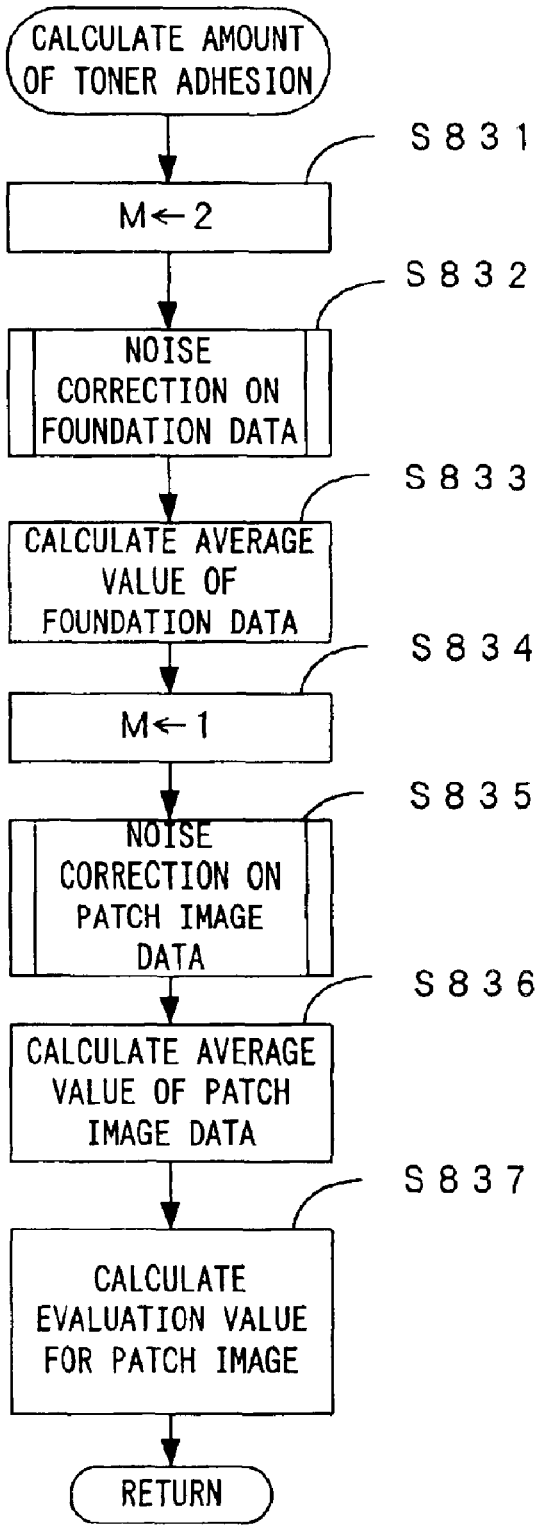
FIG. 27 is a flow chart which shows the steps of a toner adhesion calculation process.

FIG. 27 is a flow chart which shows the steps of the calculation of the amount of toner adhesion, in which Steps S831 to S833 concern the foundation sampling data whereas Steps S834 to S836 concern the patch-image sampling data.

First, the noise correction of the foundation sampling data is performed based on M=2 (Steps S831, S832). Specifically, the foundation sampling data are corrected using the median of 5 data pieces including the subject sample data piece.

Then, an average value of the data pieces thus corrected (hereinafter, referred to as "foundation data") is calculated (Step S833). The average value indicates a surface condition of the intermediate transfer belt 71 bearing no toner image, or particularly a color tone thereof. It is noted here that respective average values of the sampled output voltages Vp and Vs corresponding to the p-polarized light component and s-polarized light component, which are subjected to the above noise correction, are referred to as "Vtp_ave" and "Vts_ave".

Next, the noise correction of the patch-image sampling data is performed based on M=1 (Steps S834, S835). This correction uses the median of 3 data pieces including the subject sample data piece. Then, an average value of the data pieces thus corrected (hereinafter, referred to as "patch image data") is calculated (Step S836). The average value indicates a normal color tone of the patch image on the intermediate transfer belt 71. It is noted here that respective average values of the sampled output voltages Vp and Vs corresponding to the p-polarized light component and s-polarized light component, which are subjected to the above noise correction, are referred to as "Vdp_ave" and "Vds_ave".

It is noted here that the number M indicative of the number of data pieces used for the noise correction is differentiated between the foundation data and the patch image data for the following reasons. With increase in the number M, the variations of the sample data pieces are more flattened but on the other hand, information on subtle color tone variations is lost. Since the surface of the intermediate transfer belt 71 free from toner has a consistent color tone without subtle variations, a relatively large numerical value may be defined for the foundation data indicative of the color tone of the belt surface.

As to the patch image Ip formed on a part of the surface of the intermediate transfer belt 71, the correction principles make it impossible to obtain corrected data pieces on the M foremost ones and the M rearmost ones of the sampling positions in the patch image Ip. Accordingly, an increased numerical value M results in the decrease in the number of valid data pieces. Furthermore, there is a fear of missing density variations and the like associated with the operation characteristics of the apparatus although the density variations and the like do not directly affect the data which are averaged in this embodiment.

Thus, it is desirable that the number of data pieces used for the correction or the numerical values M1, M2 of the invention are properly changed or defined according to the state of the measurement subject. Where the correction is performed using the median of these data pieces, as described above, it is preferred to use an equal number of preceding and succeeding data pieces to the subject region of calculation. That is, the numerical value M1 is preferably defined to be equal to the numerical value M2. Because of the nature that the foundation basically has a higher degree of homogeneity than the patch image, the number of data pieces used for the correction of the foundation data is preferably greater than or at least equal to those used for the correction of the patch image. According to the embodiment, the foundation data are corrected based on 5 data pieces with the subject sample data piece positioned at center (M=M1=M2=2), whereas the patch image data are corrected based on 3 data pieces with the subject sample data piece positioned at center (M=M1=M2=1).

After the correction of the foundation data and patch image data, an evaluation value for the patch image Ip is determined using the resultant values (Step S837). The evaluation value is not a physical value directly representing the density of the patch image, but a value representing the density thereof on scale. Specifically, the evaluation value Gt is determined based on the following equation:

$$Gt=1-\{Sg\cdot(Vdp_ave-Vp\mathbf{0})-(Vds_ave-Vs\mathbf{0})\}/\{Sg\cdot(Vtp_ave-Vp\mathbf{0})-(Vts_ave-Vs\mathbf{0})\} \quad \text{(Equation 2.1)}$$

In the above equation, Vp0 and Vs0 represent voltages Vp and Vs sampled with the light emitter element 601 of the density sensor 60 deactivated. As shown in FIG. 4, an offset voltage 674*p*, 674*s* is applied to output lines of the light receiver elements 672*p*, 672*s* so that the density sensor 60 outputs predetermined output voltages Vp, Vs even when the light emitter element 601 is deactivated. The above values Vp0 and Vs0 represent the voltages outputted in this state and hence, only the amount of voltage variations corresponding to the sensed reflection light can be extracted by subtracting the voltage value Vp0 or Vs0 from each sample data piece (or an average value of the sample data).

In addition, a gain difference between the amplifier circuits 673*p*, 673*s* constituting the density sensor 60 is compensated by multiplying only the term corresponding to the p-polarized light component by the value Sg.

The evaluation value Gt thus determined takes 0 when no toner is adhered to the intermediate transfer belt 71 while taking 1 when the maximum amount of toner is adhered thereto to provide a sufficient image density. Thus, the use of the evaluation value Gt provides a normalized representation of the amount of toner on a scale from 0 to 1, the toner forming the patch image.

When the respective evaluation values Gt for 6 patch images are determined, the operation flow returns to the process for optimizing the developing bias shown in FIG. 24 where the optimum value of the developing bias is determined using these evaluation values (Step S815). The principles of the optimization process are described with reference to FIG. 28.

Figure 28:
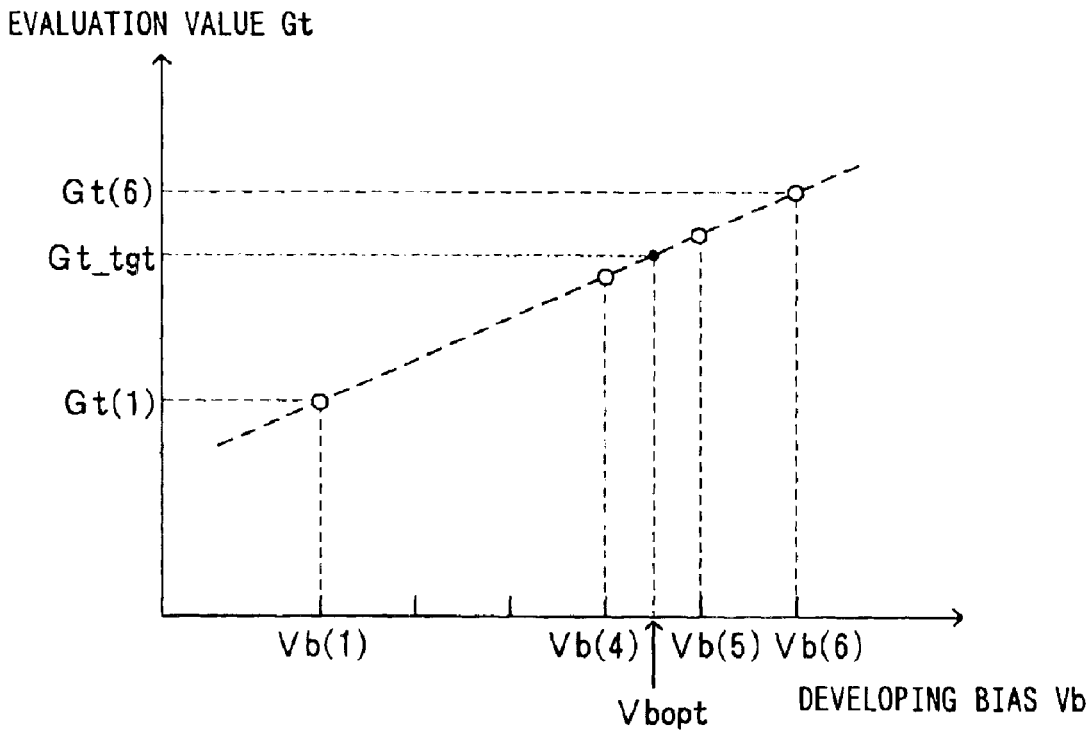
FIG. 28 is a graph explanatory of the principles of the developing bias optimization process.

FIG. 28 is a graph showing the principles of the developing-bias optimization process. The image of a predetermined pattern may be controlled to a predetermined density as follows. A target value Gt_tgt for the evaluation value Gt is previously determined according to a target density of the image and then a developing bias Vb is determined such as to establish coincidence between an evaluation value Gt of the pattern image and the target value Gt_tgt.

Patch images are formed with the developing bias varied in 6 steps from Vb(1) to Vb(6). A relationship between the developing bias Vb and the evaluation value Gt is determined by plotting the evaluation values Gt of the individual patch images against the developing biases Vb. The optimum value Vbopt of the developing bias Vb can be determined based on this relationship. Since the optimum developing bias Vbopt is between bias values Vb(4) and Vb(5) in the example shown in FIG. 28, the optimum developing bias Vbopt is determined by interpolation between these two plots.

The optimum developing bias Vbopt thus determined may be stored in, for example, the RAM 107 from which the optimum developing bias may be retrieved and used as the set value of the developing bias Vb in the subsequent image forming operations. Thus, the desired image density can be attained in a stable manner.

As mentioned supra, the same procedure may be taken to optimize other control factors such as the intensity of the exposure light beam L and the charging bias. While the aforementioned process handles one toner color, a plurality of toner colors can be handled by repeating the above processes in a required number of cycles. In this case, the foundation sampling data, the corrected data thereof and the calculated average value can be shared so that these processings need not be performed for each toner color.

The aforementioned calculation of the amount of toner adhesion determines the average amount of toner adhered to the patch image Ip (Step S836 in FIG. 27) by averaging the respective sample data pieces on the sampling points P1, P2 . . . in the patch image Ip, on assumption that the toner is substantially uniformly adhered to the area of the patch image Ip. In some cases, however, there may be a need for examining how the amount of toner adhesion varies in the patch image Ip (hereinafter, referred to as "patch image profile"). As mentioned supra, the patch image Ip may sustain the density variations resulting from the inconsistent rotation or eccentricity of the developing roller 44 or photosensitive member 2. However, images featuring an even higher image quality with little density variations may be obtained by carrying out the image formation wherein the patch image profile is obtained for evaluating the degree of density variations and, as required, correction is made in a manner to eliminate the density variations.

Figure 29:
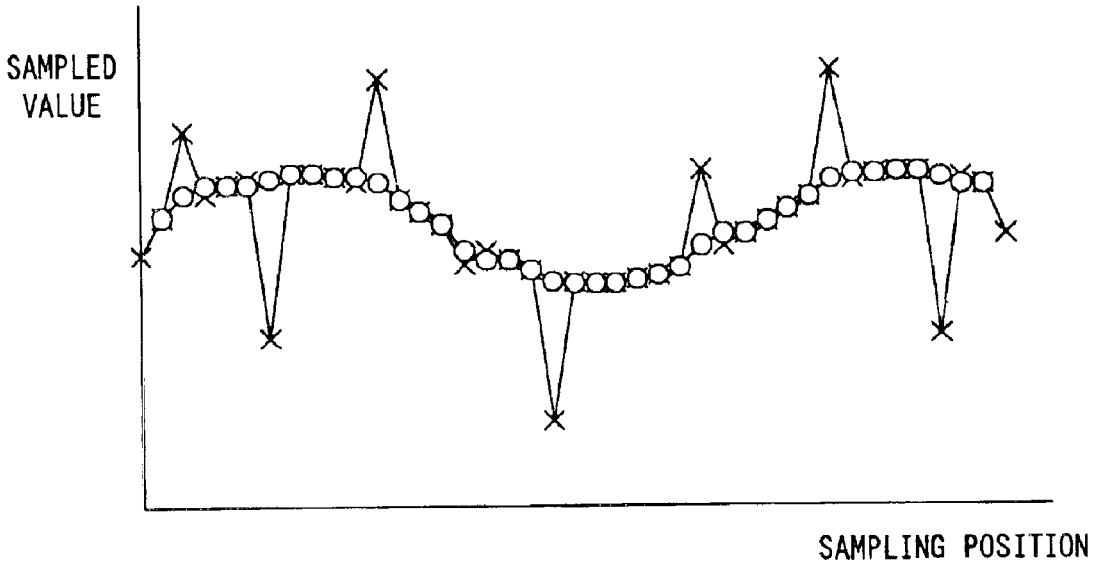
FIG. 29 is a graph which shows an example of sampled data having periodical variations.

FIG. 29 is a graph which shows an example of sampling data presenting periodical variations. Where the developing roller 44 has eccentricity, for example, periodical density variations based on the circumferential length of the developing roller 44 appear on the patch image. Accordingly, the sample data on the patch image also present periodical variations, as shown in FIG. 29. In addition, the sample data may also include notably deviated data pieces (indicated by x) due to the influence of noises.

When such a sample data string is subjected to the same noise correction as the above (FIG. 26), the notably deviated data pieces due to noises can be removed without canceling the periodical density variations associated with the eccentricity of the developing roller 44. Then, the distribution of toner adhesion in the patch image or in other words, the patch image profile may be obtained from the data string thus removed of the noise components. Thus, the above noise correction process is also effective for the patch image with the periodical variations of toner adhesion. Furthermore, the above noise correction process may be effectively applied to a patch image, the state of toner adhesion variations (or density variations) of which is previously known and in which the degree of the variation is moderate relative to the sampling intervals (distance between adjoining sampling points).

The above example demonstrates that the calculation of the amount of toner adhesion according to the invention is effective for the case where a variety of factors vary the amount of toner adhesion in the patch image which should present the consistent toner adhesion in principle. Likewise, the process of the invention is also effective for a patch image wherein the toner adhesion is purposefully varied in a periodical manner. In this case, the width, the period and the like of the toner adhesion variations in the patch image can be estimated and hence, the numerical values M1 and M2 defining the number of data pieces used for the noise correction may be decided taking such tendencies into account, thereby achieving an effective noise elimination.

Such a patch image with the periodical variations may preferably be formed in the following cases, for example. As mentioned supra, the image (such as the patch image) formed by the engine EG sustains density variations associated with the variations of the structures and performances of the individual parts of the apparatus. In addition, the eccentricity of the roller 75 confronting the density sensor 60 varies the distance between the intermediate transfer belt 71 and the density sensor 60, thus resulting in varied amounts of light detected by the density sensor 60.

In this case, the influence of such variations can be canceled by averaging the sampling results of patch images formed at plural places on the intermediate transfer belt 71 under the same image forming conditions. However, quite a long process time is required if discrete patch images are formed on the intermediate transfer belt 71 each time the image forming conditions are changed.

As a solution to this problem, it may be contemplated to form individual patch images under different image forming conditions from the above and interpose these patch images between a respective pair of adjoining ones of the aforesaid patch images formed under the same conditions. In the apparatus of the above embodiment adapted to form patch images using the developing bias varied in 6 steps, for example, a patch image may be formed at a second developing bias at place adjacent a patch image formed at a first developing bias. In this manner, the subsequent patch images may be formed using third to sixth developing biases, respectively, and then, the patch image formation at the first developing bias, the patch image formation at the second developing bias, . . . may be repeated in cycles. Subsequently, the sampling results of the patch images formed at the same level of developing bias are averaged. Based on the average value thus obtained, the amount of toner adhesion in correspondence to the developing bias of interest may be determined. This permits the process time to be reduced as well as the aforementioned influence of the density variations to be canceled.

In a macroscopic view of the groups of patch images thus formed, the amount of toner adhesion is periodically varied. Particularly if there is no space between a respective pair of adjoining patch images, the whole groups of patch images may be regarded as a single image having a pattern of periodical toner-adhesion variations. The calculation of the amount of toner adhesion according to the invention may preferably be used when the amount of toner adhesion to such an image is determined.

Third Preferred Embodiment

The apparatus of the second embodiment adopts the method wherein the patch image consisting of the repeated same pattern and wherein the control factor affecting the image quality is optimized based on the sensed amount of toner adhered to the patch image. In contrast, an apparatus according to a third preferred embodiment of the invention forms a patch image having gradations with gradually change of tone (hereinafter, referred to as "gradation patch image") as will be described hereinlater and controls tone characteristics of the apparatus based on sensed amount of toner adhered to the patch image. In the determination of the amount of toner adhered to the gradation patch image, the noise correction is performed just as in the second embodiment.

The arrangement and operations of the apparatus of the third preferred embodiment are essentially the same as those of the second embodiment. However, the apparatus of the third embodiment differs from that of the second embodiment in that this apparatus has a configuration and a control operation mode (tone correction mode) for achieving more excellent tone reproducibility.

For achieving even more favorable tone correction characteristics of the apparatus, it is preferred to perform the optimization process for the control factors according to the second embodiment and then, a tone correction process according to the third embodiment.

Figure 30:
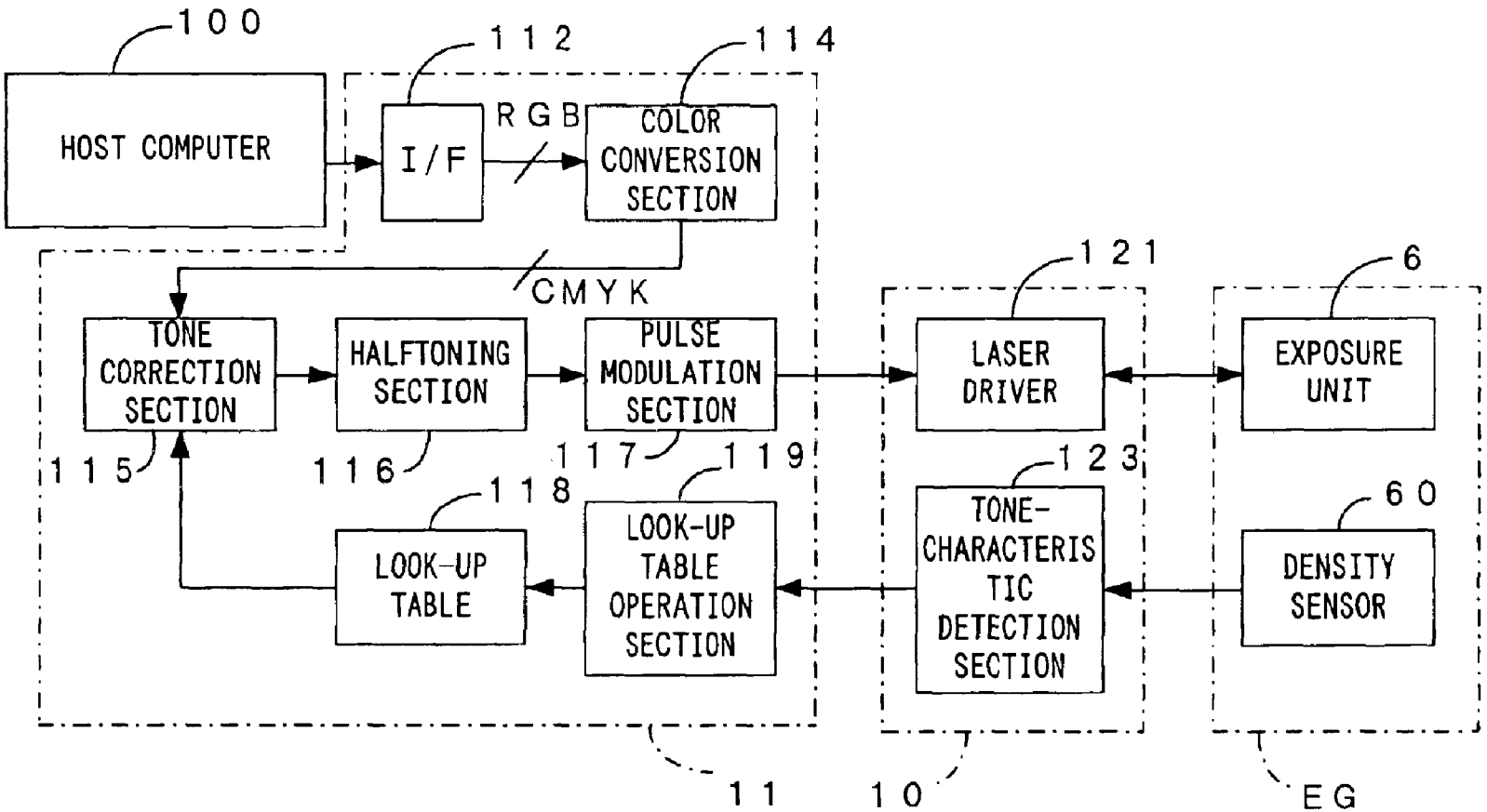
FIG. 30 is a block diagram which shows a tone processing block of an image forming apparatus according to a third preferred embodiment.

FIG. 30 is a block diagram which shows a tone processing block of the image forming apparatus according to the third preferred embodiment of the invention. The main controller 11 includes functional blocks such as a color conversion section 114, a tone correction section 115, a halftoning section 116, a pulse modulation section 117, a look-up table 118 and a look-up table operation section 119.

The engine controller 10 includes, additionally to the CPU 101, RAM 106 and ROM 107 shown in FIG. 2, a laser driver 121 for driving the laser light source disposed at the exposure unit 6, and a tone-characteristic detection section 123 for detecting a tone characteristic indicative of gamma characteristics of the engine EG based on the detection results given by the density sensor 60.

In the main controller 11 receiving an image signal from the host computer 100, the color conversion section 114 converts RGB color-tone data into CMYK color-tone data, the RGB color-tone data representing tone levels of RGB components for each pixel in an image corresponding to the image signal, the CMYK color-tone data representing tone levels of CMYK components corresponding to the RGB components. In the color conversion section 114, the input RGB color-tone data comprise, for example, 8 bits per color component for each pixel (or capable of representing 256 tone levels). Similarly, the output CMYK color-tone data also comprise 8 bits per color component for each pixel (or capable of representing 256 tone levels). The color conversion section 114 outputs the CMYK color-tone data to the tone correction section 115.

The tone correction section 115 performs the tone correction of the per-pixel CMYK color-tone data inputted from the color conversion section 114. Specifically, the tone correction section 115 refers to the look-up table 118 previously stored in the non-volatile memory. Based on the look-up table 118, the tone correction section converts the per-pixel CMYK color-tone data, inputted from the color conversion section 114, into corrected CMYK color-tone data representing corrected tone levels. A purpose of the tone correction is to compensate for the variations of the gamma characteristics of the engine EG of the above arrangement, thereby to maintain ideal gamma characteristics of the whole image forming apparatus at all times.

The CMYK color-tone data thus corrected are inputted to the halftoning section 116. The halftoning section 116 performs a halftoning process, such as error diffusion, dithering or screening, and then supplies the pulse modulation section 117 with halftoned CMYK color-tone data comprising 8 bits per color component for each pixel.

The halftoned CMYK color-tone data inputted to the pulse modulation section 117 indicate respective sizes of the CMYK color toners to be made adhere to each pixel. Based on such halftoned CMYK color-tone data thus received, the pulse modulation section 117 generates a video signal for pulse width modulation of an exposure laser pulse for each of CMYK color images, the exposure laser pulse applied by the engine EG. Then, the pulse modulation section 117 outputs the resultant signal to the engine controller 10 via a video IF not shown. In response to the video signal, the laser driver 121 performs ON/OFF control of a semiconductor laser of the exposure unit 6 whereby an electrostatic latent image of each of the color components is formed on a photosensitive member 2. Normal printing is performed in this manner.

Furthermore, the image forming apparatus has a tone correction mode which is performed at a proper time after the activation of the apparatus, for example, for forming a gradation patch image for tone correction and re-defining the look-up table. Operations in the tone correction mode are carried out as follows. For each toner color, the engine EG forms a predetermined gradation patch image for tone correction on the intermediate transfer belt 71 the patch image used for the determination of the gamma characteristics. The density sensor 60 senses amounts of toner adhered to each gradation patch image. Based on signals from the density sensor 60, the tone-characteristic detection section 123 generates a tone characteristic curve (the gamma characteristics of the engine EG) relating the sensed image densities to the tone levels of each gradation patch image and then, outputs the resultant characteristic curve to the look-up table operation section 119 of the main controller 11.

According to the embodiment, data on the gradation patch image are programmed, for example, in the ROM of the main controller 11 so that the aforementioned image forming operations are performed based on the image data to form the gradation patch image of the predetermined pattern on the intermediate transfer belt 71.

Figure 31A:
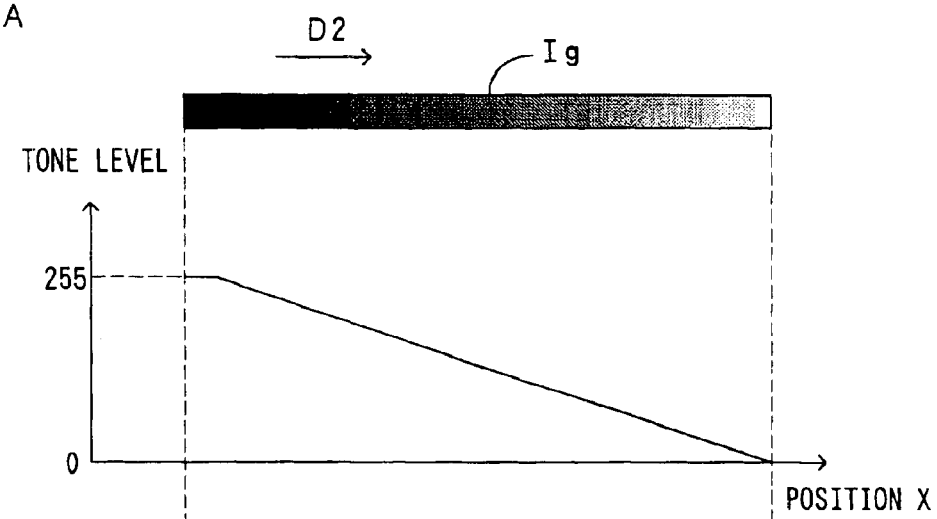
FIGS. 31A and 31B are graphical representations of a gradation patch image.
Figure 31B:
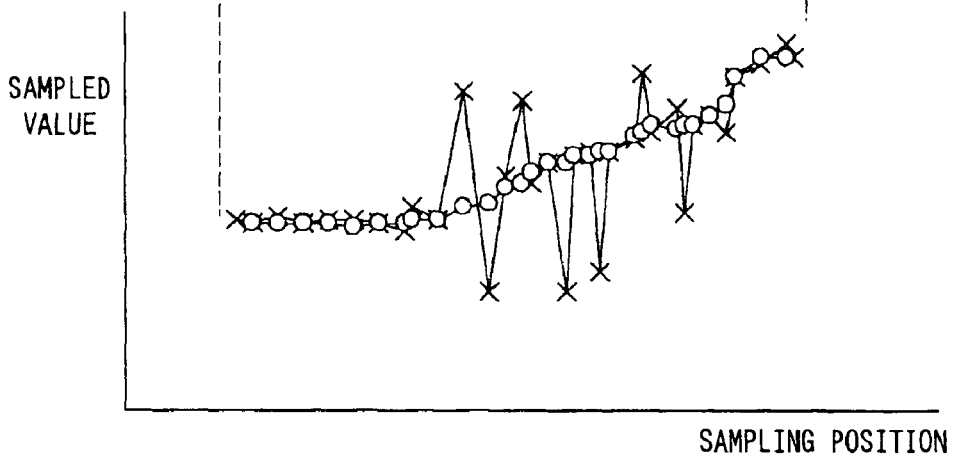

FIGS. 31A and 31B are graphical representations of the gradation patch image. As seen in FIG. 31A, a gradation patch image Ig according to the embodiment extends in a strip along the moving direction D2 of the intermediate transfer belt 71. Furthermore, the gradation patch image does not have a consistent tone level but varied tone levels which are successively decreased from the maximum level (level 255) to the minimum level (level 0) along the moving direction D2.

Figure 32:
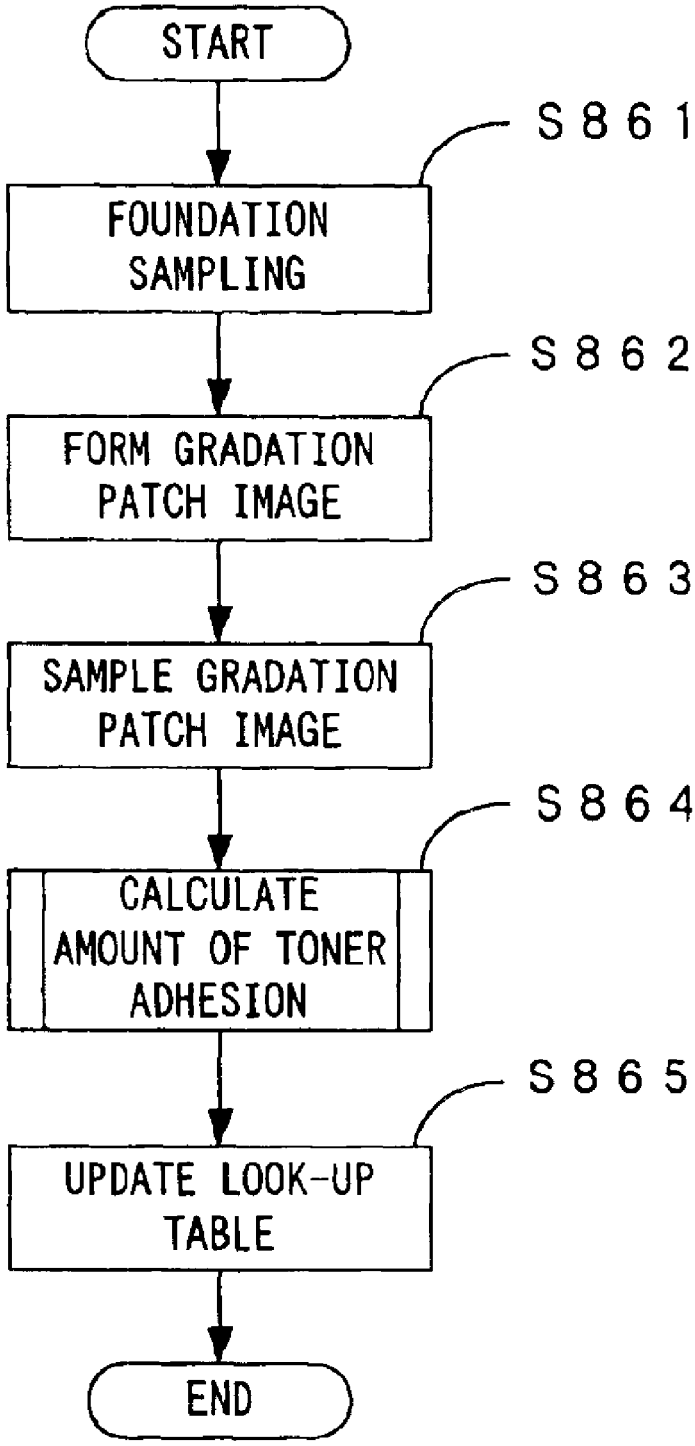
FIG. 32 is a flow chart which shows steps taken in a tone correction mode.
Figure 33:
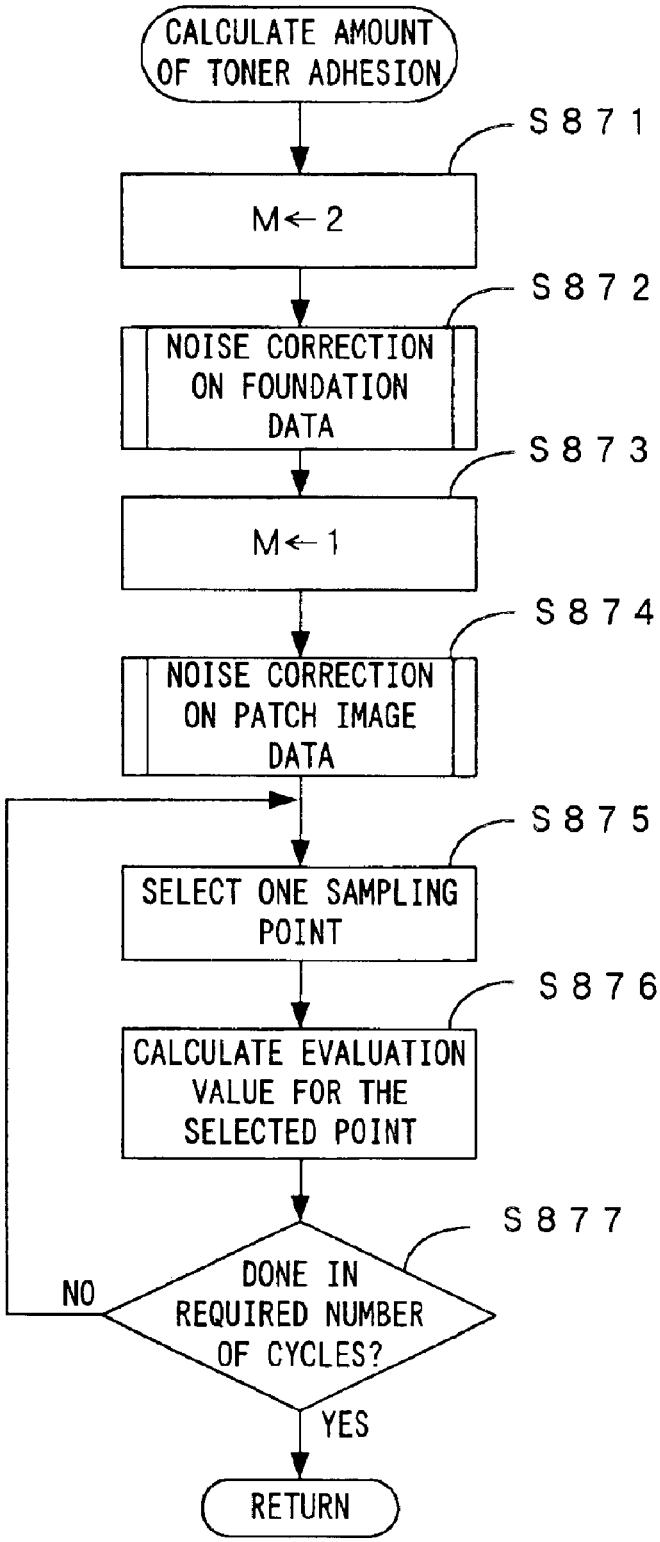
FIG. 33 is a flow chart which shows the steps of a toner-adhesion calculation process in the tone correction mode.

FIG. 32 is a flow chart which shows the steps of the tone correction mode, whereas FIG. 33 is a flow chart which shows the steps of a process for calculating the amounts of toner adhesion performed in the tone correction mode. The fundamental operations of the process are the same as those of the developing-bias optimization process shown in FIG. 24 and hence, the description of the common steps is dispensed with.

In the tone correction mode, the foundation sampling is first performed on the intermediate transfer belt 71 prior to the formation of the gradation patch image (Step S861). Then, the gradation patch image Ig as shown in FIG. 31A is formed as the patch image on the belt (Step S862). Subsequently, the gradation patch image Ig is sampled (Step S863) and then, the amounts of toner adhesion are calculated from the sampling results (Step S864).

A significant difference consists in that the toner-adhesion calculation process of the third embodiment determines the amount of toner adhesion (evaluation value) for each of the sampling points, whereas the process of the first and second embodiment determines the average amount of toner adhesion for the overall patch image. This is because the patch image Ig does not have a consistent toner adhesion but has tone levels varied from position to position, and because information used for the tone correction requires the amount of toner adhesion (evaluation value) for each tone level.

Accordingly, the toner-adhesion calculation process of the embodiment(Steps S871 to S877 in FIG. 33) does not calculate the respective average values of the post-noise-correction foundation data and patch image data, but calculates the respective evaluation values of the individual sampling points using the respective post-correction foundation data pieces and patch image data pieces on the individual sampling points (Steps S875, S876). The discrete evaluation values of the individual sampling points are determined by repeating the above steps in a required number of cycles (Step S877).

In this process, the evaluation value Gr is determined as a function of the position x with respect to the moving direction D2 of the intermediate transfer belt 71, using the following equation, for example:

$$Gr(x)=1-\{Sg\cdot(Vdp(x)-Vp0)-(Vds(x)-Vs0)\}/\{Sg\cdot(Vtp(x)-Vp0)-(Vts(x)-Vs0)\} \quad \text{(Equation 3.1)}$$

The details of the noise correction process are the same as those of the process shown in FIG. 26. The foundation data are corrected based on M1=M2=2 using 5 data pieces in total, whereas the patch image data are corrected based on M1=M2=1 using 3 data pieces in total. In this manner, the pre-correction sample data string including noises indicated by mark 'x' in FIG. 31B is corrected into the data string indicated by blank circles in the figure, whereby the influence of noises is decreased. In the gradation patch image Ig, the image pattern per se is varied from position to position so that information on the position-varying amounts of toner adhesion is required. Therefore, the use of too many data pieces for the noise correction is not favorable because the variations of the amount of toner adhesion from position to position are masked.

FIG. 31B shows a tendency that the sampled value increases with decrease of the image density in association with decrease in the tone level of the patch image Ig. This tendency is attributable to the characteristics of the density sensor 60. Specifically, the density sensor 60 is designed to sense the amount of light reflected from the surface of the intermediate transfer belt 71 and hence, is characterized by providing the output decreased in conjunction with increase in the amount of adhered toner scattering/absorbing the irradiated light.

Figure 34:
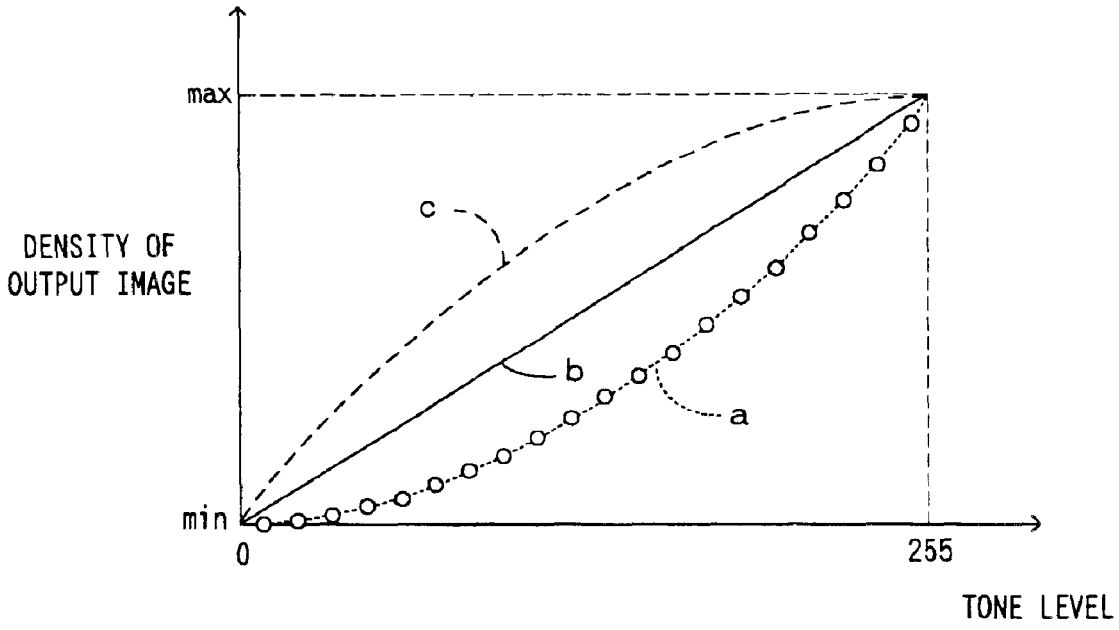
FIG. 34 is a graph which shows tone characteristics and corrected tone characteristics of an engine.

FIG. 34 is a graph which shows tone characteristics and corrected tone characteristics of the engine. As represented by a curve 'a' in FIG. 34, for example, a curve representing the tone characteristics of the apparatus is obtained by plotting the individual evaluation values Gr against the respective tone levels, the evaluation values determined for the individual points in the gradation patch image Ig. The tone characteristics based on measurements do not always coincide with the idealistic tone characteristics (exemplified by a curve 'b' in FIG. 34) because of individually different apparatus characters, variations with time, or changes in conditions surrounding the apparatus. As a solution to this problem, therefore, the image signal is previously subjected to tone correction based on inverse tone characteristics, such as represented by a curve 'C' in FIG. 34, to the above measured tone characteristics. This permits the formation of an image faithfully reproducing the tone characteristics of the input image signal.

Specifically, the look-up table operation section 119 performs operation based on the tone characteristics supplied from the tone-characteristic detection section 123 thereby generating look-up table data for obtaining the ideal tone characteristics as compensating for the measured tone characteristics of the engine EG. Subsequently, the look-up table operation section 119 updates the content of the look-up table 118 to the resultant data (Step S865 in FIG. 32. In this manner, the look-up table 118 is re-defined (tone correction mode).

In the subsequent image forming operations, the per-pixel CMYK color-tone data inputted from the color conversion section 114 are corrected with reference to the updated look-up table 118 so that a high-quality image of excellent tone characteristics may be formed based on the corrected CMYK color-tone data. Furthermore, the look-up table updated on an as-required basis permits an ideal tone correction to be accomplished at any time in correspondence to the time-varying gamma characteristics of the engine EG. Thus is ensured the stable formation of images of a consistent image quality.

According to the second and third embodiments as described above, the reflection light from each of the positions in the patch image is sampled and then, the amount of toner adhesion at each position is determined based on the data corrected using the median of the plural sample data pieces on the subject sampling point and its neighboring points. Therefore, the amount of toner adhesion corresponding to the density of the patch image can be determined with high accuracies without sustaining the influence of noises.

The amount of toner adhesion is determined based on the sampled reflection light from the patch image and on the sampled reflection light from the surface of the intermediate transfer belt 71 prior to the formation of the patch image. Therefore, the resultant data are less susceptible to the influence of the surface conditions of the intermediate transfer belt 71, thus contributing to the high-accuracy determination of the amount of toner adhesion.

In addition, the number of data pieces used for the noise correction wherein the patch image is formed on the intermediate transfer belt 71 is different from those used for the noise correction wherein no image is formed thereon. This provides for a proper correction according to the state of the evaluation subject (the intermediate transfer belt 71 here).

Such a toner-adhesion calculation method is applicable to both the image of a given pattern as illustrated by the second embodiment and the gradation image as illustrated by the third embodiment. Besides the image having the continuously varied tone levels as illustrated by the third embodiment, the method is also applicable to an image having the tone levels varied stepwise, for example.

It is noted that the invention is not limited to the foregoing embodiments and various changes and modifications may be made thereto within the sprits and scope of the invention.

For instance, in the second and third embodiments, data pieces on the opposite ends of the sample data string are only used for the noise correction of other data pieces but are not used as valid data indicative of the amounts of toner adhered to the sampling points at terminal ends. However, the following processing may be performed to permit the data pieces on the points at the terminal ends to be used as the valid data. In a first example, the sample data pieces on the points at the terminal ends of the string are not subjected to the noise correction and the sample values thereof are directly used as valid data on the sampling points at the terminal ends. In a second example, an average value of a sample data piece on a sampling point of interest and a post noise-correction data piece on a next sampling point thereto is determined and the resultant average value is used as a corrected data piece on the sampling point of interest.

Further, the second and third embodiments determine the amount of toner adhesion at one sampling point, using the sample data on an equal number of sampling points upstream and downstream from the sampling point of interest. However, the sampling points on the upstream side and on the downstream side need not necessarily be in the same number and the calculation may use an arbitrary number of sample data pieces which may be divided between the upstream side and the downstream side in an arbitrary ratio.

In the foregoing embodiments, the amount of toner adhered to the surface of the intermediate transfer belt 71 is sensed by the density sensor 60 in opposing relation therewith. An alternative arrangement may be made such that the density sensor is disposed in opposing relation with the photosensitive member 2 in order to sense the amount of toner adhered to the surface thereof.

While the foregoing embodiments apply the invention to the apparatus for forming an image using the 4 toners of yellow, magenta, cyan and black, the type of toner or the number of toner colors is not limited to the above and may be selected arbitrarily. Besides the apparatus of the rotary developing system as used herein, the invention is also applicable to an image forming apparatus of a so-called tandem system wherein developing units for individual toner colors are arranged in line along a sheet feeding direction. Furthermore, the invention is applicable not only to the electrophotographic apparatuses as illustrated by the foregoing embodiments but also to the all types of image forming apparatuses.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus arranged to determine an amount of toner adhered to a predetermined subject region of calculation in a surface of an image carrier, comprising:

an optical sensor which irradiates light on a smaller measurement area than said subject region of calculation for receiving light therefrom, and which outputs a signal corresponding to an amount of received light; and control means which acquires N1 (N1 being a natural number of 2 or more) sample data pieces by sampling output signals from said optical sensor with respect to said measurement areas present at different N1 places in said subject region of calculation and determines the amount of toner adhered to said subject region of calculation based on N2 sample data pieces out of said N1 sample data pieces (N2 being a smaller natural number than N1).

2. An image forming apparatus as claimed in claim 1, wherein said control means performs a noise elimination process for removing a predetermined number of data pieces of higher order and/or of lower order from said N1 sample data pieces, thereby obtaining said N2 sample data pieces.

3. An image forming apparatus as claimed in claim 2, wherein said control means determines the amount of toner adhered to said subject region of calculation based on an average value of said N2 sample data pieces.

4. An image forming apparatus as claimed in claim 2, wherein said control means replaces each of the removed (N1–N2 ) sample data pieces with the average value of said N2 sample data pieces, and determines the amount of toner adhered to said subject region of calculation based on said N1 data pieces including said (N1–N2 ) data pieces thus replaced and said N2 sample data pieces.

5. An image forming apparatus as claimed in claim 2, wherein said control means controls image density by forming, as a patch image, a toner image of a predetermined pattern on said image carrier; calculating the amount of toner adhered to said subject region of calculation defined by at least a part of said patch image; and then based on the calculation result, adjusting a control factor affecting the image density.

6. An image forming apparatus as claimed in claim 5, wherein said control means performs said sampling and noise elimination processes on said subject region of calculation in respective states where the patch image is borne on said image carrier and where said image carrier bears no patch image thereon, and determines the amount of toner adhered to said subject region of calculation within said patch image based on the results of these processes.

7. An image forming apparatus as claimed in claim 6, wherein the sample data piece removed by said control means performing the noise elimination process on the sample data pieces acquired from the patch image borne on said image carrier is related to the same measurement area that corresponds to the sample data piece removed by said control means performing the noise elimination process on the sample data pieces acquired from said image carrier bearing no patch image thereon.

8. An image forming apparatus as claimed in claim 5, wherein said image carrier is arranged to rotate in a predetermined direction, and wherein said control means forms the patch image which has a greater length than a circumferential length of said image carrier with respect to said predetermined direction and in which said subject region of calculation has substantially an equal length to the circumferential length of said image carrier with respect to said predetermined direction.

9. A toner-adhesion calculation method for determining an amount of toner adhered to a predetermined subject region of calculation in a surface of an image carrier comprising the steps of:

irradiating light on a smaller measurement area than said subject region of calculation for receiving light therefrom; acquiring N1 sample data pieces by sampling signals corresponding to amounts of received light; and determining the amount of toner adhered to said subject region of calculation based on N2 sample data pieces out of said N1 sample data pieces (N2 being a smaller natural number than N1).

10. A toner-adhesion calculation method as claimed in claim 9, wherein said N2 sample data pieces are obtained by performing a noise elimination process wherein a predetermined number of data pieces of higher order and/or of lower order are removed from said N1 sample data pieces.

11. A data processing method for determining an amount of toner adhered to a predetermined subject region of calculation in a surface of an image carrier comprising the steps of:

irradiating light on a smaller measurement area than said subject region of calculation for receiving light therefrom; acquiring N1 sample data pieces by sampling signals corresponding to amounts of received light; removing a predetermined number of data pieces of higher order and/or lower order from said N1 sample data pieces; and using the remaining N2 sample data pieces as valid data for calculating the amount of toner adhered to said subject region of calculation.

12. An image forming apparatus arranged to determine an amount of toner adhered to a predetermined subject region of calculation in a surface of an image carrier, comprising:

an optical sensor which irradiates light on a measurement area in the surface of said image carrier for receiving light therefrom, and which outputs a signal corresponding to an amount of received light; and control means which acquires sample data pieces by sampling output signals from said optical sensor with respect to individual measurement areas, regarding each of said subject region of calculation and its plural neighboring regions as said measurement area, and which determines the amount of toner adhered to said subject region of calculation based on the sample data pieces.

13. An image forming apparatus as claimed in claim 12, wherein said control means determines the amount of toner adhered to said subject region of calculation based on the sample data pieces on (M1+M2+1) measurement areas including said subject region of calculation and said measurement areas at M1 places upstream therefrom along the predetermined direction (M1 being a natural number) and at M2 places downstream therefrom along said predetermined direction (M2 being a natural number).

14. An image forming apparatus as claimed in claim 13, wherein said control means determines the amount of toner adhered to said subject region of calculation based on a median of the sample data pieces on the measurement areas at said (M1+M2+1) places, provided that said M1 and M2 are at an equal numerical value.

15. An image forming apparatus as claimed in claim 13, wherein said control means forms a toner image as a patch image on said image carrier, said patch image varied in the tone level thereof along the predetermined direction; calculates respective amounts of toner adhered to the plural subject regions of calculation arranged in said patch image at different positions along said predetermined direction; and then, performs tone correction of the apparatus based on the calculation results.

16. An image forming apparatus as claimed in claim 15, wherein said control means performs the sampling on said subject region of calculation and the predetermined number of its neighboring measurement areas in respective states where said patch image is borne on said image carrier and where said image carrier bears no patch image thereon; determines a respective median of these sample data sets; and determines the amount of toner adhered to said subject region of calculation based on the median determined for the state where said patch image is borne on said image carrier and the median determined for the state where said image carrier bears no image thereon.

17. An image forming apparatus as claimed in claim 16, wherein a number of sample data pieces used for determining the median for the state where said image carrier bears no patch image thereon is greater than a number of sample data pieces used for determining the median for the state where said patch image is borne on said image carrier.

18. An image forming apparatus as claimed in claim 13, wherein said (M1+M2+1) measurement areas are arranged with equal spacing along said predetermined direction.

19. An image forming apparatus as claimed in claim 18, wherein said control means performs the sampling at regular time intervals as moving said image carrier at a given speed along said predetermined direction, thereby acquiring the sample data pieces on said (M1+M2+1) measurement areas.

20. An image forming apparatus as claimed in claim 12, wherein said control means forms, as a patch image, a toner image of a predetermined pattern on said image carrier; calculates the amount of toner adhered to said subject region of calculation within said patch image; and then, based on the calculation result, adjusts a control factor affecting image quality.

21. An image forming apparatus as claimed in claim 20, wherein said control means performs the sampling on said subject region of calculation and a predetermined number of its neighboring measurement areas in respective states where said patch image is borne on said image carrier and where said image carrier bears no patch image thereon; determines a respective median of these sample data sets; and then determines the amount of toner adhered to said subject region of calculation based on the median determined for the state where said patch image is borne on said image carrier and the median determined for the state where said image carrier bears no patch image thereon.

22. A toner-adhesion calculation method for determining an amount of toner adhered to a predetermined subject region of calculation in a surface of an image carrier comprising the steps of:

irradiating light on individual measurement areas for receiving light therefrom, regarding each of said subject region of calculation and its plural neighboring regions as said measurement area; acquiring sample data pieces by sampling signals corresponding to amounts of received light from said individual measurement areas; and determining the amount of toner adhered to said subject region of calculation based on the sample data pieces.

23. A data processing method for determining an amount of toner adhered to a predetermined subject region of calculation in a surface of an image carrier comprising the steps of:

irradiating light on (2M1+1) measurement areas for receiving light therefrom, said measurement areas including said subject region of calculation and areas at M1 places (M1 being a natural number) upstream from said subject region along a predetermined direction and at M1 places downstream therefrom along said predetermined direction; acquiring sample data pieces by sampling signals corresponding to amounts of received light; replacing the sample data piece on said subject region of calculation with a median of said (2M1+1) sample data pieces; and using the replaced data piece as valid data for calculating the amount of toner adhered to the subject region of calculation.

* * * * *